US007097962B2

(12) United States Patent
Komatsu et al.

(10) Patent No.: US 7,097,962 B2
(45) Date of Patent: Aug. 29, 2006

(54) SILVER SALT PHOTOTHERMOGRAPHIC DRY IMAGING MATERIAL

(75) Inventors: Hideki Komatsu, Hachioji (JP); Hideki Takiguchi, Sagamihara (JP)

(73) Assignee: Konica Minoltn Medical & Graphic, Inc. (JP)

( * ) Notice: Subject to any disclaimer, the term of this patent is extended or adjusted under 35 U.S.C. 154(b) by 39 days.

(21) Appl. No.: 10/968,777

(22) Filed: Oct. 19, 2004

(65) Prior Publication Data

US 2005/0089807 A1 Apr. 28, 2005

(30) Foreign Application Priority Data

Oct. 24, 2003 (JP) ..... 2003-364446
Jan. 19, 2004 (JP) ..... 2004-010262
Jan. 22, 2004 (JP) ..... 2004-014067

(51) Int. Cl.
*G03C 1/00* (2006.01)
*G03C 1/05* (2006.01)
*G03C 1/494* (2006.01)

(52) U.S. Cl. ..... 430/617; 430/618; 430/619; 430/620; 430/567

(58) Field of Classification Search ..... 430/617, 430/618, 619, 620, 567
See application file for complete search history.

(56) References Cited

U.S. PATENT DOCUMENTS

2003/0203323 A1* 10/2003 Takiguchi et al. ..... 430/350
2005/0064352 A1* 3/2005 Suzuki et al. ..... 430/619

FOREIGN PATENT DOCUMENTS

| | | |
|---|---|---|
| EP | 1 168 069 A1 | 1/2002 |
| EP | 1 345 075 A2 | 9/2003 |
| JP | 63-60446 | 3/1988 |

OTHER PUBLICATIONS

European Search Report for Application No. 04024855.1-1217-Dated Dec. 9, 2004.
JP63060446 English Abstract for JP 63-60446.

* cited by examiner

*Primary Examiner*—Geraldine Letscher
(74) *Attorney, Agent, or Firm*—Cantor Colburn LLP

(57) ABSTRACT

A photothermographic imaging material containing a support having thereon light-insensitive organic silver salt grains, photosensitive silver halide grains, a reducing agent for silver ions and a binder, wherein, (i) each of the organic silver salt grains has a structure having different silver ion dissociation constants at a surface portion and at an inner portion of the grain; (ii) each of the silver halide grains produces a larger number of latent images in a surface portion than in an inner portion of the grain by exposure to light; (iii) each of the silver halide grains produces a larger number of latent images in the inner portion than in the surface portion of the grain after being subjected to a thermal development; and (iv) a surface photographic speed of each of the silver halide grains decreases after being subjected to the thermal development.

10 Claims, No Drawings

SILVER SALT PHOTOTHERMOGRAPHIC DRY IMAGING MATERIAL

FIELD OF THE INVENTION

The present invention relates to a silver salt photothermographic dry imaging material.

BACKGROUND OF THE INVENTION

In recent years, in the medical and graphic arts fields, a decrease in the processing effluent has been increasingly demanded from the viewpoint of environmental protection as well as space saving.

As a result, techniques have been sought which relate to photothermographic materials which can be effectively exposed, employing laser imagers and laser image setters, and can form clear black-and-white images exhibiting high resolution.

Such techniques are described in, for example, U.S. Pat. Nos. 3,152,904 and 3,487,075, both by D. Morgan and B. Shely, or D. H. Klosterboer et al., "Dry Silver Photographic Materials", (Handbook of Imaging Materials, Marcel Dekker, Inc. page 48, 1991). Also known are silver salt photothermographic dry imaging materials (hereinafter occasionally referred to simply as photothermographic materials) which comprise a support having thereon organic silver salts, photosensitive silver halide and reducing agents. Since any solution-based processing chemicals are not employed for the aforesaid silver salt photothermographic dry imaging materials, they exhibit advantages in that it is possible to provide a simpler environmentally friendly system to customers.

These silver salt photothermographic dry imaging materials are characterized in that photosensitive silver halide grains, which are incorporated in a photosensitive layer, are utilized as a photo-sensor and images are formed in such a manner that silver halide grains are thermally developed, commonly at 80 to 140° C., utilizing the incorporated reducing agents while using organic silver salts as a supply source of silver ions, and fixing need not be carried out.

However, the aforesaid silver salt photothermographic dry imaging materials tend to result in fogging during storage prior to thermal development, due to incorporation of organic silver salts, photosensitive silver halide grains and reducing agents. Further, after exposure, thermal development is commonly carried out at 80 to 250° C. followed by no fixing. Therefore, since all or some of the silver halide, organic silver salts, and reducing agents remain after thermal development, problems occur in which, during extended storage, image quality such as silver image tone tends to vary due to formation of metallic silver by heat as well as light.

Techniques which overcome these problems are disclosed in Patent Documents Nos. 1 and 2 employing vinyl sulfone compounds or photo oxidation compounds. These techniques disclosed therein exhibit some effects, but are not fully sufficient to meet the market's requirements.

In addition, for the purpose of enhancing covering power (CP), when the number of photosensitive silver halide grains is increased while decreasing the diameter of the aforesaid grains, it has been found that problems occur in which variation and degradation of image quality such as tone of silver images are further accelerated due to effects of light incident to the aforesaid photosensitive slier halide grains during storage of the aforesaid photosensitive silver halide grains after development as well as while viewing them.

A technology employing a leuco dye capable of producing color is disclosed. This technology enables to adjust a hue of silver to a preferred color. The hue of silver is caused by a morphology of silver. Examples of such technology are disclosed in Japanese Patent Publication Open to Public Inspection (hereafter it is referred to as JP-A) Nos. 50-36110, 59-206831, 5-204087, 11-231460, 20002-169249 and 2002-236334. However, this technology is not fully effective to prevent change of color of silver after long-term storage.

It is disclosed another technology to prevent change and deterioration of silver caused by irradiation of light. That technology employs a halogenated compound capable of oxidizing a silver image by irradiation of light. Examples of compounds are shown in Patent Documents Nos. 3 and 4. However, these compounds generally tend to exhibit an oxidizing property by an effect of heat. As a result, they have an effect of preventing fog formation but at the same time they may prevent formation of a silver image resulting in a loss of photographic speed, a loss of Dmax and a loss of a silver covering power.

On the other hand, these silver salt photothermographic dry imaging materials always incorporate developing agents, organic carboxylic acid silver salts as a silver supplying source, and light-sensitive silver halide. As a result, not only storage stability prior to exposure but also that of after thermal development results in major problems.

Disclosed as techniques to enhance stability of these silver salt photothermographic dry imaging materials is one in which with regard to cores and shells of organic carboxylic acid silver salt particles, particles are subjected to formation of core/shell, and by changing the silver salt composition of the surface from that of the interior, developability at relatively low temperature is improved to result in high Dmax (refer, for example to Patent Document 5). However, it was discovered that when the silver salt composition of the surface was only changed from that of the interior, stability was degraded, whereby storage stability was also occasionally deteriorated.

On the other hand, disclosed as a technique to enhance stability of silver salt photothermographic dry imaging materials is one in which employed as light-sensitive silver halide grains are those which are surface-sensitive prior to thermal development and become an internal image forming type (refer, for example, to Patent Document 6). This is an epoch-making technique in which after thermal development, light-sensitive silver halide grains are subjected to be of an internal image forming type to result in rapid decrease in surface photographic speed, whereby even though silver salt photothermographic drying imaging materials are exposed to natural light, no fog is formed and storage stability of images is improved. However, problems occur in which depending on storage conditions prior to exposure, photographic speed markedly decreases especially during storage at relatively high humidity.

On the other hand, demanded as so-called "eternal object" is further improvement of image quality. Specifically, in the medical image field, demanded is development of techniques to achieve higher quality images to enable more accurate diagnosis.

It is demanded to develop a new and high technology to achieve a high image quality in order to solve the above-described problems in the imaging materials of the present technical field.

Patent Document No. 1: JP-A No. 6-208192
Patent Document No. 2: JP-A No. 8-267934
Patent Document No. 3: JP-A No. 7-2781

Patent Document No. 4: JP-A No. 6-208193
Patent Document No. 5: JP-A No. 2002-23303
Patent Document No. 6: JP-A No. 2003-270755

SUMMARY OF THE INVENTION

From the viewpoint of the foregoing, the present invention was achieved. An object of the present invention is to provide a silver salt photothermographic dry imaging material which exhibits excellent storage stability under the change of ambient temperature and humidity, with high speed as well as low fogging, and further exhibits an excellent processing stability.

An aspect of the present invention is a photothermographic imaging material containing a support having thereon light-insensitive organic silver salt grains, photosensitive silver halide grains, a reducing agent for silver ions and a binder, wherein each of the light-insensitive organic silver salt grains has specific grain structure with respect to a silver dissociation constant, and at the same time, each of photosensitive silver halide grains exhibits decreasing of surface sensitivity after being subjected to thermal processing.

DESCRIPTION OF THE PREFERRED EMBODIMENTS

These and other objects of the present invention are accomplished by one of the following embodiments.

1. An embodiment of the present invention includes a photothermographic imaging material comprising a support having thereon light-insensitive organic silver salt grains, photosensitive silver halide grains, a reducing agent for silver ions and a binder, wherein:

(i) each of the light-insensitive organic silver salt grains has a structure having different silver ion dissociation constants at a surface portion of the grain and at an inner portion of the grain;

(ii) each of the photosensitive silver halide grains produces a larger number of latent images in a surface portion of the grain than in an inner portion of the grain by exposure to light;

(iii) each of the photosensitive silver halide grains produces a larger number of latent images in the inner portion of the grain than in the surface portion of the grain after being subjected to a thermal development; and (iv) a surface photographic speed of each of the photosensitive silver halide grains decreases after being subjected to the thermal development.

2. Another embodiment of the present invention includes a photothermographic imaging material of Item 1, wherein:

(i) each of the light-insensitive organic silver salt grains comprises an aliphatic carboxylic acid and a silver salt of the aliphatic carboxylic acid; and (ii) each of the light-insensitive organic silver salt grains has a different weight ratio of the aliphatic carboxylic acid to the silver salt of the aliphatic carboxylic acid in the surface portion of the grain and in the inner portion of the grain.

3. Another embodiment of the present invention includes a photothermographic imaging material of Item 1, wherein each of the light-insensitive organic silver salt grains is covered with a coating material.

4. Another embodiment of the present invention includes a photothermographic imaging material of Items 1–3, wherein the light-insensitive organic silver salt grains are subjected to a thermal treatment at no less than 80° C.

5. Another embodiment of the present invention includes a photothermographic imaging material of Items 1–4, wherein the light-insensitive organic silver salt grains comprises one kind of silver salt of an aliphatic carboxylic acid in an amount of not less than 50 mol % based on the total mol of the silver salts of aliphatic carboxylic acids contained in the organic silver salt grains.

6. Another embodiment of the present invention includes a photothermographic imaging material of Item 1, further comprising a surface active agent having a HLB value of 3 to 7.

7. Another embodiment of the present invention includes a photothermographic imaging material of Item 6, still further comprising a surface active agent having a HLB value of not less than 8.

8. Another embodiment of the present invention includes a photothermographic imaging material of Items 1, 6 and 7 further comprising a gelatin which is dispersible in an organic solvent as a dispersing agent for the photosensitive silver halide grains.

9. The photothermographic imaging material of Item 1, further comprising a compound represented by Formula (1):

Formula (1)

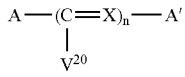

wherein X represents $C(V^{21})$ or a nitrogen atom, each $V^{20}$ and $V^{21}$ independently represents a hydrogen atom or a substituent, provided that $V^{20}$ and $V^{21}$ may form a ring by binding together; each A and A' independently represents a hydrogen atom or a substituent, provided that at least one of A and A' represents OH, OR, $NH_2$, NHR or NRR', each R and R' independently representing a hydrogen atom or a substituent; and A and A' may form a ring by binding together; and n represents an integer of 0 to 5.

10. The photothermographic imaging material of Item 9, the compound represented by Formula (1) is further represented by Formula (DA-1) or Formula (DA-2):

Formula (DA-1)

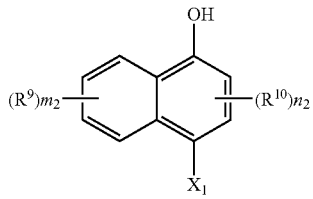

Formula (DA-2)

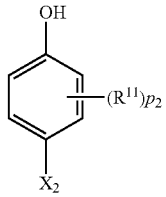

wherein, each $X_1$ and $X_2$ is independently a hydrogen atom or a substituent; each $R^9$ and $R^{11}$ is independently a hydrogen atom or a substituent; each m2 and p2 is independently an integer of 0 to 4; and n2 is an integer of 0 to 2.

The present invention enables to provide a photothermographic material exhibiting excellent storage stability without being affected by the change of ambient temperature and humidity, and having high speed as well as low fogging, and further exhibiting an excellent photographic property.

The present invention will now be further detailed.

(Light-Insensitive Aliphatic Carboxylic Acid Silver Salt Particles Which Result in Different Silver Dissociation of the Surface from that of the Interior)

In the present invention, it is necessary that light-insensitive aliphatic carboxylic acid silver salt particles, which result in different silver dissociation of the surface from that of the interior, are incorporated.

Different silver dissociation of the surface from that of the interior, as described herein, means that the aforesaid light-insensitive aliphatic carboxylic acid salt particles have the interior structure which is different from that of the surface. The shape, thickness, and composition of the covered portions which form the surface of the aforesaid silver salt particles are not particularly limited.

Known as factors which control silver dissociation of light-insensitive aliphatic carboxylic acid silver salt particles are the types of aliphatic carboxylic acids, in the case in which aliphatic carboxylic acid is a mixture, its composition, the simultaneous use of compounds, such as phthalic acid or benzimidazole, which form organic silver salts, the mixing ratio of aliphatic carboxylic acid silver salts to free aliphatic carboxylic acids, and the reactivity with silver supplying compounds such as phthalazine or phthalic acid. In the present invention, any of the methods may be usable and some methods may be employed in combination. Methods which makes silver dissociation of the surface different from that of the interior are not limited to those described above.

In the case of an aliphatic carboxylic acid type and a mixture, it is preferable to control employing its composition and the mixing ratio of aliphatic carboxylic acid silver and free aliphatic carboxylic acid. Further it is preferable that the silver dissociation of the surface is lower than the interior.

(Light-insensitive Aliphatic Carboxylic Acid Silver Salt Particles in Which the Content Ratio of Free Aliphatic Carboxylic Acids to Aliphatic Carboxylic Acid Silver Salts of the Surface is Different from that of the Interior)

Light-insensitive aliphatic carboxylic silver salt particles are basically formed as a mixture of free aliphatic carboxylic acids and aliphatic carboxylic acid silver.

In the present invention, it is preferable that the content ratio of free aliphatic carboxylic acids to aliphatic carboxylic acid silver salts of the surface of slight-intensive aliphatic carboxylic acid silver salt particles is different from that of the interior of the aforesaid particles. The content of aliphatic carboxylic acid silver salts of the interior is preferably at least 0.9 mol, and is more preferably at least 0.95 mol. The content of aliphatic carboxylic acid silver of the surface is preferably in the range of 0–0.9 mol, and is more preferably in the range of 0–0.3 mol. Further, the ratio of the surface to the interior is preferably in the range of 1:100–1:0.1 in terms of the mol ratio of the total aliphatic carboxylic acids.

(Light-insensitive Aliphatic Carboxylic Acid Silver Salt Particles Having a Structure in Which the Particle Surface is Coated)

In the present invention, it is preferable that light-intensive aliphatic carboxylic acid silver salt particles have a structure in which the particle surface is coated.

The purpose of such a surface coated structure is to retard silver dissociation of aliphatic carboxylic acid silver salts as well as reaction with compounds such as phthalazine or phthalic acid capable of forming silver salts. It is possible to select any of the coating materials which achieve the above purpose. For example, a case in which the content ratio of free aliphatic carboxylic acids of the surface of light-insensitive aliphatic carboxylic acid silver salt particles reaches 1 is included in the above surface coating. It is possible to choose any of the coating thickness depending on coating materials to achieve the purposes.

(Light-insensitive Aliphatic Carboxylic Acid Silver Salt Particles Thermally Processed at 80° C. or Higher)

In the present invention, it is preferable that light-insensitive aliphatic carboxylic acid silver salt particles are thermally processed at 80° C. or higher. Any time after formation of aliphatic carboxylic acid silver salt particles may be selected for the thermal processing step. However, it is preferable that the thermal processing is performed during drying of aliphatic carboxylic acid silver salt particles or prior to the dispersion process after drying. Thermal processing temperature is preferably in the range of 80–130° C., while thermal processing time is preferably in the range of 30–300 seconds.

(Light-insensitive Aliphatic Carboxylic Acid Silver Salt Particles in Which at least 50 mol Percent of the Total Aliphatic Carboxylic Acid Silver is Composed of One Type of Aliphatic Carboxylic Acid Silver)

Commonly employed as light-insensitive aliphatic carboxylic acid silver salt particles are those which are composed of at least two aliphatic carboxylic acids.

In the present invention, it is preferable that the light-insensitive aliphatic carboxylic acid silver salt particles are composed in such a manner that at least 50 mol percent of the total aliphatic carboxylic acid silver is composed of one type of an aliphatic carboxylic acid.

Preferred as the aforesaid aliphatic carboxylic acids are behenic acid, arachidic acid, stearic acid, and palmitic acid.

Light-insensitive aliphatic carboxylic acid silver salt particles according to the present invention are composed of silver salt particles having a structure in which silver dissociation of the surface is different from that of the interior. Common methods for producing such light-insensitive aliphatic carboxylic acid silver salts will now be described.

<Light-insensitive Aliphatic Carboxylic Acid Silver Salt>

The light-insensitive aliphatic carboxylic acid silver salts according to the present invention are reducible silver sources which are preferably silver salts of long chain aliphatic carboxylic acids, having from 10 to 30 carbon atoms and preferably from 15 to 25 carbon atoms. Listed as examples of appropriate silver salts are those described below.

For example, listed are silver salts of gallic acid, oxalic acid, behenic acid, stearic acid, arachidic acid, palmitic acid, and lauric acid. Of these, listed as preferable silver salts are silver behenate, silver arachidate, and silver stearate.

Further, in the present invention, it is preferable that at least two types of aliphatic carboxylic acid silver salts are mixed since the resulting developability is enhanced and high contrast silver images are formed. Preparation is preferably carried out, for example, by mixing a mixture consisting of at least two types of aliphatic carboxylic acid with a silver ion solution.

On the other hand, from the viewpoint of enhancing retaining properties of images, the melting point of aliphatic carboxylic acids, which are employed as a raw material of aliphatic carboxylic acid silver, is commonly at least 50° C., and is preferably at least 60° C. The content ratio of aliphatic carboxylic acid silver salts is commonly at least 60 percent, is preferably at least 70 percent, and still more preferably at least 80 percent. From this viewpoint, specifically, it is preferable that the content ratio of silver behenate is higher.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in JP-A No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing the soap with silver nitrate. In such a case, silver halide grains may be mixed together with them.

The kinds of alkaline metal salts employed in the present invention include sodium hydroxide, potassium hydroxide, and lithium hydroxide, and it is preferable to simultaneously use sodium hydroxide and potassium hydroxide. When simultaneously employed, the mol ratio of sodium hydroxide to potassium hydroxide is preferably in the range of 10:90–75:25. When the alkali metal salt of aliphatic carboxylic acid is formed via a reaction with an aliphatic carboxylic acid, it is possible to control the viscosity of the resulting liquid reaction composition within the desired range.

Further, in the case in which aliphatic carboxylic acid silver is prepared in the presence of silver halide grains at an average grain diameter of at most 0.050 μm, it is preferable that the ratio of potassium among alkaline metals in alkaline metal salts is higher than the others, since dissolution of silver halide grains as well as Ostwald ripening is retarded. Further, as the ratio of potassium salts increases, it is possible to decrease the size of fatty acid silver salt particles. The ratio of potassium salts is preferably 50–100 percent with respect to the total alkaline metal salts, while the concentration of alkaline metal salts is preferably 0.1–0.3 mol/1,000 ml.

(Silver Salt Particles at a High Silver Ratio)

An emulsion containing aliphatic carboxylic acid silver salt particles according to the present invention is a mixture consisting of free aliphatic carboxylic acids which do not form silver salts, and aliphatic carboxylic acid silver salts. In view of storage stability of images, it is preferable that the ratio of the former is lower than the latter. Namely, the aforesaid emulsion according to the present intention preferably contains aliphatic carboxylic acids in an amount of 3–10 mol percent with respect to the aforesaid aliphatic carboxylic acid silver salt particles, and most preferably 4–8 mol percent.

Incidentally, in practice, each of the amount of total aliphatic carboxylic acids and the amount of free aliphatic carboxylic acids is determined employing the methods described below. Whereby, the amount of aliphatic carboxylic acid silver salts and free aliphatic carboxylic acids, and each ratio, or the ratio of free carboxylic acids to total aliphatic carboxylic acids, are calculated.

(Quantitative Analysis of the Amount of Total Aliphatic Carboxylic Acids (the Total Amount of These Being Due to Both of the Aforesaid Aliphatic Carboxylic Acid Silver Salts and Free Acids))

(1) A sample in an amount (the weight when peeled from a photosensitive material) of approximately 10 mg is accurately weighed and placed in a 200 ml ovoid flask.

(2) Subsequently, 15 ml of methanol and 3 ml of 4 mol/L hydrochloric acid are added and the resulting mixture is subjected to ultrasonic dispersion for one minute.

(3) Boiling stones made of Teflon (registered trade name) are placed and refluxing is performed for 60 minutes.

(4) After cooling, 5 ml of methanol is added from the upper part of the cooling pipe and those adhered to the cooling pipe are washed into the ovoid flask (this is repeated twice).

(5) The resulting liquid reaction composition is subjected to extraction employing ethyl acetate (separation extraction is performed twice by adding 100 ml of ethyl acetate and 70 ml of water).

(6) Vacuum drying is then performed at normal temperature for 30 minutes.

(7) Placed in a 10 ml measuring flask is 1 ml of a benzanthrone solution as an internal standard (approximately 100 mg of benzanthrone is dissolved in toluene and the total volume is made to 100 ml by the addition of toluene).

(8) The sample is dissolved in toluene and placed in the measuring flask described in (7) and the total volume is adjusted by the addition of toluene.

(9) Gas chromatography (GC) measurements are performed under the measurement conditions below.

Apparatus: HP-5890+HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa (Quantitative Analysis of Free Aliphatic Carboxylic Acids)

(1) A sample in an amount of approximately 20 mg is accurately weighed and placed in a 200 ml ovoid flask. Subsequently, 100 ml of methanol was added and the resulting mixture is subjected to ultrasonic dispersion (free organic carboxylic acids are extracted).

(2) The resulting dispersion is filtered. The filtrate is placed in a 200 ml ovoid flask and then dried up (free organic carboxylic acids are separated).

(3) Subsequently, 15 ml of methanol and 3 ml of 4 mol/L hydrochloric acid are added and the resulting mixture is subjected to ultrasonic dispersion for one minute.

(4) Boiling stones made of Teflon (registered trade mark) were added, and refluxing is performed for 60 minutes.

(5) Added to the resulting liquid reaction composition are 60 ml of water and 60 ml of ethyl acetate, and a methyl-esterificated product of organic carboxylic acids is then extracted to an ethyl acetate phase. Ethyl acetate extraction is performed twice.

(6) The ethyl acetate phase is dried, followed by vacuum drying for 30 minutes.

(7) Placed in a 10 ml measuring flask is 1 ml of a benzanthrone solution (being an internal standard and prepared in such a manner that approximately 100 mg of benzanthrone is dissolved in toluene and the total volume is made to 100 ml by the addition of toluene).

(8) The product obtained in (6) is dissolved in toluene and placed in the measuring flask described in (7) and the total volume is adjusted by the addition of more toluene.

(9) Carried out GC measurement using the conditions described below.

Apparatus: HP-5890+HP-Chemistation
Column: HP-1 30 m×0.32 mm×0.25 μm (manufactured by Hewlett-Packard)

Injection inlet: 250° C.
Detector: 280° C.
Oven: maintained at 250° C.
Carrier gas: He
Head pressure: 80 kPa <Morphology of Aliphatic Carboxylic Acid Silver Salts>

In the aliphatic carboxylic acid silver salts according to the present invention, it is preferable that the average circle equivalent diameter is from 0.05 to 0.80 μm, and the average thickness is from 0.005 to 0.070 μm. It is still more preferable that the average circle equivalent diameter is from 0.2 to 0.5 mm, and it is more preferable that the average circle equivalent diameter is from 0.2 to 0.5 μm and the average thickness is from 0.01 to 0.05 μm.

When the average circle equivalent diameter is less than or equal to 0.05 μm, excellent transparency is obtained, while image retention properties are degraded. On the other hand, when the average grain diameter is less than or equal to 0.8 μm, transparency is markedly degraded. When the average thickness is less than or equal to 0.005 μm, during development, silver ions are abruptly supplied due to the large surface area and are present in a large amount in the layer, since specifically in the low density section, the silver ions are not used to form silver images. As a result, the image retention properties are markedly degraded. On the other hand, when the average thickness is more than or equal to 0.07 μm, the surface area decreases, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, Ltd.). The resultant negative image is converted to a digital image employing a scanner. Subsequently, by employing appropriate software, the grain diameter (being a circle equivalent diameter) of at least 300 grains is determined and an average grain diameter is calculated.

It is possible to determine the average thickness, employing a method utilizing a transmission electron microscope (hereinafter referred to as a TEM) as described below.

First, a photosensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. The ultra-thin slice is supported by a copper mesh and transferred onto a hydrophilic carbon layer, employing a glow discharge. Subsequently, while cooling the resultant slice at less than or equal to −130° C. employing liquid nitrogen, a bright field image is observed at a magnification of 5,000 to 40,000, employing TEM, and images are quickly recorded employing either film, imaging plates, or a CCD camera. During the operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, the organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo Gakkai Kanto Shibu (Maruzen).

It is preferable that a TEM image, recorded in a suitable medium, is decomposed into preferably at least 1,024×1,024 pixels and subsequently subjected to image processing, utilizing a computer. In order to carry out the image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binarization processing.

At least 300 of the thickness of aliphatic carboxylic acid silver salt particles, extracted as above, are manually determined employing appropriate software, and an average value is then obtained.

Methods to prepare aliphatic carboxylic acid silver salt particles, having the shape as above, are not particularly limited. It is preferable to maintain a mixing state during formation of an organic acid alkali metal salt soap and/or a mixing state during addition of silver nitrate to the soap as desired, and to optimize the proportion of organic acid to the soap, and of silver nitrate which reacts with the soap.

It is preferable that, if desired, the planar aliphatic carboxylic acid silver salt particles (referring to aliphatic carboxylic acid silver salt particles, having an average circle equivalent diameter of 0.05 to 0.80 μm as well as an average thickness of 0.005 to 0.070 μm) are preliminarily dispersed together with binders as well as surface active agents, and thereafter, the resultant mixture is dispersed employing a media homogenizer or a high pressure homogenizer. The preliminary dispersion may be carried out employing a common anchor type or propeller type stirrer, a high speed rotation centrifugal radial type stirrer (being a dissolver), and a high speed rotation shearing type stirrer (being a homomixer).

Further, employed as the aforesaid media homogenizers may be rotation mills such as a ball mill, a planet ball mill, and a vibration ball mill, media stirring mills such as a bead mill and an attritor, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, yttrium-stabilized zirconia, and zirconia-reinforced alumina (hereafter ceramics containing zirconia are abbreviated to as zirconia). The reason of the preference is that impurity formation due to friction with beads as well as the homogenizer during dispersion is minimized.

In apparatuses which are employed to disperse the planar aliphatic carboxylic acid silver salt particles of the present invention, preferably employed as materials of the members which come into contact with the aliphatic carboxylic acid silver salt particles are ceramics such as zirconia, alumina, silicon nitride, and boron nitride, or diamond. Of these, zirconia is preferably employed. During the dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at less than or equal to 45° C. The examples of the preferable operation conditions for the main dispersion are as follows. When a high pressure homogenizer is employed as a dispersion means, preferable operation conditions are from 29 to 100 MPa, and at least double operation frequency. Further, when the media homogenizer is employed as a dispersion means, the peripheral rate of 6 to 13 m/second is cited as the preferable condition.

In the present invention, light-insensitive aliphatic carboxylic acid silver salt particles are preferably formed in the presence of compounds which function as a crystal growth retarding agent or a dispersing agent. Further, the compounds which function as a crystal growth retarding agent or a dispersing agent are preferably organic compounds having a hydroxyl group or a carboxyl group.

In the present invention, compounds, which are described herein as crystal growth retarding agents or dispersing agents for aliphatic carboxylic acid silver salt particles, refer to compounds which, in the production process of aliphatic carboxylic acid silver salts, exhibit more functions and greater effects to decrease the grain diameter, and to enhance monodispersibility when the aliphatic carboxylic acid silver salts are prepared in the presence of the compounds, compared to the case in which the compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable addition amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isostearic acid, isoarachidinic acid, isobehenic acid, or isohexaconic acid. Listed as preferable side chains are an alkyl group or an alkenyl group having 4 or fewer carbon atoms. Further, listed are aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable addition amount is from 0.5 to 10.0 mol percent of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropyl methyl cellulose, polyvinylpyrrolidone, and gelatin. The preferable addition amount is from 0.1 to 20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease particle size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts to increase the distortion of crystal lattices whereby the particle size decreases due to non-formation of over-sized crystals.

<Silver Halide Grains>

Photosensitive silver halide grains (hereinafter simply referred to as silver halide grains) will be described which are employed in the silver salt photothermographic dry imaging material of the present invention (hereinafter simply referred to as the photosensitive material of the present invention).

The photosensitive silver halide grains, as described in the present invention, refer to silver halide crystalline grains which can originally absorb light as an inherent quality of silver halide crystals, can absorb visible light or infrared radiation through artificial physicochemical methods and are treatment-produced so that physicochemical changes occur in the interior of the silver halide crystal and/or on the crystal surface, when the crystals absorb any radiation from ultraviolet to infrared.

Silver halide grains employed in the present invention can be prepared in the form of silver halide grain emulsions, employing methods described in P. Glafkides, "Chimie et Physique Photographiques" (published by Paul Montel Co., 1967), G. F. Duffin, "Photographic Emulsion Chemistry" (published by The Focal Press, 1955), and V. L. Zelikman et al., "Making and Coating Photographic Emulsion", published by The Focal Press, 1964). Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations thereof. However, of these methods, the so-called controlled double-jet precipitation method is preferably employed in which silver halide grains are prepared while controlling formation conditions.

Halogen compositions are not particularly limited. Any of silver chloride, silver chlorobromide, silver chloroiodobromide, silver bromide, silver iodobromide, or silver iodide may be employed. Of these, silver bromide or silver iodobromide is particularly preferred.

The content ratio of iodine in silver iodobromide is preferably in the range of 0.02 to 16 mol percent per Ag mol. Iodine may be incorporated so that it is distributed into the entire silver halide grain. Alternatively, a core/shell structure may be formed in which, for example, the concentration of iodine in the central portion of the grain is increased, while the concentration near the grain surface is simply decreased or substantially decreased to zero.

Grain formation is commonly divided into two stages, that is, the formation of silver halide seed grains (being nuclei) and the growth of the grains. Either method may be employed in which two stages are continually carried out, or in which the formation of nuclei (seed grains) and the growth of grains are carried out separately. A controlled double-jet precipitation method, in which grains are formed while controlling the pAg and pH which are grain forming conditions, is preferred, since thereby it is possible to control grain shape as well as grain size. For example, when the method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows the grains while supplying water-soluble silver salts as well as water-soluble halides.

In order to minimize milkiness (or white turbidity) as well as coloration (yellowing) after image formation and to obtain excellent image quality, the average grain diameter of the silver halide grains, employed in the present invention, is preferably rather small. The average grain diameter, when grains having a grain diameter of less than 0.02 μm is beyond practical measurement, is preferably 0.035 to 0.055 μm.

Incidentally, grain diameter, as described herein, refers to the edge length of silver halide grains which are so-called regular crystals such as a cube or an octahedron. Further, when silver halide gains are planar, the grain diameter refers to the diameter of the circle which has the same area as the projection area of the main surface.

In the present invention, silver halide grains are preferably in a state of monodispersion. Monodispersion, as described herein, means that the variation coefficient, obtained by the formula described below, is less than or equal to 30 percent. The aforesaid variation coefficient is preferably less than or equal to 20 percent, and is more preferably less than or equal to 15 percent.

Variation coefficient (in percent) of grain diameter=standard deviation of grain diameter/average of grain diameter×100

Cited as shapes of silver halide grains may be cubic, octahedral and tetradecahedral grains, planar grains, spherical grains, rod-shaped grains, and roughly elliptical-shaped grains. Of these, cubic, octahedral, tetradecahedral, and planar silver halide grains are particularly preferred.

When the aforesaid planar silver halide grains are employed, their average aspect ratio is preferably 1.5 to 100, and is more preferably 2 to 50. These are described in U.S. Pat. Nos. 5,264,337, 5,314,798, and 5,320,958, and incidentally it is possible to easily prepare the aforesaid target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

The silver halide grains, employed in the present invention, are preferably prepared employing low molecular weight gelatin, having an average molecular weight of less than or equal to 50,000 during the formation of the grains, which are preferably employed during formation of nuclei. The low molecular weight gelatin refers to gelatin having an average molecular weight of less than or equal to 50,000. The molecular weight is preferably from 2,000 to 40,000, and is more preferably from 5,000 to 25,000. It is possible to measure the molecular weight of gelatin employing gel filtration chromatography.

The concentration of dispersion media during the formation of nuclei is preferably less than or equal to 5 percent by weight. It is more effective to carry out the formation at a low concentration of 0.05 to 3.00 percent by weight.

During formation of the silver halide grains employed in the present invention, it is possible to use polyethylene oxides represented by the general formula described below.

$$YO(CH_2CH_2O)_m(CH(CH_3)CH_2O)_p(CH_2CH_2O)_nY \quad \text{General Formula}$$

wherein Y represents a hydrogen atom, —$SO_3M$, or —CO—B—COOM; M represents a hydrogen atom, an alkali metal atom, an ammonium group, or an ammonium group substituted with an alkyl group having less than or equal to 5 carbon atoms; B represents a chained or cyclic group which forms an organic dibasic acid; m and n each represents 0 through 50; and p represents 1 through 100.

When silver halide photosensitive photographic materials are produced, polyethylene oxides, represented by the above general formula, have been preferably employed as anti-foaming agents to counter marked foaming which occurs while stirring and transporting emulsion raw materials in a process in which an aqueous gelatin solution is prepared, in the process in which water-soluble halides as well as water-soluble silver salts are added to the gelatin solution, and in a process in which the resultant emulsion is applied onto a support. Techniques to employ polyethylene oxides as an anti-foaming agent are disclosed in, for example, JP-A No. 44-9497. The polyethylene oxides represented by the above general formula function as an anti-foaming agent during nuclei formation.

The content ratio of polyethylene oxides, represented by the above general formula, is preferably less than or equal to 1 percent by weight with respect to silver, and is more preferably from 0.01 to 0.10 percent by weight.

It is desired that polyethylene oxides, represented by the above general formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01 to 2.00 percent by weight. Further, it is preferable that they are present during at least 50 percent of the time of the nuclei formation process, and it is more preferable that they are present during at least 70 percent of the time of the same. The polyethylene oxides, represented by the above general formula, may be added in the form of powder or they may be dissolved in a solvent such as methanol and then added.

Incidentally, temperature during nuclei formation is commonly from 5 to 60° C., and is preferably from 15 to 50° C. It is preferable that the temperature is controlled within the range, even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably less than or equal to 3.5 M, and is more preferably in the lower range of 0.01 to 2.50 M. The silver ion addition rate during nuclei formation is preferably from $1.5\times10^{-3}$ to $3.0\times10^{-1}$ mol/minute, and is more preferably from $3.0\times10^{-3}$ to $8.0\times10^{-2}$ mol/minute.

The pH during nuclei formation can be set in the range of 1.7 to 10.0. However, since the pH on the alkali side broadens the particle size distribution of the formed nuclei, the preferred pH is from 2 to 6. Further, the pBr during nuclei formation is usually from about 0.05 to about 3.00, is preferably from 1.0 to 2.5, and is more preferably from 1.5 to 2.0.

<Silver Halide Grains of Internal Latent Formation After Thermal Development>

The photosensitive silver halide grains according to the present invention are characterized in that they have a property to change from a surface latent image formation type to an internal latent image formation type after subjected to thermal development. This change is caused by decreasing the speed of the surface latent image formation by the effect of thermal development.

When the silver halide grains are exposed to light prior to thermal development, latent images capable of functioning as a catalyst of development reaction are formed on the surface of the aforesaid silver halide grains. "Thermal development" is a reduction reaction by a reducing agent for silver ions. On the other hand, when exposed to light after the thermal development process, latent images are more formed in the interior of the silver halide grains than the surface thereof. As a result, the silver halide grains result in retardation of latent image formation on the surface.

Generally, when photosensitive silver halide grains are exposed to light, silver halide grains themselves or spectral sensitizing dyes, which are adsorbed on the surface of photosensitive silver halide grains, are subjected to photoexcitation to generate free electrons. Generated electrons are competitively trapped by electron traps (sensitivity centers) on the surface or interior of silver halide grains. Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing Co. Ltd. , 1998.

The photosensitive silver halide grains of the present invention are preferably provided with dopants which act as electron trapping in the interior of silver halide grains at least in a stage of exposure to light after thermal development. This is required so as to achieve high photographic speed grains as well as high image keeping properties.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the aforesaid dopants themselves which exhibit properties capable of trapping free electron, or the aforesaid dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, idole, indazole, purine, thiazole, oxadiazole, quinoline, phthalazine, naphthylizine, quinoxaline, quinazoline, cinnoline, pteridine, acrydine, phenanthroline, phenazine, tetrazole, thiazole, oxazole, benzimidazole, benzoxazole, benzthiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole, and tetraazaindene.

Incidentally, the aforesaid heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in the present invention so as to function as an electron trapping dopant, as described above, or as a hole trapping dopant. Preferred as aforesaid transition metals are W, Fe, Co, Ni, Cu, Ru, Rh, Pd, Re, Os, Ir, and Pt.

In the present invention, aforesaid various types of dopants may be employed individually or in combination of at least two of the same or different types. It is required that at least one of the dopants act as an electron trapping dopant during an exposure time after being thermal developed. They may be incorporated in the interior of the silver halide grains in any forms of chemical states.

The content ratio of dopants is preferably in the range of $1\times10^{-9}$ to $1\times10$ mol per mol of silver, and is more preferably $1\times10^{-6}$ to $1\times10^{-2}$ mol.

However, the optimal amount varies depending the types of dopants, the diameter and shape of silver halide grains, and ambient conditions. Accordingly, it is preferable that addition conditions are optimized taking into account these conditions.

In the present invention, preferred as transition metal complexes or complex ions are those represented by the general formula described below.

General Formula: $[ML_6]^m$ wherein M represents a transition metal selected from the elements of Groups 6 through 11 in the Periodic Table; L represents a ligand; and m represents 0, -, 2-, 3-, or 4-. Listed as specific examples of ligands represented by L are a halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in JP-A Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with the present invention, it is possible to evaluate whether the aforesaid dopants exhibit electron trapping properties or not, while employing a method which has commonly employed in the photographic industry. Namely a silver halide emulsion comprised of silver halide grains, which have been doped with the aforesaid dopant or decomposition product thereof so as to be introduced into the interior of grains, is subjected to photoconduction measurement, employing a microwave photoconduction measurement method. Subsequently, it is possible to evaluate the aforesaid electron trapping properties by comparing the resulting decrease in photoconduction to that of the silver halide emulsion comprising no dopant as a standard. It is also possible to evaluate the same by performing experiments in which the internal speed of the aforesaid silver halide grains is compared to the surface speed.

Further, a method follows which is applied to a finished photothermographic dry imaging material to evaluate the electron trapping dopant effect in accordance with the present invention. For example, prior to exposure, the aforesaid imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the aforesaid electron trapping dopant effect by comparing the speed obtained based on the characteristic curve to that of the imaging material which is comprised of the silver halide emulsion which does not comprise the aforesaid electron trapping dopant. Namely, it is necessary to confirm that the speed of the former sample comprised of the silver halide grain emulsion comprising the dopant in accordance with the present invention is lower than the latter sample which does not comprise the aforesaid dopant.

Speed of the aforesaid material is obtained based on the characteristic curve which is obtained by exposing the aforesaid material to white light or infrared radiation through an optical wedge for a definite time (for example 30 seconds) followed by developing the resulting material under common thermal development conditions. Further, speed of the aforesaid material is obtained based on the characteristic curve which is obtained by heating the aforesaid material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed is as low as not more than 1/50.

The silver halide grains of the present invention may be incorporated in a photosensitive layer employing an optional method. In such a case, it is preferable that the aforesaid silver halide grains are arranged so as to be adjacent to reducible silver sources (being aliphatic carboxylic silver salts) in order to get an imaging material having a high covering power.

The silver halide of the present invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds.

Specific examples are disclosed in; U.S. Pat. Nos. 4,009,039, 3,4757,075, 4,003,749; G.B. Pat. No. 1,498,956; and JP-A Nos. 53-27027, 53-25420.

Further, silver halide grains may be employed in combination which are produced by converting some part of separately prepared aliphatic carboxylic acid silver salts.

The aforesaid silver halide grains, which include separately prepared silver halide grains and silver halide grains prepared by partial conversion of aliphatic carboxylic acid silver salts, are employed commonly in an amount of 0.001 to 0.7 mol per mol of aliphatic carboxylic acid silver salts and preferably in an amount of 0.03 to 0.5 mol.

The separately prepared photosensitive silver halide particles are subjected to desalting employing desalting methods known in the photographic art, such as a noodle method, a flocculation method, an ultrafiltration method, and an electrophoresis method, while they may be employed without desalting.

<Antifoggant and Image Stabilizer>

As mentioned above, being compared to conventional silver halide photosensitive photographic materials, the greatest different point in terms of the structure of silver salt photothermographic dry imaging materials is that in the latter materials, a large amount of photosensitive silver halide, organic silver salts and reducing agents is contained which are capable of becoming causes of generation of fogging and printout silver, irrespective of prior and after photographic processing. Due to that, in order to maintain storage stability before development and even after development, it is important to apply highly effective fog minimizing and image stabilizing techniques to silver salt photothermographic dry imaging materials. Other than aromatic heterocyclic compounds which retard the growth and development of fog specks, heretofore, mercury compounds, such as mercury acetate, which exhibit functions to oxidize and eliminate fog specks, have been employed as a markedly effective storage stabilizing agents. However, the use of such mercury compounds may cause problems regarding safety as well as environmental protection.

The important points for achieving technologies for antifogging and image stabilizing are:

to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of the present invention will now be described.

In the silver salt photothermographic dry imaging material of the present invention, one of the features is that bisphenols are mainly employed as a reducing agent, as described below. It is preferable that compounds are incorporated which are capable of deactivating reducing agents upon generating active species capable of extracting hydrogen atoms from the aforesaid reducing agents.

Preferred compounds are those which are capable of: preventing the reducing agent from forming a phenoxy radial; or trapping the formed phenoxy radial so as to stabilize the phenoxy radial in a deactivated form to be effective as a reducing agent for silver ions.

Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group.

More preferred are compounds having a sulfonyl group, a sulfoxide group or a phosphoryl group in the molecule.

Specific examples are disclosed in, JP-A Nos. 6-208192, 20001-215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in JP-A Nos. 50-120328, 59-57234, 4-232939, 6-208193, and 10-197989, as well as U.S. Pat. No. 5,460,938, and JP-A No. 7-2781. Specifically, in the imaging materials according to the present invention, specific examples of preferred compounds include halogen radical releasing compounds which are represented by General Formula (OFI) below.

$$Q_2\text{-}Y\text{—}C(X_1)(X_3)(X_2) \qquad \text{General Formula (OFI)}$$

In General Formula (OFI), $Q_2$ represents an aryl group or a heterocyclic group; $X_1$, $X_2$, and $X_3$ each represent a hydrogen atom, a halogen atom, an acyl group, an alkoxycarbonyl group, an aryloxycarbonyl group, a sulfonyl group, or an aryl group, at least one of which is a halogen atom; and Y represents —C(═O)—, —SO— or —$SO_2$—.

The aryl group represented by $Q_2$ may be in the form of a single ring or a condensed ring, and is preferably a single ring or double ring aryl group having 6–30 carbon atoms (for example, phenyl and naphthyl) and is more preferably a phenyl group and a naphthyl group, and is still more preferably a phenyl group.

The heterocyclic group represented by $Q_2$ is a 3- to 10-membered saturated or unsaturated heterocyclic group containing at least one of N, O, or S, which may be a single ring or may form a condensed ring with another ring.

The heterocyclic group is preferably a 5- to 6-membered unsaturated heterocyclic group which may have a condensed ring, is more preferably a 5- to 6-membered aromatic heterocyclic group which may have a condensed ring, and is most preferably a 5- to 6-membered aromatic heterocyclic group which may have a condensed ring containing 1 to 4 nitrogen atoms. Heterocycles in such heterocyclic groups are preferably imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; are more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; are still more preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, triazole, benzimidazole, and benzthiazole; and are most preferably pyridine, thiadiazole, quinoline, and benzthiazole.

The aryl group and heterocyclic group represented by $Q_2$ may have a substituent other than —YU-C($X_1$)($X_2$)($X_3$). Substituents are preferably an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylimino group, a sulfamoyl group, a carbamoyl group, a sulfonyl group, a ureido group, a phosphoric acid amide group, a halogen atom, a cyano group, a sulfo group, a carboxyl group, a nitro group, and a heterocyclic group; are more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amide group, a halogen atom, a cyano group, a nitro group, and a heterocyclic group; are more preferably an alkyl group, an aryl group, an alkoxy group, an aryloxy group, an acyl group, an acylamino group, a sulfonylimino group, a sulfamoyl group, a carbamoyl group, a halogen atom, a cyano group, a nitro group, and a heterocyclic group; and are most preferably an alkyl group, an aryl group, are a halogen atom.

Each of $X_1$, $X_2$, and $X_3$ is preferably a halogen atom, a haloalkyl group, an acyl group, an alkoxycarbonyl group, an aryloxycarbonyl group, a carbamoyl group, a sulfamoyl group, a sulfonyl group, or a heterocyclic group; is more preferably a halogen atom, a haloalkyl group, an acyl group, an alkoxycarbonyl group, an aryloxycarbonyl group, or a sulfonyl group; is still more preferably a halogen atom or a trihalomethyl group; and is most preferably a halogen atom. Of halogen atoms preferred are a chlorine atom, a bromine atom and an iodine atom. Of these, a chlorine atom and a bromine atom are more preferred and a bromine atom is particularly preferred.

Y represents —C(═O)— or —$SO_2$—, and is preferably —$SO_2$—.

The added amount of these compounds is commonly $1\times10^{-4}$–1 mol per of silver, and is preferably $1\times10^{-3}$–$5\times10^{-2}$ mol.

Incidentally, in the imaging materials according to the present invention, it is possible to use those disclosed in JP-A No. 2003-5041 in the manner as the compounds represented by aforesaid General Formula (OFI).

Specific examples of the compounds represented by General Formula (OFI) are listed below, however, the present invention is not limited thereto.

OFI-1

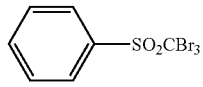

OFI-2

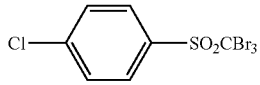

OFI-3

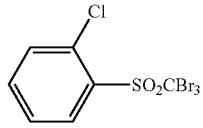

OFI-4

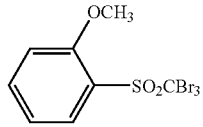

OFI-5

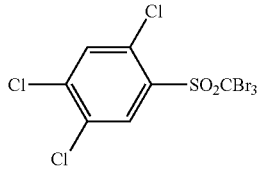

OFI-6

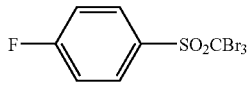

OFI-7

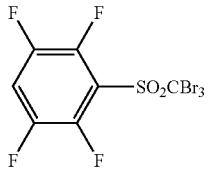

-continued
OFI-8
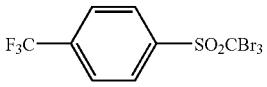
OFI-9
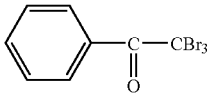
OFI-10
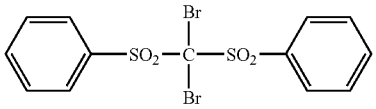
OFI-11
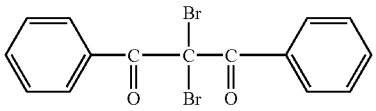
OFI-12
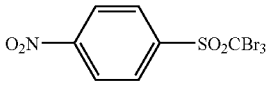
OFI-13
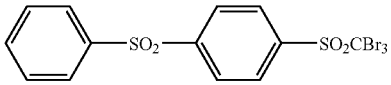
OFI-14
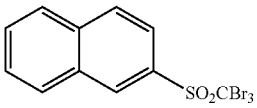
OFI-15
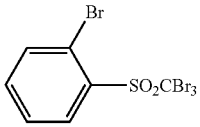
OFI-16
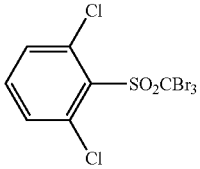
OFI-17
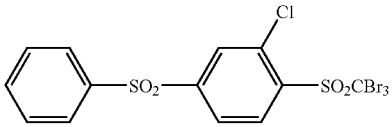
OFI-18
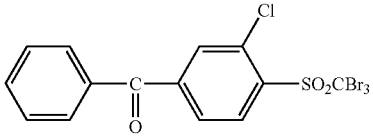
OFI-19
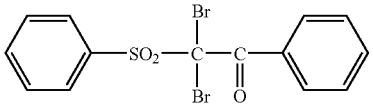
OFI-20
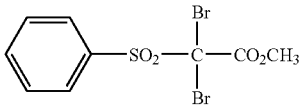
-continued
OFI-21
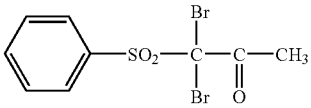
OFI-22
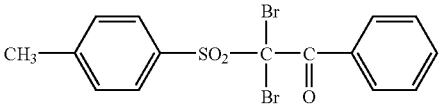
OFI-23
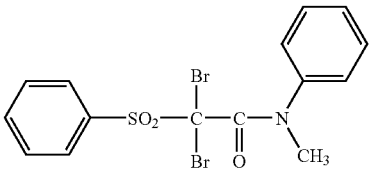
OFI-24
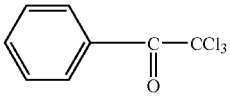
OFI-25
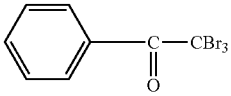
OFI-26
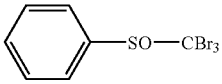
OFI-27
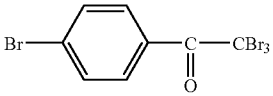
OFI-28
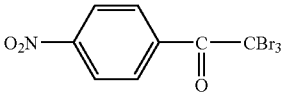
OFI-29
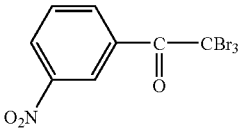
OFI-30
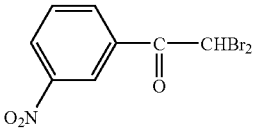
OFI-31
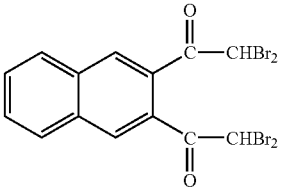
OFI-32
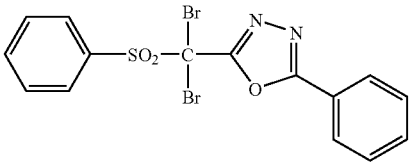

-continued
OFI-33
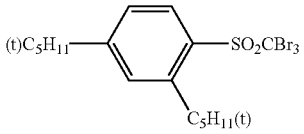
OFI-34
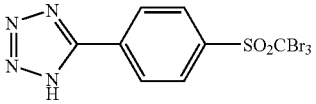
OFI-35
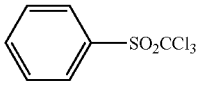
OFI-36
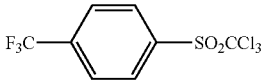
OFI-37
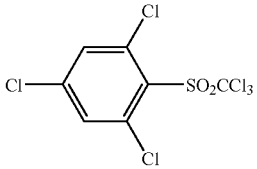
OFI-38
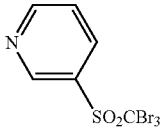
OFI-39
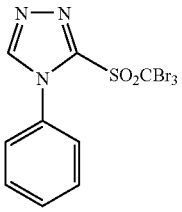
OFI-40
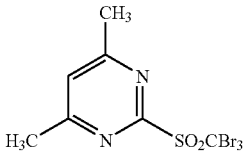
OFI-41
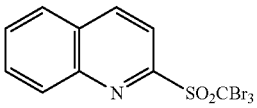
OFI-42
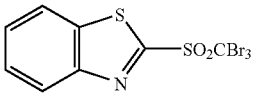
OFI-43
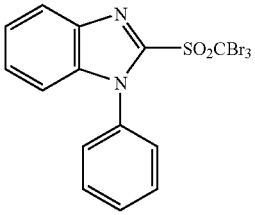
-continued
OFI-44
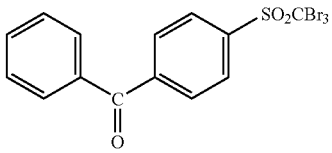
OFI-45
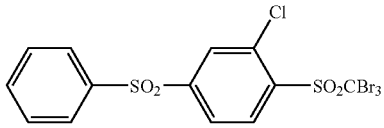
OFI-46
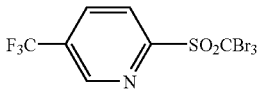
OFI-47
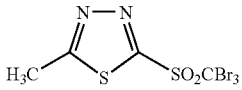
OFI-48
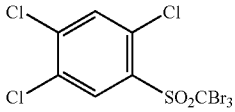
OFI-49
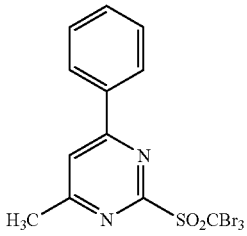
OFI-50
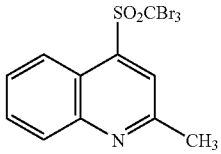
OFI-51
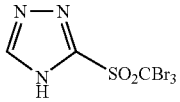
OFI-52
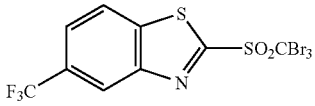
OFI-53
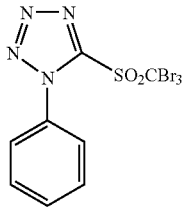

-continued

OFI-54

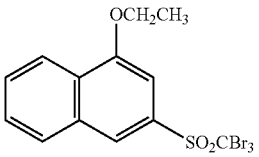

OFI-55

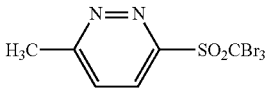

OFI-56

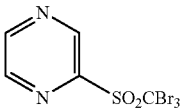

OFI-57

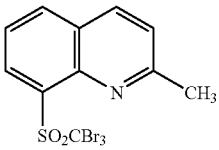

OFI-58

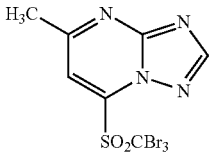

OFI-59

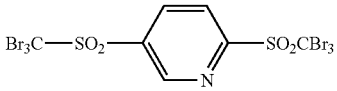

OFI-60

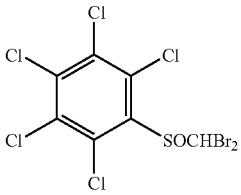

-continued

OFI-61

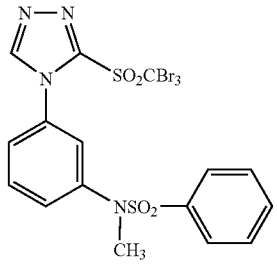

OFI-62

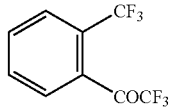

OFI-63

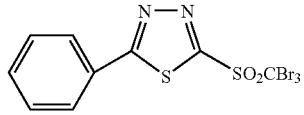

OFI-64

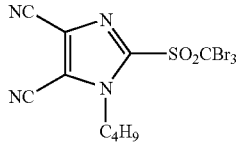

(Polymer PO Inhibitors)

Further, in view of the capability of more stabilizing of silver images, as well as an increase in photographic speed and CP, it is preferable to use, in the photothermographic imaging materials according to the present invention, as an image stabilizer, polymers which have at least one repeating unit of the monomer having a radical releasing group disclosed in JP-A No. 2003-91054. Specifically, in the photothermographic imaging-materials according to the present invention, desired results are unexpectedly obtained.

Specific examples of polymers having a halogen radical releasing group are listed below. However, the present invention is not limited thereto.

XP1

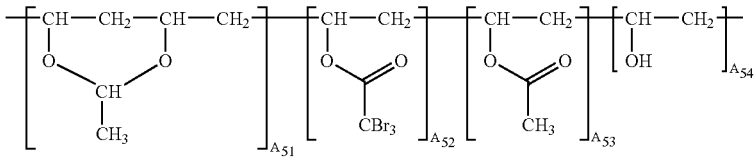

Number average molecular weight of 20,000
Composition (in weight percent) A51:A52:A53:A54 = 70:22:2:6 respectively

XP2

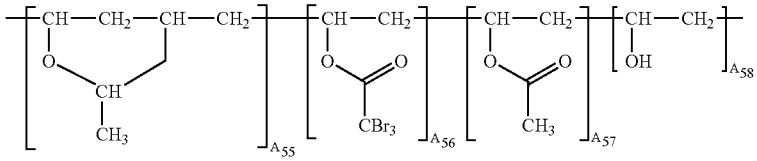

Number average molecular weight of 20,000
Composition (in weight percent) A55:A56:A57:A58 = 62:29:0.5:5.5 respectively -continued

XP3

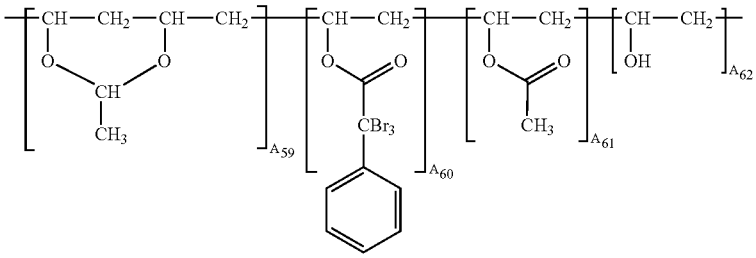

Number average molecular weight of 30,000
Composition (in weight percent) A59:A60:A61:A62 = 52:40:4:4 respectively

XP4

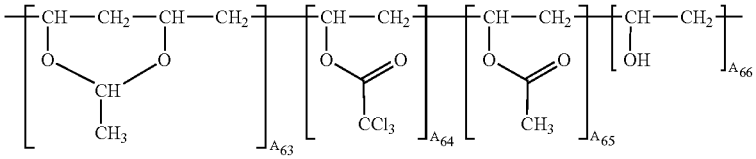

Number average molecular weight of 30,000
Composition (in weight percent) A63:A64:A65:A66 = 57:39:2:2 respectively

XP5

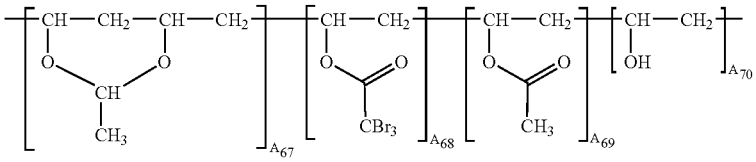

Number average molecular weight of 100,000
Composition (in weight percent) A67:A68:A69:A70 = 60:33:2:5 respectively

XP6

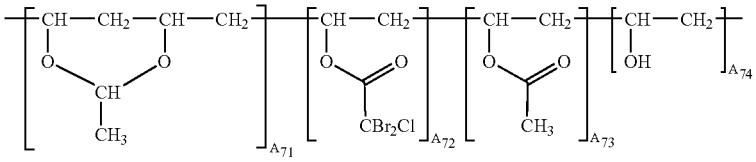

Number average molecular weight of 25,000
Composition (in weight percent) A71:A72:A73:A74 = 80:12:2:6 respectively

XP7

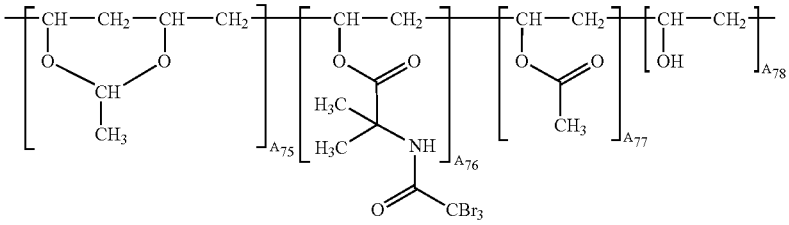

Number average molecular weight of 20,000
Composition (in weight percent) A75:A76:A77:A78 = 78:21:2:6 respectively

XP8

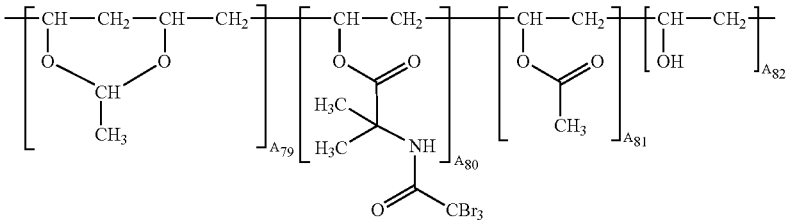

Number average molecular weight of 60,000
Composition (in weight percent) A79:A80:A81:A82 = 70:25:1:4 respectively -continued

XP9

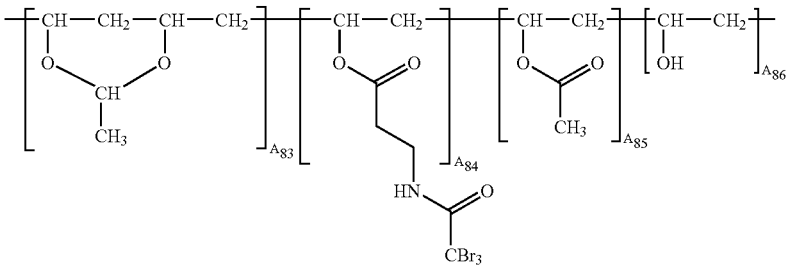

Number average molecular weight of 100,000
Composition (in weight percent) A83:A84:A85:A86 = 76:23:0.5:0.5 respectively

XP10

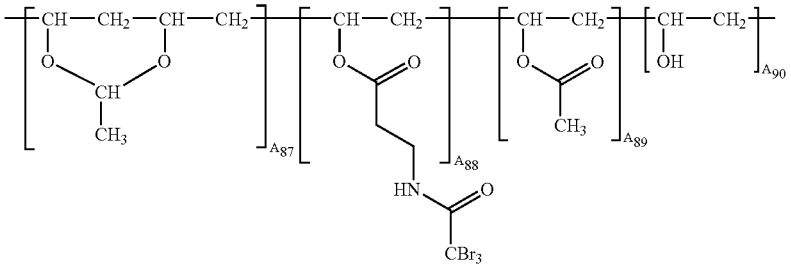

Number average molecular weight of 27,000
Composition (in weight percent) A87:A88:A89:A90 = 71:20:3:6 respectively Incidentally, other than the above-mentioned compounds, compounds which are conventionally known as an antifogging agent may be incorporated in the silver salt photothermographic dry imaging materials of the present invention. For example, listed are the compounds described in U.S. Pat. Nos. 3,589,903, 4,546,075, and 4,452,885, and JP-A Nos. 9-288328 and 9-90550. Listed as other antifogging agents are compounds disclosed in U.S. Pat. No. 5,028,523, and European Patent Nos. 600,587, 605,981 and 631,176.

(Polycarboxy Compounds)

In the imaging materials according to the present invention, it is preferable to use the compounds represented by the following General Formula (PC) as an antifogging agent and a storage stabilizer.

$$R—(CO—O-M)_n \qquad \text{General Formula (PC)}$$

wherein R represents a linkable atom, an aliphatic group, an aromatic group, a heterocyclic group, or a group of atoms capable of forming a ring as they combine with each other; M represents a hydrogen atom, a metal atom, a quaternary ammonium group, or a phosphonium group; and n represents an integer of 2–20.

Listed as linkable atoms represented by R are those such as nitrogen, oxygen, sulfur or phosphor.

Listed as aliphatic groups represented by R are straight or branched alkyl, alkenyl, alkynyl, and cycloalkyl groups having 1–30 and preferably 1–20 carbon atoms. Specific examples include methyl, ethyl, butyl, hexyl, decyl, dodecyl, isopropyl, t-butyl, 2-ethylhexyl, allyl, butenyl, 7-octenyl, propagyl, 2-butynyl, cyclopropyl, cyclopentyl, cyclohexyl, and cyclododecyl groups.

Listed as aromatic groups represented by R are those having 6–20 carbon atoms, and specific examples include phenyl, naphthyl, and anthranyl groups.

Heterocyclic groups represented by R may be in the form of a single ring or a condensed ring and include 5- to 6-membered heterocyclic groups which have at least O, S, or N atoms, or an amineoxido group. Listed as specific examples are pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isoxazole, isothiazole, triazole, tetrazole, thiadiazole, and oxadiazole, and groups derived from these benzelogues.

In the case in which R is formed employing $R_1$ and $R_2$, each $R_1$ or $R_2$ is defined as R, and $R_1$ and $R_2$ may be the same or different. Listed as rings which are formed employing $R_1$ and $R_2$ may be 4- to 7-membered rings. Of these, are preferred 5- to 7-membered rings. Preferred groups represented by $R_1$ and $R_2$ include aromatic groups as well as heterocyclic groups. Aliphatic groups, aromatic groups, or heterocyclic rigs may be further substituted with a substituent. Listed as the above substituents are a halogen atom (e.g., a chlorine atom or a bromine atom), an alkyl group (e.g., a methyl group, an ethyl group, an isopropyl group, a hydroxyethyl group, a methoxymethyl group, a trifluoromethyl group, or a t-butyl group), a cycloalkyl group (e.g., a cyclopentyl group or a cyclohexyl group), aralkyl group (e.g., a benzyl group or a 2-phenetyl group), an aryl group (e.g., phenyl group, a naphthyl group, a p-tolyl group, or a p-chlorophenyl group), an alkoxy group (e.g., a methoxy group, an ethoxy group, an isopropoxy group, or a butoxy group), an aryloxy group (e.g., a phenoxy group or a 4-methoxyphenoxy group), a cyano group, an acylamino group (e.g., an acetylamino group or a propionylamino group), an alkylthio group (e.g., a methylthio group, an ethylthio group, or a butylthio group), an arylthio group (e.g., a phenylthio group or a p-methylphenylthio group), a sulfonylamino group (e.g, a methanesulfonylamino group or a benzenesulfonylamino group), a ureido group (e.g., a 3-methylureido group, a 3,3-dimethylureido group, or a 1,3-dimethylureido group), a sulfamoylamino group (a dimethylsulfamoylamino group or a diethylsulfamoylamino group), a carbamoyl group (e.g., a methylcarbamoyl group, an ethylcarbmoyl group, or a dimerthylcarbamoyl group), a sulfamoyl group (e.g., an ethylsulfamoyl group or a dimethylsulfamoyl group), an alkoxycarbonyl group (e.g., a methoxycarbonyl group or an ethoxycarbonyl group), an aryloxycarbonyl group (e.g., a phenoxycarbonyl group or a p-chlorophenoxycarbonyl group), a sulfonyl group (e.g., a methanesulfonyl group, a butanesulfonyl group, or a phenylsulfonyl group), an acyl group (e.g., an acetyl group, a propanoyl group, or a butyroyl group), an amino group (e.g., a methylamino group, an ethylamino group, and a dimethylamino group), a hydroxy group, a nitro group, a nitroso group, an amineoxide group (e.g., a pyridine-oxide group), an imido group (e.g., a phthalimido group), a disulfide group (e.g., a benzenedisulfide group or a benzthiazoryl-2-disulfide group), and a heterocyclic group (e.g., a pyridyl group, a benzimidazolyl group, a benzthiazoyl group, or a benzoxazolyl group). $R_1$ and $R_2$ may each have a single substituent or a plurality of substituents selected from the above. Further, each of the substituents maybe further substituted with the above substituents. Still further, $R_1$ and $R_2$ may be the same or different. Yet further, when General Formula (PC-1) is an oligomer or a polymer $(R—(COOM)_{n0})_m$, desired effects are obtained, wherein n is preferably 2–20, and m is preferably 1–100, or the molecular weight is preferably at most 50,000.

Acid anhydrides of General Formula (PC-1), as described in the present invention, refer to compounds which are formed in such a manner that two carboxyl groups of the compound represented by General Formula (PC-1) undergo dehydration reaction. Acid anhydrides are preferably prepared from compounds having 3–10 carboxyl groups and derivatives thereof.

Further preferably employed are simultaneously dicarboxylic acids described in JP-A Nos. 58-95338, 10-288824, 11-174621, 11-218877, 2000-10237, 2000-10236, and 2000-10231.

(Thiosulfonic Acid Restrainers)

It is preferable that imaging materials according to the present invention contain the compounds represented by the following General Formula (ST).

$Z\text{-}SO_2.S\text{-}M$ General Formula (ST):

wherein Z represents an unsubstituted or substituted alkyl group, aryl group or heterocyclic group; and M represents a metal atom or an organic cation.

In the compounds represented by General Formula (ST), the alkyl group, aryl group, heterocyclic group, aromatic ring and heterocyclic ring, which are represented by Z may be substituted. Listed as the substituents may be, for example, a lower alkyl group such as a methyl group or an ethyl group, an aryl group such as a phenyl group, an alkoxyl group having 1–8 carbon atoms, a halogen atom such as chlorine, a nitro group, an amino group, or a carboxyl group. Metal atoms represented by M are alkaline metals such as a sodium ion or a potassium ion, while as the organic cation preferred are an ammonium ion or a guanidine group.

Listed as specific examples of the compounds represented by General Formula (ST) may be those described below. However, the present invention is not limited thereto.

(ST-1) $CH_3SO_2SNa$ (ST-2) $C_2H_5SO_2SNa$

-continued (ST-3) $HOOC—CH_2CH_2SO_2SK$ (ST-4) $(n)C_4H_9SO_2SNa$ (ST-5) $NC—CH_2CH_2CH_2SO_2SNa$ (ST-6) $(n)C_8H_{17}SO_2SNa$ (ST-7) $(n)C_{12}H_{25}SO_2SNa$ (ST-8) $ClCH_2(CH_2)_4SO_2SK$ (ST-9) $(n)C_{18}H_{37}SO_2SNa$ (ST-10) $(n)C_4H_9SO_2SK$ (ST-11) $(n)C_8H_{17}SO_2SK$ (ST-12) $(CH_3)_2CHCH_2SO_2SNa$ (ST-13) $(CH_3)_2CHCH_2CH_2SO_2SNa$ (ST-14) 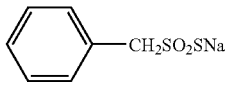

(ST-15) $(n)C_8H_{17}SO_2S^- \cdot (n)(C_4H_9)_4N^+$ (ST-16) $(n)C_8H_{17}SO_2S^-$ 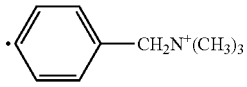

(ST-17) $H_2N—CH_2CH_2SO_2SH$ (ST-18) $CH_3O—CH_2CH_2SO_2SNa$ (ST-19) 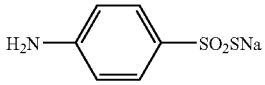

(ST-20) 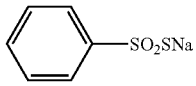

(ST-21) 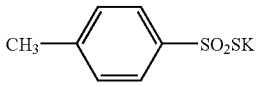

(ST-22) 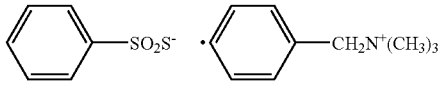

(ST-23) 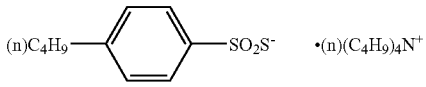

(ST-24) 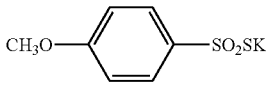

-continued (ST-25)

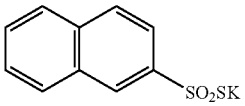

(ST-26)

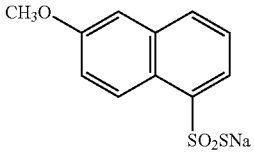

(ST-27)

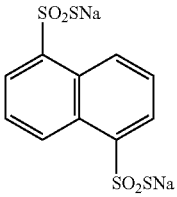

(ST-28)

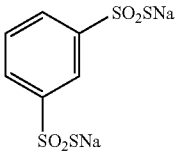

(ST-29)

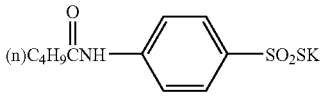

(ST-30)

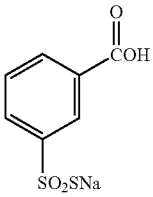

(ST-31)

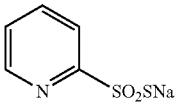

(ST-32)

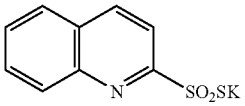

(ST-33)

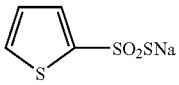

(ST-34)

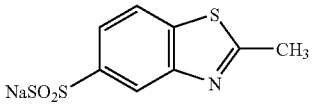

(ST-35)

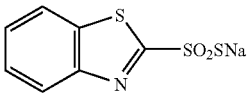

(ST-36)

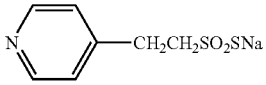

-continued (ST-37)

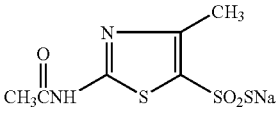

(ST-38)

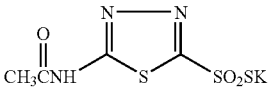

(ST-39)

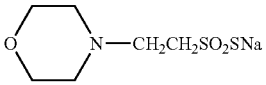

(ST-40)

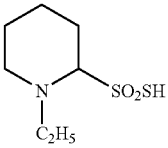

It is possible to synthesize the compounds represented by General Formula (ST), employing methods which are generally well known. For example, it is possible to synthesize them employing a method in which corresponding sulfonyl fluoride is allowed to react with sodium sulfide, or corresponding sodium sulfinate is allowed to react with sulfur. On the other hand, these compounds are also easily available on the market.

The compounds represented by General Formula (ST) may be added at any time prior to the coating process of the production process of the imaging materials according to the present invention. However, it is preferable that they are added to a liquid coating composition just before the coating.

The added amount of the compounds represented by General Formula (ST) is not particularly limited, but is preferably in the range of $1\times10^{-6}$–1 g per mol of the total silver amount, including silver halides.

Incidentally, similar compounds are disclosed in JP-A No. 8-314059.

(Electron Attractive Group Containing Vinyl Type Restrainers)

In the present invention, it is preferable to simultaneously use the fog restrainers represented by General Formula (CV).

General Formula (CV)

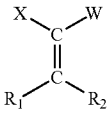

Compounds represented by aforesaid General Formula (CV) will now be explained.

An electron withdrawing group-represented by X is a substituent, Hammett's σp of which is positive. Specifically, listed are substituted alkyl-groups (such as halogen-susbstituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. The σp value is preferably not less than 0.2 and more preferably not less than 0.3.

W includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group.

Preferable as W are also aryl groups and heterocyclic groups as described above, in addition to electron withdrawing groups having a positive Hammett's substituent constant up.

X and W may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_1$ includes a hydroxyl group or organic or inorganic salts of the hydroxyl group. Specific examples of alkyl groups, alkenyl groups, alkynyl groups, aryl groups and heterocyclic groups represented by $R_2$ include each example of alkyl groups, alkenyl groups, alkynyl groups, aryl groups and heterocyclic groups exemplified as W.

Further, in this invention, any of X, W and $R_2$ may contain a ballast group. A ballast group means a so-called ballast group in such as a photographic coupler, which makes the added compound have a bulky molecular weight not to migrate in a coated film of a light-sensitive material.

Further, in this invention, X, W and $R_2$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of X and W represents a cyano group, or X and W form a cyclic structure by bonding to each other.

Further, in this invention, preferable are compounds in which a thioether group (—S—) is contained in the substituents represented by X, W and $R_2$.

Further, preferable are those in which at least one of X and W is provided with an alkene group represented by following General Formula (CV1).

$$—C(R)=C(Y)(Z) \qquad \text{General Formula (CV1)}$$

wherein, R represents a hydrogen atom or a substituent, Y and Z each represent a hydrogen atom or a substituent, however, at least one of Y and Z represents an electron withdrawing group.

Examples of electron withdrawing groups among the substituents represented by Y and Z include the aforesaid electron withdrawing groups listed as X and W, in addition to a cyano group and a formyl group.

X and W represented by above General Formula (CV1) include, for example, the following groups.

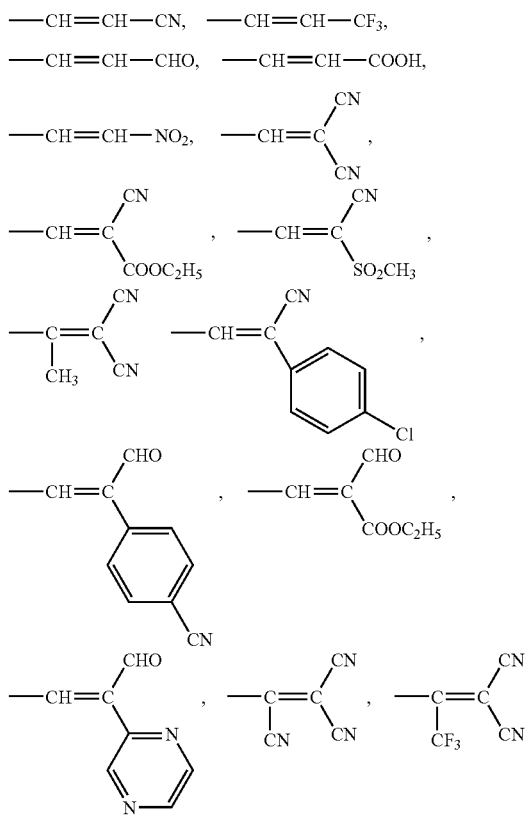

Further, preferable are those in which at least one of X and W is alkyne groups described below.

—C≡C—$R_5$

R represents a hydrogen atom or a substituent, and the substituent is preferably an electron withdrawing group such as those listed in the aforesaid X and W. X and W represented by the above General Formula (CV1) include the following groups.

—C≡C—H, —C≡C—CN, —C≡C—$CF_3$,

—C≡C—CHO, —C≡C— 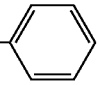 ,

—C≡C— 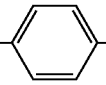 —Cl,

—C≡C— 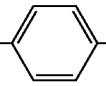 —CN

Further, at least one of X and W is preferably provided with an acyl group selected from a substituted alkylcarbonyl group, alkenylcarbonyl group and alkynylcarbonyl group, and X and W, for example, include the following groups.

—$COCF_2H$, —$COCH_2F$, —$COCCl_3$, —$COCCl_2H$,

—$COCH_2Cl$, —$COCH_2SCH_3$, —$COCH_2OCH_3$,

—$COCH_2CN$, —$COCH_2$— 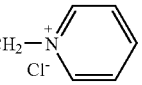 ,

—$COCH_2CONH_2$, —$COCH_2SO_2CH_3$,

—$COCH_2SO_2$— 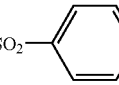 —CN,

—$COCH_2SO_2CF_3$, —$COCH_2COOC_2H_5$,

—COCH═N— 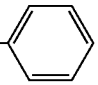

Further, at least one of X and W is preferably provided with an oxalyl group, and X and W provided with an oxalyl group include the following groups:

—COCH═CH—CN, —COCH═CH—CHO,

—COCH═CH—$CF_3$,

—COCH═CH— 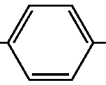 —CN,

—COC≡C—H, —COC≡C—CN,

—COC≡C—$CF_3$, —COC≡C—CHO,

—COC≡C— 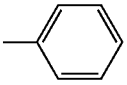 ,

-continued

—COC≡C— 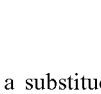 —CN

The following are also preferred groups:

—$COCOCH_3$, —$COCOOC_2H_5$, —$COCONHCH_3$, —$COCOSC_2H_5$ and $COCOOC_2H_4SCH_3$.

Further, at least one of X and W is also preferably provided with an aryl group or a nitrogen containing hetrocyclic group substituted by an electron withdrawing group, and such X and W, for example, include the following groups.

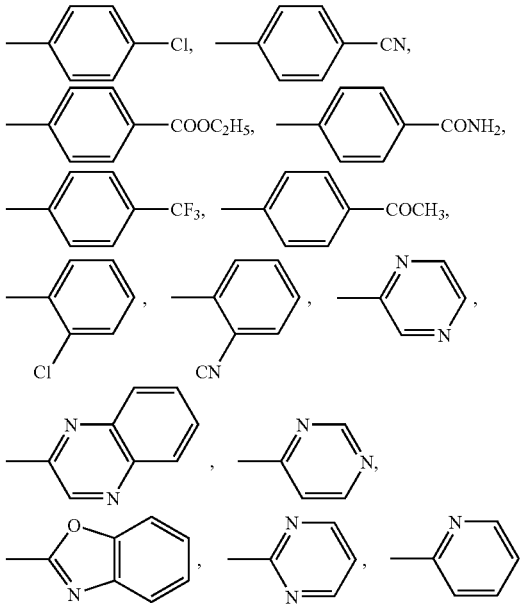

In this invention, alkene compounds represented by General Formula (CV) include every isomers when they can take isomeric structures with respect to a double bond, where X, W, $R_1$, $R_2$ include every isomers when they can take tautomeric structures such as a keto-enol form.

In the following, specific examples of compounds represented by General Formula (CV) will be described, however, this invention is not limited thereto.

CV-1

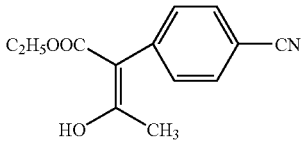

CV-2

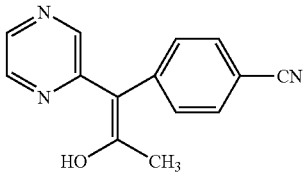

-continued
CV-3
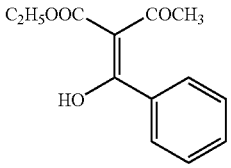
CV-4
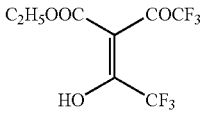
CV-5
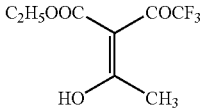
CV-6
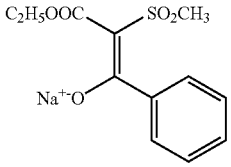
CV-7
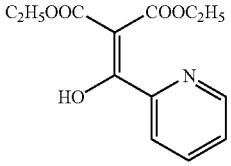
CV-8
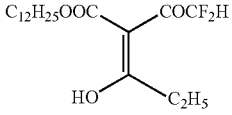
CV-9
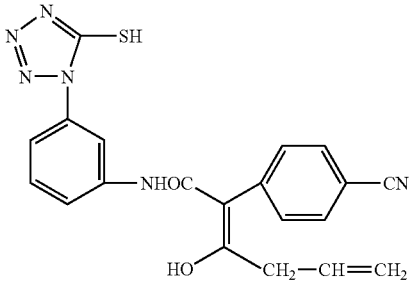
CV-10
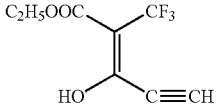
CV-11
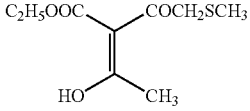
CV-12
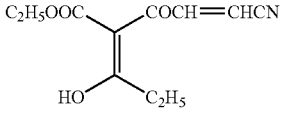
-continued
CV-13
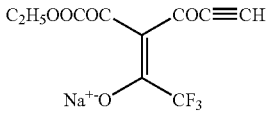
CV-14
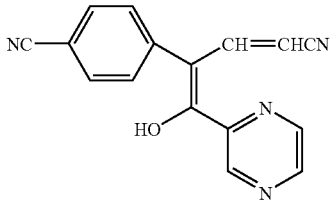
CV-15
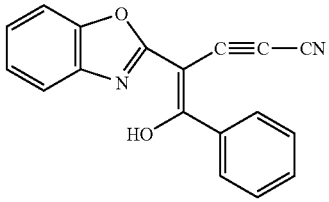
CV-16
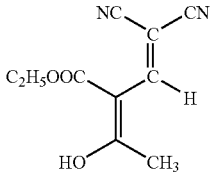
CV-17
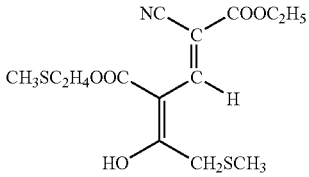
CV-18
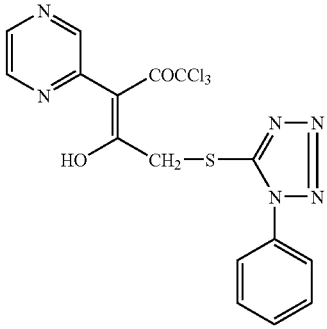
CV-19
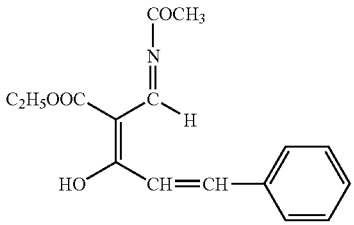

-continued
CV-20
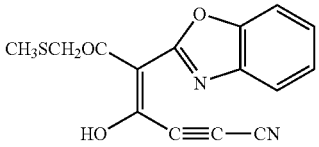
CV-21
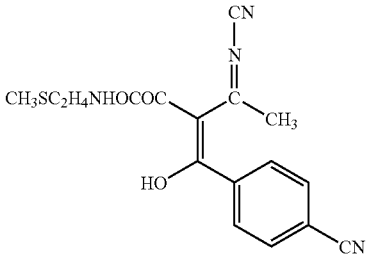
CV-22
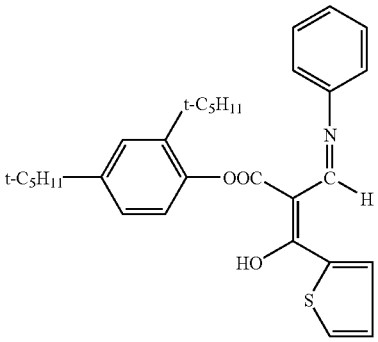
CV-23
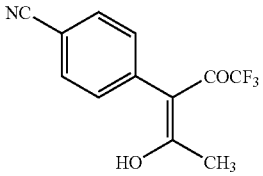
CV-24
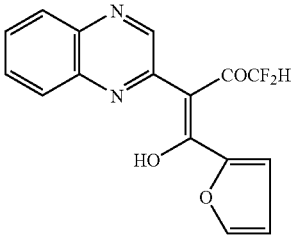
CV-25
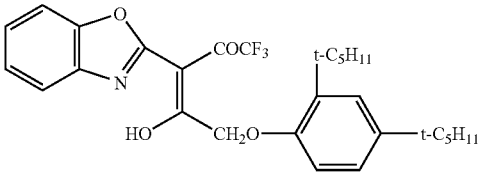
CV-26
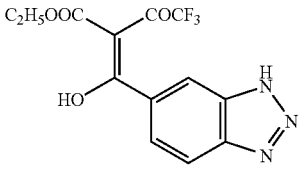
-continued
CV-27
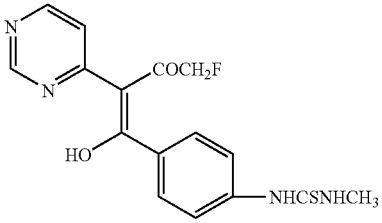
CV-28
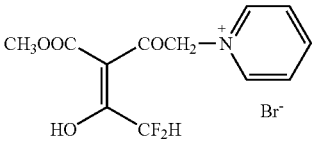
CV-29
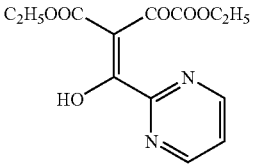
CV-30
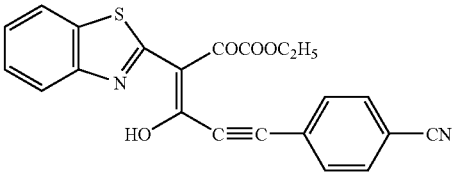
CV-31
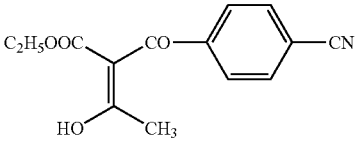
CV-32
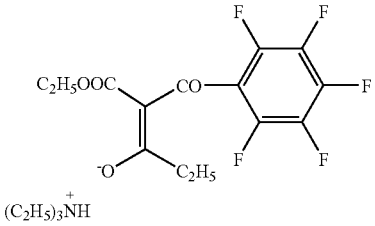
CV-33
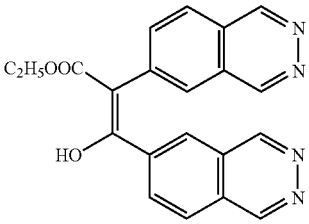
CV-34
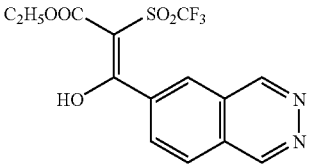

-continued
CV-35
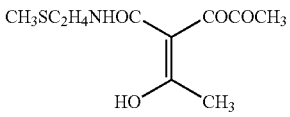
CV-36
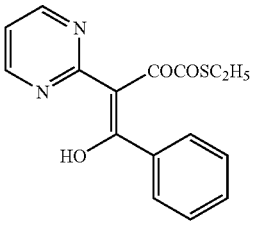
CV-37
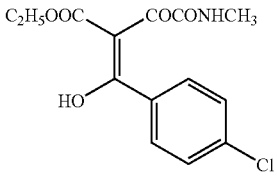
CV-38
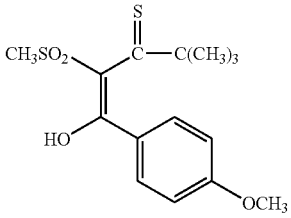
CV-39
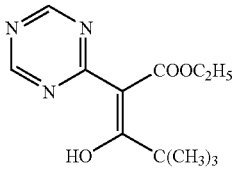
CV-40
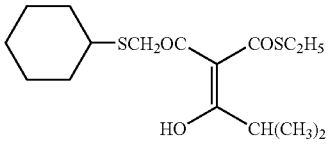
CV-41
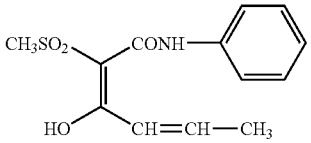
CV-42
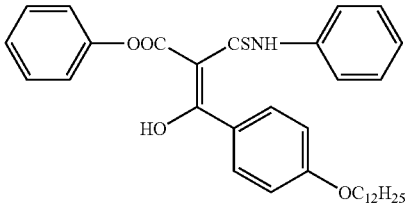
-continued
CV-43
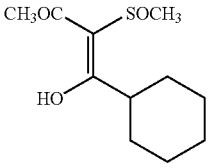
CV-44
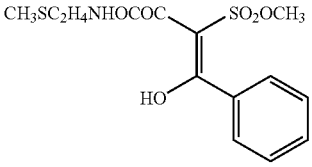
CV-45
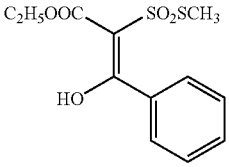
CV-46
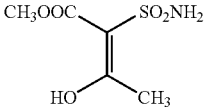
CV-47
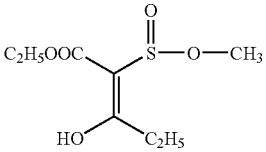
CV-48
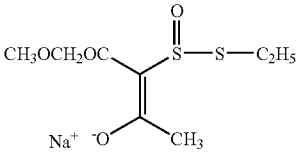
CV-49
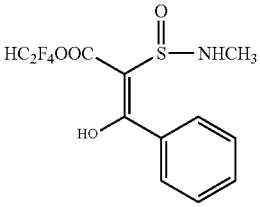
CV-50
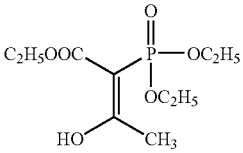
CV-51
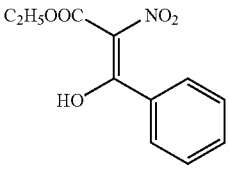

-continued
CV-52
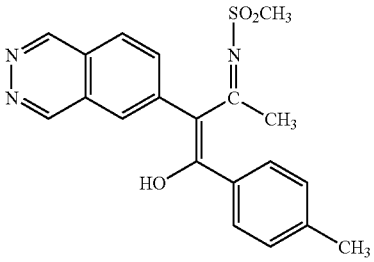
CV-53
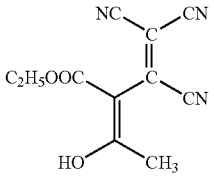
CV-54
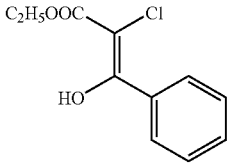
CV-55
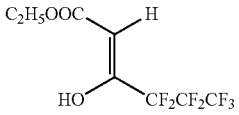
CV-56
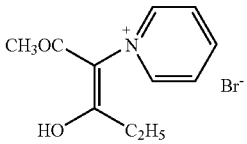
CV-57
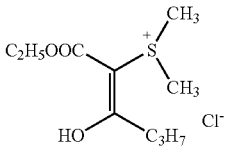
CV-58
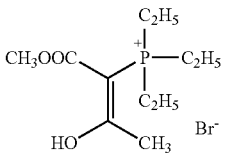
CV-59
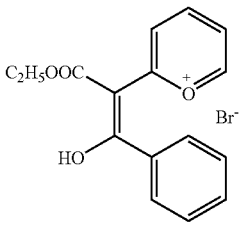
-continued
CV-60
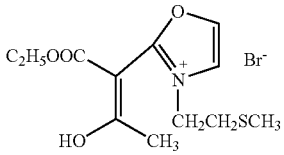
CV-61
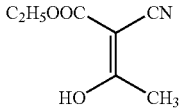
CV-62
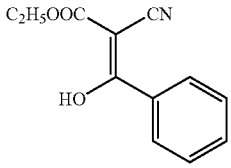
CV-63
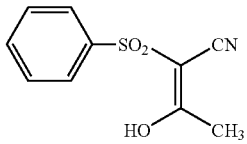
CV-64
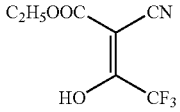
CV-65
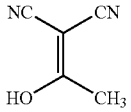
CV-66
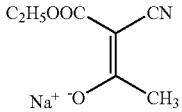
CV-67
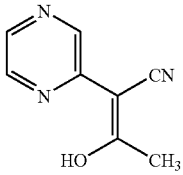
CV-68
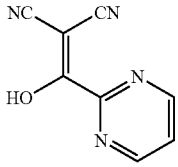
CV-69
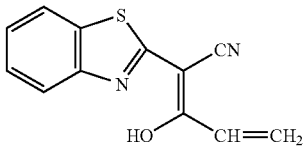

-continued
CV-70
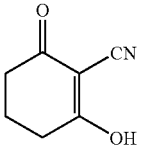
CV-71
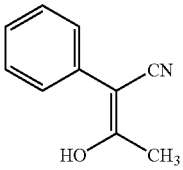
CV-72
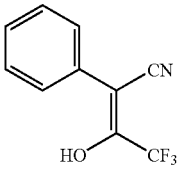
CV-73
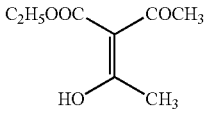
CV-74
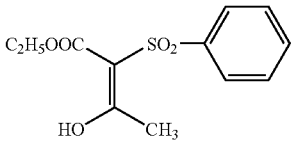
CV-75
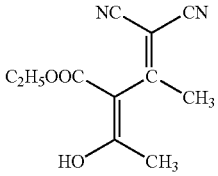
CV-76
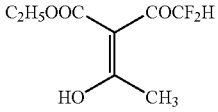
CV-77
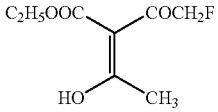
CV-101
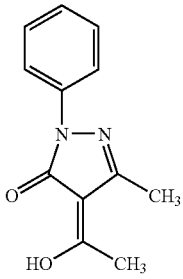
-continued
CV-102
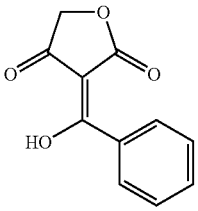
CV-103
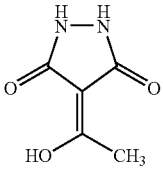
CV-104
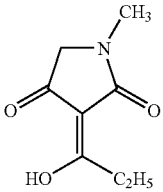
CV-105
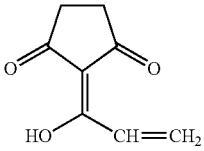
CV-106
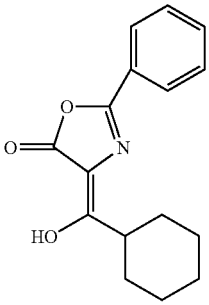
CV-107
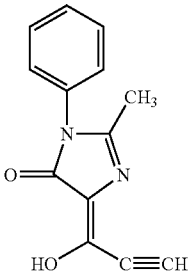
CV-108
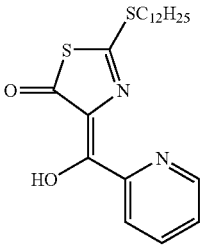

-continued
CV-109
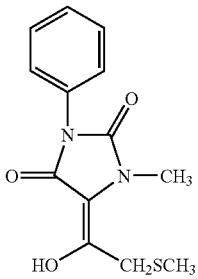
CV-110
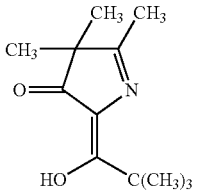
CV-111
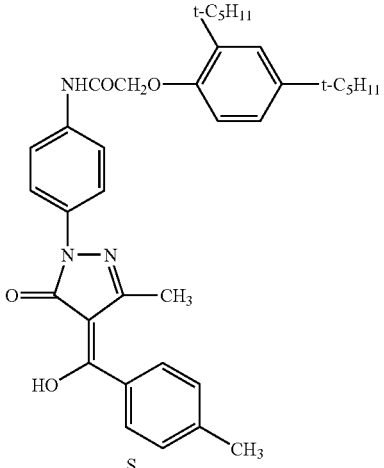
CV-112
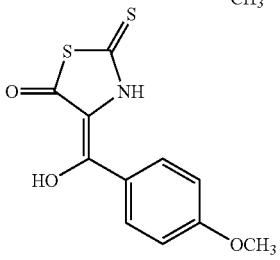
CV-113
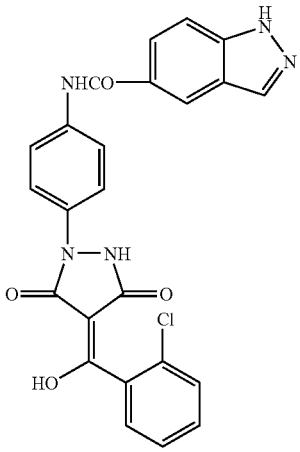
-continued
CV-114
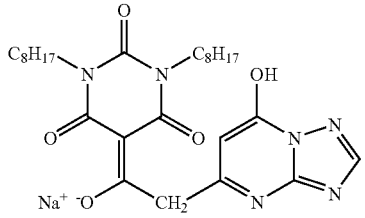
CV-115
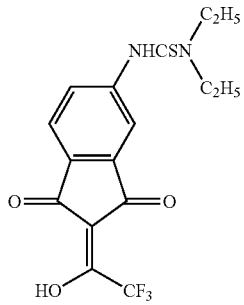
CV-116
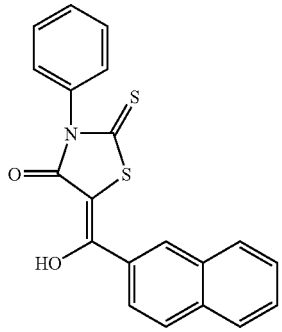
CV-117
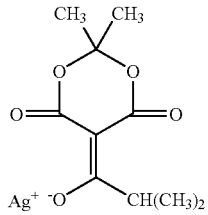
CV-118
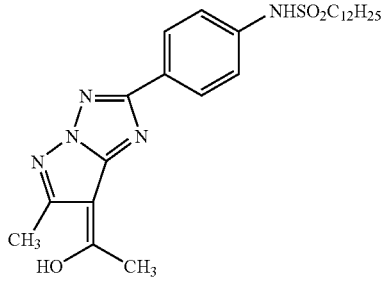

-continued
CV-119
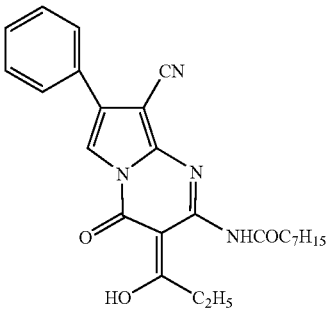
CV-120
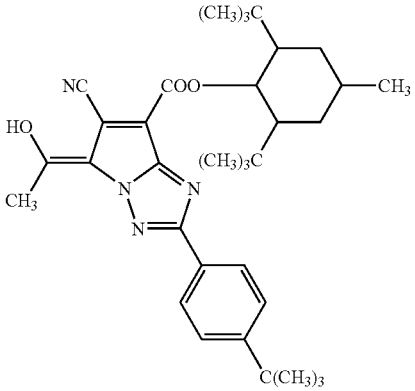
CV-121
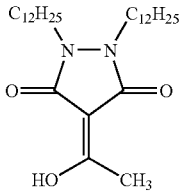
CV-122
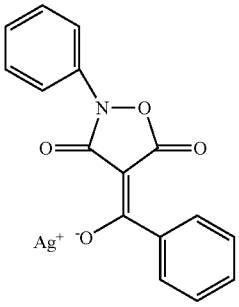
CV-123
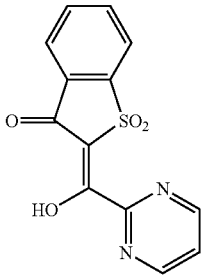
-continued
CV-124
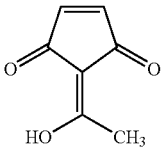
CV-125
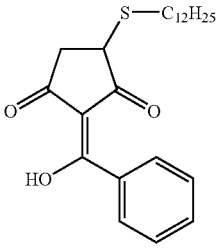
CV-126
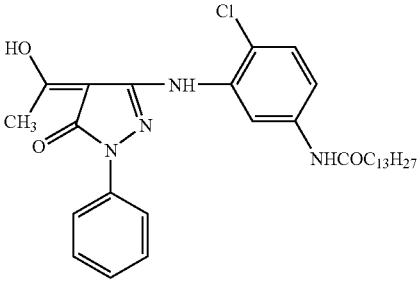
CV-127
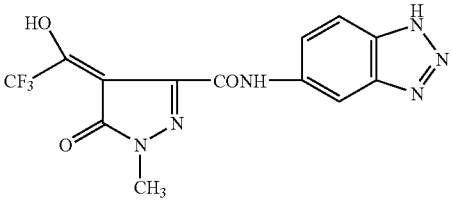
CV-128
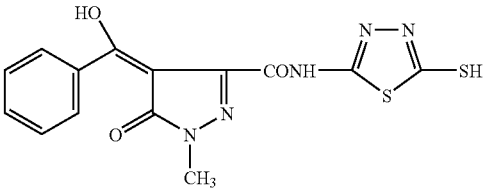
CV-129
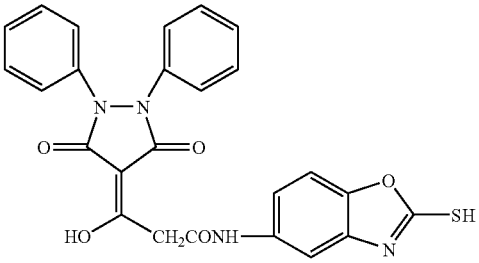
CV-130
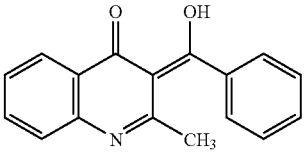

-continued

CV-131

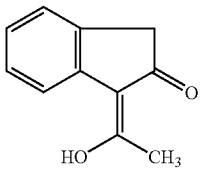

CV-132

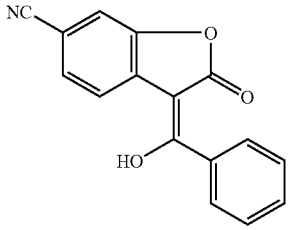

CV-133

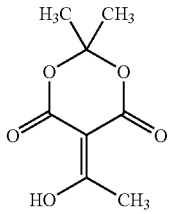

CV-134

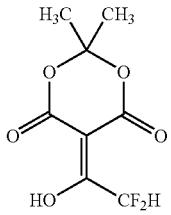

CV-135

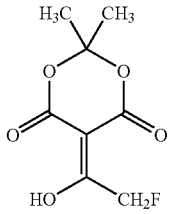

CV-136

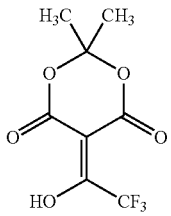

CV-137

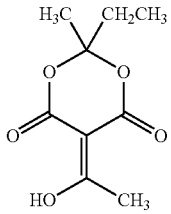

Compounds represented by General Formula (CV) of this invention can be synthesized by various methods, and they can be synthesized by referring to, for example, a method described in Japanese Translated PCT Patent Publication No. 2000-515995.

Example compound (CV)-5 can be synthesized, for example, by the following rout.

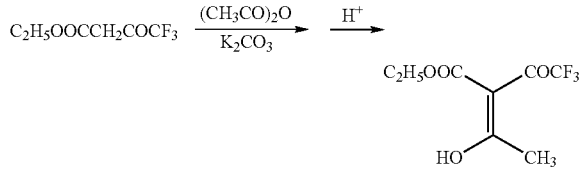

Other compounds represented by General Formula (CV) can be synthesized in a similar manner.

The compound represented by General Formula (CV) is incorporated at least in one of a light-sensitive layer and light-insensitive layers on said light-sensitive layer side, of a thermally developable light-sensitive material, and preferably at least in a light-sensitive layer. The addition amount of compounds represented by General Formula (CV) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by General Formula (CV) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for microparticle dispersion techniques, many techniques have been disclosed and the compound can be dispersed according to these techniques.

(Silver Ion Reducing Agents)

In the present invention, employed as a silver ion reducing agent (hereinafter occasionally referred simply to. as a reducing agent) may be polyphenols described in U.S. Pat. Nos. 3,589,903 and 4,021,249, British Patent No. 1,486,148, JP-A Nos. 51-5193350-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In the present invention, preferred reducing agents for silver ions are compounds represented by General Formula (RED).

General Formula (RED)

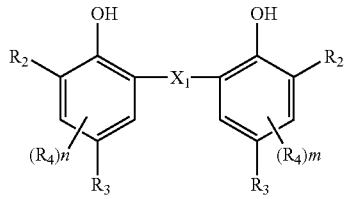

$X_1$ in General Formula (RED) represents a chalcogen atom or $CHR_1$. $R_1$ in $CHR_1$ represents a hydrogen atom, a halogen atom, an alkyl group, an alkenyl group, an alkynyl group, an aryl group or a heterocyclic group. $R_2$ represents an alkyl group. $R_3$ represents a hydrogen atom or a substituent for benzene. $R_4$ represents a substituent for benzene. m and n each represents an integer of 0 to 2.

$X_1$ represents a chalcogen atom. Specifically listed as chalcogen atoms are a sulfur atom, a selenium atom, and a tellurium atom. Of these, a sulfur atom is preferred.

$R_1$ in $CHR_1$ represents a hydrogen atom, a halogen atom, an alkyl group, an alkenyl group, an alkynyl group, an aryl group or a heterocyclic group. Listed as halogen atoms are, for example, a fluorine atom, a chlorine atom, and a bromine atom. Listed as alkyl groups are, alkyl groups having 1–20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Listed as said substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different. Most preferred substituent is an alkyl group.

$R_2$ represents an alkyl group. Preferred as the alkyl groups are those, having 1–20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. $R_2$ is preferably a secondary or tertiary alkyl group and preferably has 2–20 carbon atoms. $R_2$ is more preferably a tertiary alkyl group, is still more preferably a t-butyl group, a t-pentyl group, or a methylcyclohexyl group, and is most preferably a t-butyl group.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

Preferably listed as $R_3$ are methyl, ethyl, i-propyl, t-butyl, cyclohexyl, 1-methylcyclohexyl, and 2-hydroxyethyl. Of these, more preferably listed is 2-hydroxyethyl.

These groups may further have a substituent. Employed as such substituents may be those listed in aforesaid $R_1$.

Further, $R_3$ is more preferably an alkyl group having 1–10 carbon atoms. Specifically listed is the hydroxyl group disclosed in Japanese Patent Application No. 2002-120842, or an alkyl group, such as a 2-hydroxyethyl group, which has as a substituent a group capable of forming a hydroxyl group while being deblocked. In order to achieve high maximum density (Dmax) at a definite silver coverage, namely to result in silver image density of high covering power (CP), sole use or use in combination with other kinds of reducing agents is preferred.

The most preferred combination of $R_2$ and $R_3$ is that $R_2$ is a tertiary alkyl group (t-butyl, or 1-methylcyclohexyl) and $R_3$ is an alkyl group, such as a 2-hydoxyethyl group, which has, as a substituent, a hydroxyl group or a group capable of forming a hydroxyl group while being deblocked. Incidentally, a plurality of $R_2$ and $R_3$ is may be the same or different.

$R_4$ represents a group capable of being substituted to a benzene ring. Listed as specific examples may be an alkyl group having 1–25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyl, pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylamino-sulfonyl, hexylaminosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of 0–2. However, the most preferred case is that both n and m are 0. A plurality of $R_4$s may be the same or different.

Further, $R_4$ may form a saturated ring together with $R_2$ and $R_3$. $R_4$ is preferably a hydrogen atom, a halogen atom, or an alkyl group, and is more preferably a hydrogen atom.

Specific examples of the compounds represented by General Formula (RED) are listed below. However, the present invention is not limited thereto.

(RED-1)

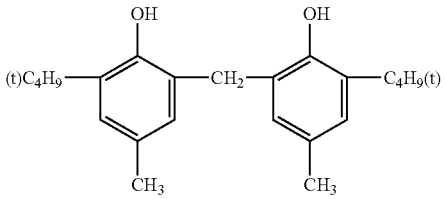

(RED-2)

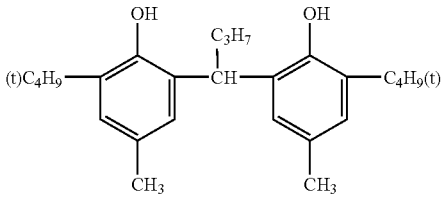

(RED-3)

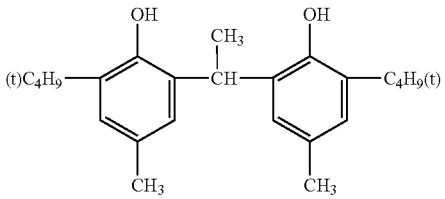

(RED-4)

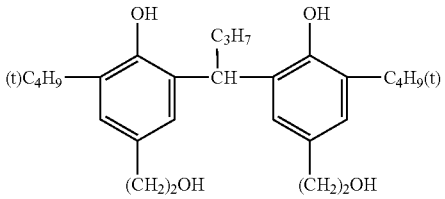

-continued (RED-5)

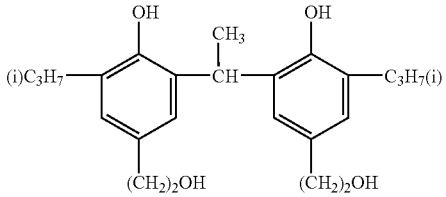

(RED-6)

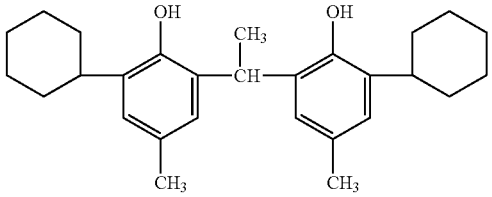

(RED-7)

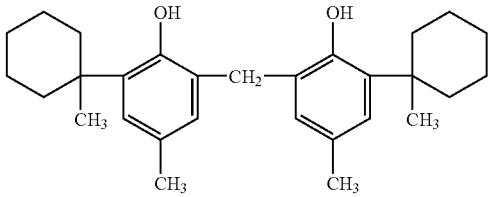

(RED-8)

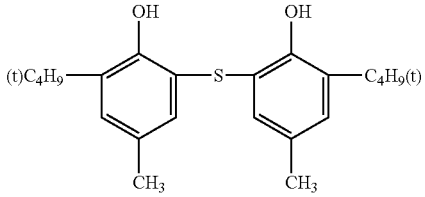

(RED-9)

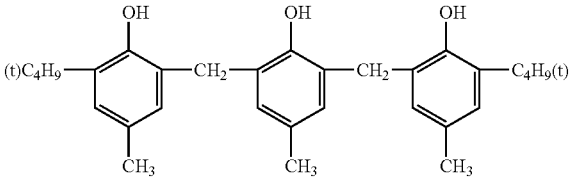

(RED-10)

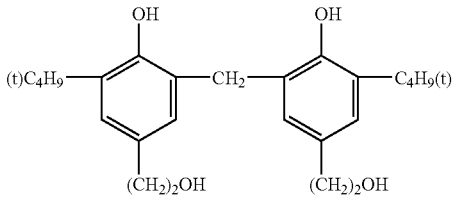

(RED-11)

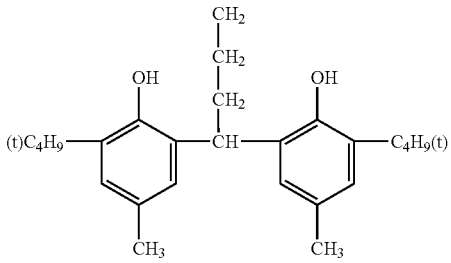

-continued (RED-12)

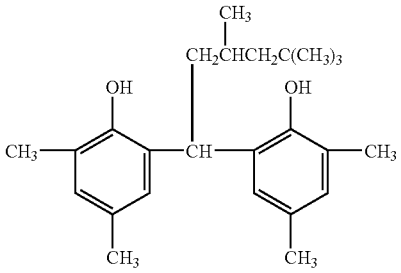

(RED-13)

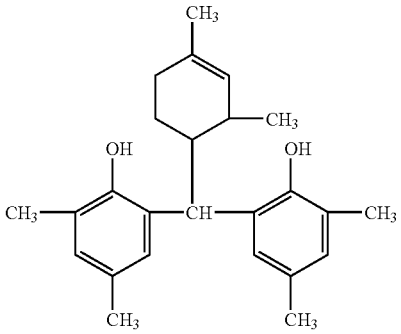

(RED-14)

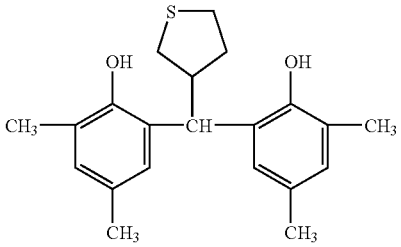

(RED-15)

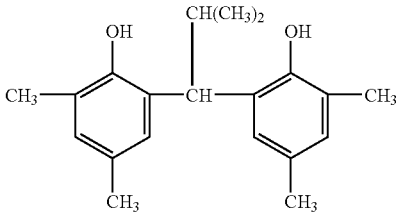

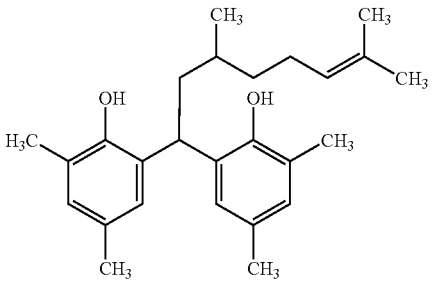

(RED-17)

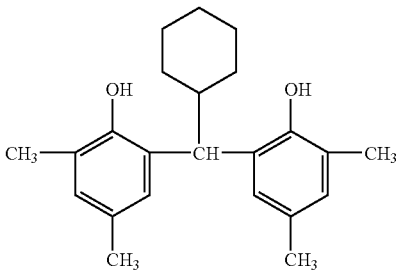

-continued (RED-18)

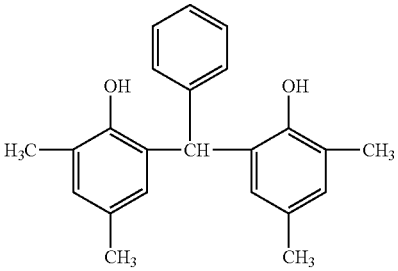

(RED-19)

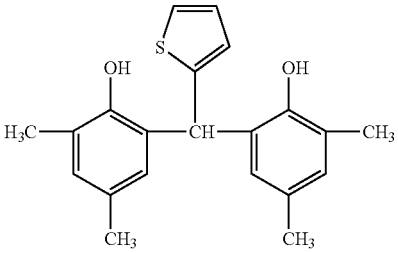

(RED-20)

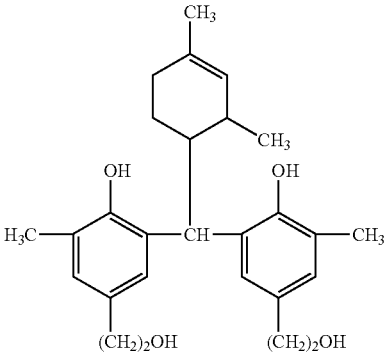

(RED-21)

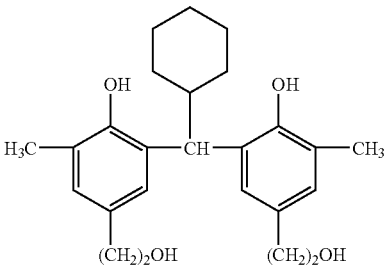

It is possible to synthesize these compounds (bisphenol compounds) represented by General Formula (RED) employing conventional methods known in the art.

The amount of silver ion reducing agents employed in the photothermographic dry imaging materials of the present invention varies depending on the types of organic silver salts, reducing agents and other additives. However, the aforesaid amount is customarily 0.05–10 mol per mol of organic silver salts, and is preferably 0.1–3 mol. Further, in the aforesaid range, silver ion reducing agents of the present invention may be employed in combinations of at least two types. Namely, in view of achieving images exhibiting excellent storage stability, high image quality and high CP, it is preferable to simultaneously use reducing agents which differ in reactivity, due to a different chemical structure.

In the present invention, preferred cases occasionally occur in which the aforesaid reducing agents are added, just prior to coating, to a photosensitive emulsion comprised of photosensitive silver halide, organic silver salt particles, and solvents and the resulting mixture is coated to minimize variations of photographic performance due to the standing time.

Further, hydrazine derivatives and phenol derivatives represented by General Formulas (1)–(4) in JP-A No. 2003-43614, and General Formulas (1)–(3) in JP-A 2003-66559 are preferably employed as a development accelerator which are simultaneously employed with the aforesaid reducing agents.

The oxidation potential of development accelerators employed in the silver salt photothermographic materials of the present invention, which is determined by polarographic measurement, is preferably lower 0.01–0.4 V, and is more preferably lower 0.01–0.3 V than that of the compounds represented by General Formula (RED). Incidentally, the oxidation potential of the aforesaid development accelerators is preferably 0.2–0.6 V, which is polarographically determined in a solvent mixture of tetrahydrofuran:Britton Robinson buffer solution=3:2 the pH of which is adjusted to 6 employing an SCE counter electrode, and is more preferably 0.3–0.55 V. Further, the pKa value in a solvent mixture of tetrahydrofuran:water=3:1 is preferably 3–12, and is more preferably 5–10. It is particularly preferable that the oxidation potential which is polarographically determined in the solvent mixture of tetrahydrofuran:Britton Robinson buffer solution=3:2, the pH of which is adjusted to 6, employing an SCE counter electrode is 0.3–0.55, and the pKa value in the solvent mixture of tetrahydrofuran:water=3:2 is 5–10.

Further employed as silver ion reducing agents according to the present invention may be various types of reducing agents disclosed in European Patent No. 1,278,101 and JP-A No. 2003-15252.

The amount of silver ion reducing agents employed in the photothermographic imaging materials of the present invention varies depending on the types of organic silver salts, reducing agents, and other additives. However, the aforesaid amount is customarily 0.05–10 mol per mol of organic silver salts and is preferably 0.1–3 mol. Further, in this amount range, silver ion reducing agents of the present invention may be employed in combinations of at least two types. Namely, in view of achieving images exhibiting excellent storage stability, high image quality, and high CP, it is preferable to simultaneously employ reducing agents which differ in reactivity due to different chemical structure.

In the present invention, preferred cases occasionally occur in which when the aforesaid reducing agents are added to and mixed with a photosensitive emulsion comprised of photosensitive silver halide, organic silver salt particles, and solvents just prior to coating, and then coated, variation of photographic performance during standing time is minimized.

(Surface Active Agents at an HLB Value of 3–7)

The present invention is characterized in incorporating surface active agents at an HLB value of 3–7. HLB values, as described herein, refer to those which numerically represents the relative ratio of the hydrophilicity of a surface active agent to the oleophilicity of the same and is primarily applied to nonionic surface active agents. Based on emulsification experiments of oil, a value of 1–40 is empirically given. As the numerical value decreases, oleophilicity increases, while as the numerical value increases, hydrophilicity increases. It is possible to obtain HLB values based on an empirical calculation formula, referring to the mass fraction of a hydrophilic group, etc. The HLB values are more preferably in the range of 3.5–6. Specific examples of surface active agents at an HLB of 3–7 are listed below. However, compounds employed in the present invention are not limited these specific examples.

Listed are propylene glycol fatty acid esters, propylene glycol monostearic acid ester, ethylene glycol fatty acid esters, sorbitan sequioleic acid ester, polyoxyethylenesorbit-4,5-oleic acid ester, glycerin monostearic acid ester, sorbitan monooleic acid ester, diethylene glycol monooleic acid ester, diethylene glycol fatty acid esters, diethylene glycol monostearic acid ester, diethylene glycol monolauric acid ester, sorbitan monopalmitic acid ester, and polyethyleneoxy-polypropyleneoxy copolymers.

(Surface Active Agents at an HLB Value of at Least 8)

In the present invention, it is preferable to incorporate surface active agents at an HLB value of at least 8, and it is more preferable to incorporate those at an HLB value in the range of 8–20. Listed are specific examples of surface active agents at an HLB value of at least 8. However, compounds employed in the present invention are not limited thereto.

Listed are polyoxypropylene mannitol dioleic acid ester, polyoxypropylene stearic acid ester, sorbitan monolauric acid ester, polyoxyethylene fatty acid esters, tetraethylene glycol monolauric acid esters, polyoxyethylene dodecyl ether, polyoxyethylene sorbitan monostearic acid ester, polyoxyethylene sorbitan monooleic acid ester, polyoxyethylene hexadecyl ether, polyoxyethylene sorbitan tristearic acid ester, polyoxyethylene sorbitan trioleic acid ester, polyoxypropylene oleic acid ester, polyoxyethylene monooleic acid ester, polyoxyethylene monostearic acid ester, polyoxyethylene monopalmitic acid ester, alkylarylsulfonic acid salts, triethanolamine oleic acid salt, polyoxyethylene monolauric acid ester, polyoxyethylene alkyl aryl ethers, polyoxyethylene sorbitan monolauric acid ester, polybutylene glycol, polyethyleneoxy alkylamines, and polyethyleneoxy-polypropyleneoxy copolymers.

<Gelatin Capable of Being Dispersed in Organic Solvent>

It is preferable to use gelatin which can be dispersed in an organic solvent for dispersing photosensitive silver halide grains.

Usually, gelatin is so hydrophilic that it is not appropriate to disperse in an organic solvent. Therefore, in the present invention, it is preferable to employ gelatin which can be dispersed in an organic solvent in order to disperse AgX grains uniformly. As a means enabling gelatin to be dispersed in an organic solvent, a known method can be used such as giving an oleophilic property to gelatin. An examples of such method is to modify gelatin with a oleophilic group. Specific examples are, carbamoyl substituted gelatin, phthalic gelatin and succinic gelatin, although the present invention is not limited by them.

<Compounds Represented by Formula (1)>

The compounds represented by Formula (1) will be explained.

In Formula (1), X represents $C(V^{21})$ or a nitrogen atom, each $V^{20}$ and $V^{21}$ independently represents a hydrogen atom or a substituent, provided that $V^{20}$ and $V^{21}$ may form a ring by binding together; each A and A' independently represents a hydrogen atom or a substituent, provided that at least one of A and A' represents OH, OR, $NH_2$, NHR or NRR', each R and R' independently representing a hydrogen atom or a substituent; and A and A' may form a ring by binding together; and n represents an integer of 0 to 5.

Examples of basic structures represented by Formula (1) are as follows.

When X is a carbon atom:

and when n is o, hydroxylamine and hydrazine;

and when n is 1, catechol, 2-aminophenol, ascorbic acid derivatives, 2-hydroxycyclohexanone;

and when n is 2, hydroquinone, 1,4-dihydroxynaphtalene, 4-aminophenol and p-phenylenediamine.

When X is a nitrogen atom, example of a basic structure represented by Formula (1) is Phenidone. Further, listed examples of basic structures formed by different Xs are, pyridine, pyrimidine, pyrazine and pyridazine, in which at least one of an amino group and a hydroxy group is substituted.

It is preferable that each of the compounds represented by Formula (1) has an oxidation potential measured with polarography smaller than the reducing agent for silver ions by 0.01 to 0.4 V, more preferably, by 0.01 to 0.3 V.

It is preferable that each of the compounds represented by Formula (1) has an oxidation potential of 0.2–0.6 V (SEC), measured with polarography in a mixed solvent of tetrahydrofuran:Briton Robinson buffer=3:2 adjusted to pH 6. More preferably, an oxidation potential is 0.3–0.55 V (SEC).

It is preferable that each of the compounds represented by Formula (1) has a pKa value of 3 to 12 in a mixed solvent of tetrahydrofuran:water=3:2. More preferably, a pKa value is 5 to 10.

It is more preferable that the compounds represented by Formula (1) are further represented by Formula (DA-1) or Formula (DA-2).

In General Formula (DA-1) or (DA-2), $X_1$ and $X_2$ independently represent a hydrogen atom or a substituent. Examples of substituents represented by $X_1$ and $X_2$ include a halogen atom (e.g., a fluorine atom, a chlorine atom, a bromine atom, or a an iodine atom); an aryl group (having preferably 6–30 carbon atoms, more preferably 6–20, and still more preferably 6–12, and for example, phenyl, p-methylphenyl, or naphthyl); an alkoxy group (having preferably 1–20 carbon atoms, more preferably 1–12, and still more preferably 1–8, and for example, methoxy, ethoxy, or butoxy); an aryloxy group (having preferably 6–20 carbon atoms, more preferably, and still more preferably 6–12, and for example, phenyloxy or 2-naphthyloxy); an alkylthio group (having preferably 1–20 carbon atoms, more preferably 1–16, and still more preferably 1–12, and for example, methylthio, ethylthio, or butylthio); an arylthio group (having preferably 6–20 carbon atoms, more preferably 6–16, and still more preferably 6–12, and for example, phenylthio or naphthylthio); an acyloxy group (having preferably 1–20 carbon atoms, more preferably 2–16, and still more preferably 2–10, and for example, acetoxy or benzoyloxy); an acylamino group (having preferably 2–20 carbon atoms, more preferably 2–16, and still more preferably 2–10, and for example, N-methylacetylamino or benzoylamino); a sulfonylamino group (having preferably 1–20 carbon atoms, more preferably 1–16, and still more preferably 1–12, and for example, methanesulfonylamino or benzenesulfonylamino); a carbamoyl group (having preferably 1–20 carbon atoms, more preferably 1–16, and still more preferably 1–12, and for example, carbamoyl, N,N-diethylcarbamoyl, or N-phenylcarbamoyl); an acyl group (having preferably 2–20 carbon atoms, more preferably 2–16, and still more preferably 2–12, and for example, acetyl, benzoyl, formyl, and pivaloyl); an alkoxycarbonyl group (having preferably 2–20 carbon atoms, more preferably 2–16, and still more preferably 2–12, and for example, methoxycarbonyl); a sulfo group; a sulfonyl group (having preferably 1–20 carbon atoms, more preferably 1–16, and still more preferably 1–12, and for example, mesyl or tosyl); a sulfonyloxy group (having preferably 1–20 carbon atoms, more preferably 1–16, and still more preferably 1–12, and for example, methanesulfonyloxy or benzenesulfonyloxy); an azo group; a heterocyclic group; a heterocyclic mercapto group; and a cyano group. A heterocyclic groups, as described herein, refer to a saturated or unsaturated heterocyclic group and examples include a pyridyl group, a quinolyl group, a quinoxanyl group, a pyradinyl group, a benzotriazolyl group, a piraxolyl group, an imidazolyl group, a benzimidazolyl group, a tetrazolyl group, a hydantoin-1-il group, a succinimide group, and a phthalimide group.

In General Formula (DA-1) or (DA-2), the case in which $X_1$ and $X_2$ each represent preferably a substituent, and more preferably an alkoxy group, and an aryloxy group is preferred in view of the fact that more preferably, dye images are not substantially formed after development and the image color tone of heat developable light-sensitive materials is barely affected. Further, the substituent represented by $X_1$ and $X_2$ may be further substituent with another substituent. Any of the substituents, which are commonly known, may be usable as long as photographic performance is not adversely affected.

In General Formula (DA-1) or (DA-2), $R^9$–$R^{11}$ each independently represent a hydrogen atom or a substituent; m2 and p2 each independently represent an integer of 0–4; and n2 represents an integer of 0–2. Any of the substituents represented by $R^9$–$R^{11}$ may be usable as long as photographic performance is not adversely affected. Examples include a halogen atom (e.g., a fluorine atom, a chlorine atom, a bromine atom, or an iodine atom); a straight, branched chain, or cyclic alkyl group, or an alkyl group having combinations of thereof (having preferably 1–20 carbon atoms, more preferably 1–16, and still more preferably 1–13, and for example, methyl, ethyl, n-propyl, isopropyl, sec-butyl, tert-butyl, tert-octyl, n-amyl, n-dodecyl, n-tridecyl, or cyclohexyl); an alkenyl group (having preferably 2–20 carbon atoms, more preferably 2–16, and still more preferably 2–12, and for example, vinyl, allyl, 2-butenyl, or 3-pentenyl); an aryl group (having preferably 6–30 carbon atoms, more preferably 6–20, and still more preferably 6–12, and for example, phenyl, p-methylphenyl, or naphthyl); an alkoxy group (having preferably 1–20 carbon atoms, more preferably 1–16, and still more preferably 1–12, and for example, methoxy, ethoxy, propoxy, or butoxy); an aryloxy group (having preferably 6–30 carbon atoms, more preferably 6–20, and still more preferably 6–12, and for example, phenyloxy or 2-naphthyloxy); an acyloxy group (having preferably 2–20 carbon atoms, more preferably 2–16, and still more preferably 2–12, and for example, acetoxy or benzoyloxy); an amino group (having preferably 0–20 carbon atoms, more preferably 1–16, and still more preferably 1–12, and for example, a dimethylamino group, a diethylamino group, a dibutylamino group, or an anilino group); an acylamino group (having preferably 2–20 carbon atoms, more preferably 2–16, and still more preferably 2–13, and for example, acetyl amino, tridecanoylamino, or benzoylamino); a sulfonylamino group (having preferably 1–20 carbon atoms, more preferably 1–16, and still more preferably 1–12, and for example, methanesulfonylamino, butanesulfonylamino, or benzenesulfonylamino); a ureido group (having preferably 1–20 carbon atoms, more preferably 1–16, and still more preferably 1–12, and for example, ureido, methylureido, or phenylureido); a carbamate group (having preferably 2–20 carbon atoms, more preferably 2–16, and still more preferably 2–12, and for example, methoxycarbionylamino or phenyloxycarbonylamino); a carboxyl group; a carbamoyl group (having preferably 1–20 carbon atoms, more preferably 1–16, and still more preferably 1–12, and for example, carbamoyl, N,N-diethylcarbamoyl, N-dodecylcarbamoyl, or N-phenylcarbamoyl); an alkoxycarbonyl group (having preferably 2–20 carbon atoms, more preferably 2–16, and still more preferably 2–12, and for example, methoxycarbonyl, ethoxycarbonyl, or butoxycarbonyl); an acyl group (having preferably 2–20 carbon atoms, more preferably 2–16, and still more preferably 2–12, and for example, acetyl, benzoyl, formyl, or pivaloyl); a sulfo group; a sufonyl group (having preferably 1–20 carbon atoms, more preferably 1–16, and still more preferably 1–12, and for example, mesyl or tosyl); a sulfamoyl group (having preferably 0–20 carbon atoms, more preferably 0–16, and still more preferably 0–12, and for example, sulfamoyl, methylsulfamoyl, dimethylsulfamoyl, or phenylsulfamoyl); a cyano group, a nitro group, a hydroxyl group, a mercapto group; an alkylthio group (having preferably 1–20 carbon atoms, more preferably 1–16, and still more preferably 1–12, and for example, methylthio or butylthio); and a heterocyclic group (having preferably 2–20 carbon atoms, more preferably 2–16, and still more preferably 2–12, and for example, pyridyl, imidazolyl, or pyrrolidyl). These substituents may be further substituted with another substituents. Of these compounds, the preferred substituents represented by $R^9$–$R^{11}$ include a halogen atom, an alkyl group, an aryl group, an alkoxy group, an aryloxy group, an acyloxy group, an anilino group, an acylamino group, a sulfonylamino group, a carboxyl group, a carbamoyl group, an acyl group, a sulfo group, a sulfonyl group, a sulfamoyl group, a cyano group, a hydroxyl group, a mercapto group, an alkylthio group, and a heterocyclic group.

It is particularly preferable that the compounds represented by General Formula (DA-1) have, at the position 2, a carbamoyl group (having preferably 1–20 carbon atoms, more preferably 1–16, and still more preferably 1–12, and for example, carbamoyl, N,N-diethylcarbamoyl, N-dodecylcarbamoyl, N-phenylcarbamoyl, N-(2-chlorophenyl)carbamoyl, N-(4-chlorophenyl)carbamoyl, N-(2,4-dichlorophenyl)carbamoyl, or N-(3,4-dichlorophenyl)carbamoyl).

Specific examples of the compounds represented by Formula (DA-1) and Formula (DA-2) are listed below. However, the present invention is not limited by them

DA-1-1

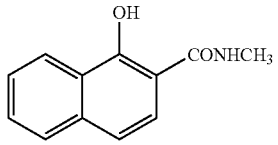

DA-1-2

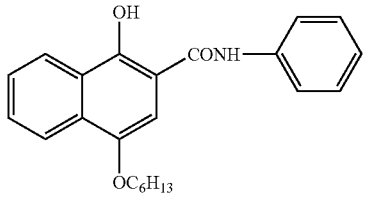

-continued

DA-1-3

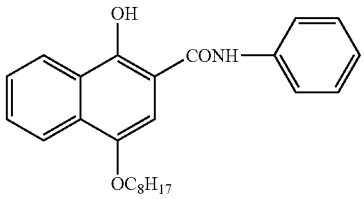

DA-1-4

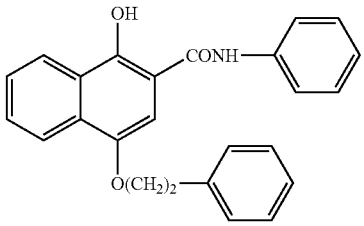

DA-1-5

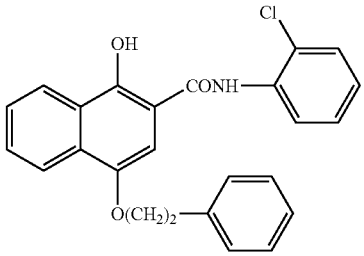

DA-2-1

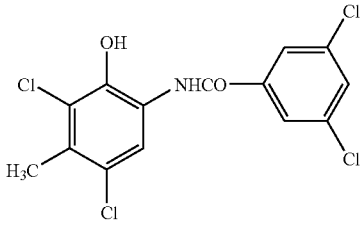

DA-2-2

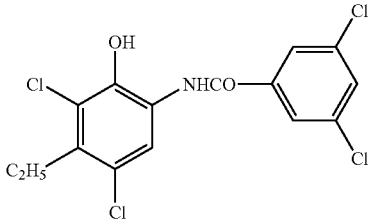

DA-2-3

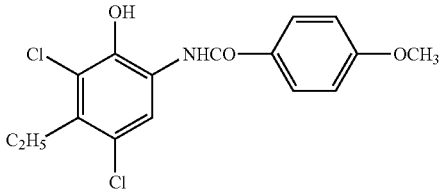

DA-2-4

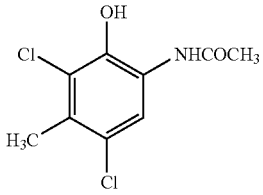

-continued

DA-2-5

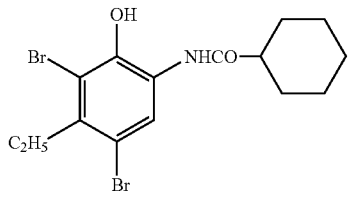

It is possible to readily synthesize the compounds represented by General Formula (DA-1) or (DA-2), employing methods known by a skilled person in the art. The compounds represented by General Formula (DA-1) or (DA-2) are dissolved in either water or suitable organic solvents such as alcohols (methanol, ethanol, propanol, or fluorinated alcohol), ketones (acetone or methyl ethyl ketone), dimethylformamide, dimethylsulfoxide, or methylcellosolve and then employed. Alternatively, by employing previously well known emulsification dispersion methods, the above compounds are dissolved in oil such in dibutyl phthalate, tricresyl phosphate, glyceryl triacetate, diethyl phthalate, employing auxiliary solvents such as ethyl acetate or cyclohexanone, and emulsion dispersion is mechanically prepared. Based on well known solid dispersing method, powder of the above compounds is dispersed into water, employing a ball mill, a colloid mill, a sand grinder mill, a Manton-Gaulin homogenizer, Microfluidizer, or an ultrasonic homogenizer and then employed.

The compounds represented by General Formula (DA-1) or (DA-2) may be added to any of the layers on a support, as long as the aforesaid compounds are present on the same plane as of silver halides and reducible silver salts. However, it is preferable that they are added to the layer containing silver halide or the layer adjacent to the aforesaid layer. The added mount of the compounds represented by General Formula (DA-1) or (DA-2) is preferably 0.2–200 millimol per mol of silver, is more preferably 0.3–100 millimol, and is still more preferably 0.5–30 millimol. The compounds represented by General Formula (DA-1) or (DA-2) of the present invention may be used individually or in combinations of at least two types.

<Chemical Sensitization>

The photosensitive silver halide of the present invention may undergo chemical sensitization. For instance, it is possible to create chemical sensitization centers (being chemical sensitization nuclei) utilizing compounds which release chalcogen such as sulfur, as well as noble metal compounds which release noble metal ions, such as gold ions, while employing methods described in, for example, Japanese Patent Application Nos. 2000-057004 and 2000-061942.

The chemical sensitization nuclei is capable of trapping an electron or a hole produced by a photo-excitation of a sensitizing dye.

It is preferable that the aforesaid silver halide is chemically sensitized employing organic sensitizers containing chalcogen atoms, as described below.

It is preferable that the aforesaid organic sensitizers, comprising chalcogen atoms, have a group capable of being adsorbed onto silver halide grains as well as unstable chalcogen atom positions.

Employed as the aforesaid organic sensitizers may be those having various structures, as disclosed in JP-A Nos. 60-150046, 4–109240, and 11-218874. Of these, the aforesaid organic sensitizer is preferably at least one of compounds having a structure in which the chalcogen atom bonds to a carbon atom, or to a phosphorus atom, via a double bond. More specifically, a thiourea derivative having a heterocylic group and a triphenylphosphine derivative are preferred.

Chemical sensitization methods of the present invention can be applied based on a variety of methods known in the field of wet type silver halide materials. Examples are disclosed in: (1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing, 1998.

Specifically, when a silver halide emulsion is chemically sensitized, then mixed with a light-insensitive organic silver salt, the conventionally known chemical sensitizing methods ca be applied.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. The chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. The sensitization conditions are that the pAg is preferably from 6 to 11, but is more preferably from 7 to 10, while the pH is preferably from 4 to 10, but is more preferably from 5 to 8. Further, the sensitization is preferably carried out at a temperature of lass than or equal to 30° C.

Further, it is preferable that chemical sensitization, employing the aforesaid organic sensitizers, is carried out in the presence of either spectral sensitizing dyes or compounds containing heteroatoms, which exhibit the adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher speed as well as lower fogging. Though spectral sensitizing dyes will be described below, the compounds comprising heteroatoms, which result in adsorption onto silver halide grains, as descried herein, refer to, as preferable examples, nitrogen containing heterocyclic compounds described in JP-A No. 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of the rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzthiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

The aforesaid heterocyclic ring may have substituents other than a hydroxyl group. As substituents, the aforesaid heterocyclic ring may have, for example, an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom, and a cyano group.

The added amount of these heterocyclic compounds varies widely depending on the size and composition of silver halide grains, and other conditions. However, the amount is in the range of about $10^{-6}$ to 1 mol per mol with respect to silver halide, and is preferably in the range of $10^{-4}$ to $10^{-1}$ mol.

The photosensitive silver halide of the present invention may undergo noble metal sensitization utilizing compounds which release noble metal ions such as gold ions. For example, employed as gold sensitizers may be chloroaurates and organic gold compounds.

Gold sensitization methods described in JP-A No. 11-194447 may be employed.

Further, other than the aforesaid sensitization methods, it is possible to employ a reduction sensitization method. Employed as specific compounds for the reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH higher than or equal to 7 or a pAg less than or equal to 8.3.

Silver halide which undergoes the chemical sensitization, according to the present invention, includes one which has been formed in the presence of organic silver salts, another which has been formed in the absence of organic silver salts, or still another which has been formed by mixing those above.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Spectral Sensitization>

It is preferable that photosensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in JP-A Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in JP-A Nos. 9-34078, 9-54409, and 9-80679.

Useful cyanine dyes include, for example, cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to the basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a maronitryl nucleus, and a pyrazolone nucleus.

In the present invention, it is possible to employ sensitizing dyes which exhibit spectral sensitivity, specifically in the infrared region. Listed as preferably employed infrared spectral sensitizing dyes are infrared spectral sensitizing dyes disclosed in U.S. Pat. Nos. 4,536,473, 4,515,888, and 4,959,294.

It is preferred that the imaging material of the present invention incorporates at least one sensitizing dye represented by the following General Formulas (SD-1) or (SD-2).

General Formula (SD-1)

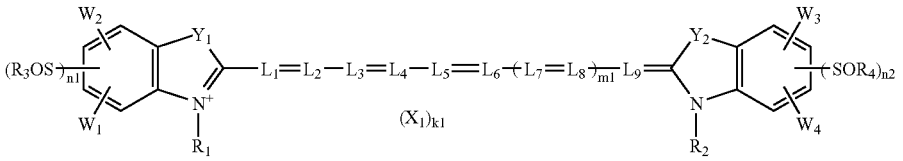

General Formula (SD-2)

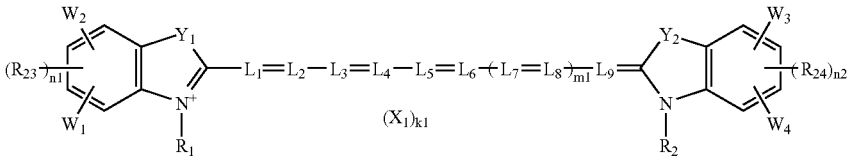

wherein $Y_1$ and $Y_2$ each represent an oxygen atom, a sulfur atom, a selenium atom, or —CH═CH—; $L_1$–$L_9$ each represent a methine group; $R_1$ and $R_2$ each represent an aliphatic group; $R_3$, $R_4$, $R_{23}$, and $R_{24}$ each represent a lower alkyl group, a cycloalkyl group, an alkenyl group, an aralkyl group, an aryl group, or a heterocyclic group; $W_1$, $W_2$, $W_3$, and $W_4$ each represent a hydrogen atom, a substituent, or a group of non-metallic atoms necessary for forming a condensed ring while combined between $W_1$ and $W_2$ and $W_3$ and $W_4$ or represent a group of non-metallic atoms necessary for forming a 5- or 6-membered condensed ring while combined between $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$; $X_1$ represents an ion necessary for neutralizing the charge in the molecule; $k_1$ represents the number of ions necessary for neutralizing the charge in the molecule; m1 represents 0 or 1; and n1 and n2 each represent 0, 1, or 2, however, n1 and n2 should not represent 0 at the same time.

It is possible to easily synthesize the aforesaid infrared sensitizing dyes, employing the method described in F. M. Harmer, "The Chemistry of Heterocyclic Compounds, Volume 18, The Cyanine Dyes and Related Compounds (A. Weissberger ed., published by Interscience, New York, 1964).

These infrared sensitizing dyes may be added at any time after preparing the silver halide. For example, the dyes may be added to solvents, or the dyes, in a so-called solid dispersion state in which the dyes are dispersed into minute particles, may be added to a photosensitive emulsion comprising silver halide grains or silver halide grains/aliphatic carboxylic acid silver salts. Further, in the same manner as the aforesaid heteroatoms containing compounds which exhibit adsorption onto silver halide grains, the dyes are adsorbed onto silver halide grains prior to chemical sensitization, and subsequently, undergo chemical sensitization, whereby it is possible to minimize the dispersion of chemical sensitization center nuclei so at to enhance speed, as well as to decrease fogging.

In the present invention, the aforesaid spectral sensitizing dyes may be employed individually or in combination. Combinations of sensitizing dyes are frequently employed when specifically aiming for supersensitization, for expanding or adjusting a spectral sensitization range.

An emulsion comprising photosensitive silver halide as well as aliphatic carboxylic acid silver salts, which are employed in the silver salt photothermographic dry imaging material of the present invention, may comprise sensitizing dyes together with compounds which are dyes having no spectral sensitization or have substantially no absorption of visible light and exhibit supersensitization, whereby the aforesaid silver halide grains may be supersensitized.

Useful combinations of sensitizing dyes and dyes exhibiting supersensitization, as well as materials exhibiting supersensitization, are described in Research Disclosure Item 17643 (published December 1978), page 23, Section J of IV; Japanese Patent Publication Nos. 9-25500 and 43-4933; and JP-A Nos. 59-19032, 59-192242, and 5-431432. Preferred as supersensitizers are hetero-aromatic mercapto compounds or mercapto derivatives.

Ar-SM wherein M represents a hydrogen atom or an alkali metal atom, and Ar represents an aromatic ring or a condensed aromatic ring, having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthooxazole, benzoselenazole, benztellurazole, imidazole, oxazole, pyrazole, triazole, triazine, pyrimidine, pyridazine, pyrazine, pyridine, purine, quinoline, or quinazoline. On the other hand, other hetero-aromatic rings are also included.

Incidentally, mercapto derivatives, when incorporated in the dispersion of aliphatic carboxylic acid silver salts and/or a silver halide grain emulsion, are also included which substantially prepare the mercapto compounds. Specifically, listed as preferred examples are the mercapto derivatives described below.

Ar-S—S-Ar wherein Ar is the same as the mercapto compounds defined above.

The aforesaid hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than the aforesaid supersensitizers, employed as supersensitizers may be large ring compounds containing a hetero atom disclosed in JP-A No. 2001-330918.

The amount of a supersensitizer of the present invention used in a photosensitive layer containing an organic silver salt and silver halide grains and in the present invention is in the range of 0.001 to 1.0 mol per mol of Ag. More preferably, it is 0.01 to 0.5 mol per mol of Ag.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to employ a spectral sensitizing dye which is easily desorpted from the silver halide grains during thermal development; or to incorporate sufficient amount of an oxidizing agent capable to destroy the spectral sensitizing dye by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Silver Saving Agent>

In the present invention, either a photosensitive layer or a light-insensitive layer may comprise silver saving agents.

The silver saving agents, used in the present invention, refer to compounds capable of reducing the silver amount to obtain a definite silver image density. Even though various mechanisms may be considered to explain functions regarding a decrease in the silver amount, compounds having functions to enhance covering power of developed silver are preferable. The covering power of developed silver, as described herein, refers to optical density per unit amount of silver. These silver saving agents may be incorporated in either a photosensitive layer or a light-insensitive layer or in both such layers.

Listed as preferred examples of silver saving agents are hydrazine derivatives represented by General Formula (H) described below, vinyl compounds represented by General Formula (G) described below, and quaternary onium compounds represented by General Formula (P) described below.

General Formula (H)

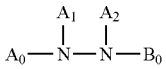

General Formula (G)

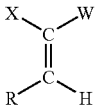

General Formula (P)

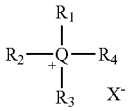

In General Formula (H), $A_0$ represents an aliphatic group, an aromatic group, a heterocyclic group, or a $-G_0-D_0$ group, each of which may have a substituent; $B_0$ represents a blocking group; and $A_1$ and $A_2$ each represents a hydrogen atom, or one represents a hydrogen atom and the other represents an acyl group, a sulfonyl group, or a oxalyl group. Herein, $G_0$ represents a —CO— group, a —COCO— group, a —CS— group, a $—C(=NG_1D_1)-$ group, a —SO— group, a $—SO_2—$ group, or a $—P(O)(G_1D_1)-$ group, wherein $G_1$ represents a simple bonding atom or a group such as an —O— group, a —S— group, or an $—N(D_1)-$ group, wherein $D_1$ represents an aliphatic group, an aromatic group, a heterocyclic group, or a hydrogen atom; when there is a plurality of $D_1$ in the molecule, those may be the same or different; and $D_0$ represents a hydrogen atom, an aliphatic group, an aromatic group, a heterocyclic group, an amino group, an alkoxy group, an aryloxy group, an alkylthio. group, or an arylthio group. Listed as preferred $D_0$ are a hydrogen atom, an alkyl group, an alkoxy group, and an amino group.

In General Formula (H), the aliphatic group represented by $A_0$ is preferably a straight chain, branched, or cyclic alkyl group having from 1 to 30 carbon atoms and more preferably from 1 to 20 carbon atoms. Listed as the alkyl groups are, for example, a methyl group, an ethyl group, a t-butyl group, an octyl group, a cyclohexyl group, and a benzyl group. The groups may be substituted with a suitable substituent (for example, an aryl group, an alkoxy group, an aryloxy group, an alkylthio group, an arylthio group, a sulfoxyl group, a sulfonamido group, a sulfamoyl group, an acylamino group, and a ureido group).

In General Formula (H), the aromatic group represented by $A_0$ is preferably a single ring or fused ring aryl group. Listed as examples are a benzene ring or a naphthalene ring. Preferably listed as heterocyclic groups represented by $A_0$ are those containing at least one heteroatom selected from nitrogen, sulfur and oxygen atoms. Listed as examples are a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, and a furan ring. The aromatic ring, heterocyclic group, and $-G_0-D_0$ group may each have a substituent. Particularly preferred as $A_0$ are an aryl group and a $-G_0-D_0-$ group.

Further, in General Formula (H), $A_0$ preferably contains at least one of non-diffusive groups or silver halide adsorbing groups. Preferred as the non-diffusive groups are ballast groups which are commonly employed for immobilized photographic additives such as couplers. Listed as ballast groups are an alkyl group, an alkenyl group, an alkynyl group, an alkoxy group, a phenyl group, a phenoxy group, and an alkylphenoxy group, which are photographically inactive. The total number of carbon atoms of the portion of the substituent is preferably at least 8.

In General Formula (H), listed as silver halide adsorption enhancing groups are thiourea, a thiourethane group, a mercapto group, a thioether group, a thione group, a heterocyclic group, a thioamido heterocyclic group, a mercapto heterocyclic group, or the adsorption group described in JP-A No. 64-90439.

In General Formula (H), $B_0$ represents a blocking group, and preferably represents $-G_0-D_0$ group, wherein $G_0$ represents a —CO— group, a —COCO— group, a —CS— group, a $—C(=NG_1D_1)-$ group, an —SO— group, an $—SO_2—$ group, or a $—P(O)(G_1D_1)$ group. Listed as preferred $G_0$ are a —CO— group and a —COCO— group. $G_1$ represents a simple bonding atom or group such as an —O— atom, an —S— atom or an $—N(D_1)-$ group, wherein $D_1$ represents an aliphatic group, an aromatic group, a heterocyclic group, or a hydrogen atom, and when there is a plurality of $D_1$ in a molecule, they may be the same or different. $D_0$ represents a hydrogen atom, an aliphatic group, an aromatic group, a heterocyclic group, an amino group, an alkoxy group, an aryloxy group, an alkylthio group, and an arylthio group. Listed as preferred $D_0$ are a hydrogen atom, an alkyl group, an alkoxy group, or an amino group. $A_1$ and $A_2$ each represents a hydrogen atom, or when one represents a hydrogen atom, the other represents an acyl group (such as an acetyl group, a trifluoroacetyl group, and a benzoyl group), a sulfonyl group (such as a methanesulfonyl group and a toluenesulfonyl group), or an oxalyl group (such as an ethoxalyl group).

The compounds represented by General Formula (H) can be easily synthesized employing methods known in the art. They can be synthesized based on, for example, U.S. Pat. Nos. 5,464,738 and 5,496,695.

Other than those, preferably usable hydrazine derivatives include Compounds H-1 through H-29 described in columns 11 through 20 of U.S. Pat. No. 5,545,505, and Compounds 1 through 12 in columns 9 through 11 of U.S. Pat. No. 5,464,738. The hydrazine derivatives can be synthesized employing methods known in the art.

In General Formula (G), X as well as R are illustrated utilizing a cis form, while X and R include a trans form. This is applied to the structure illustration of specific compounds.

In General Formula (G), X represents an electron attractive group, while W represents a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

R represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. X and W may be joined together to form a ring structure, while X and R may also be joined together in the same manner. Listed as rings which are formed by X and W are, for example, pyrazolone, pyrazolidinone, cyclopentanedione, β-ketolactone, β-ketolactum.

General Formula (G) will be described further. The electron attractive group represented by X refers to the substituent of which substituent constant σp is able to take a positive value. Specifically, included are a substituted alkyl group (such as a halogen-substituted alkyl group), a substituted alkenyl group (such as a cyanovinyl group), a substituted or unsubstituted alkynyl group (such as a trifluoromethylacetylenyl group and a cyanoacetylenyl group), a substituted aryl group (such as a cyanophenyl group), a substituted or unsubstituted heterocyclic group (such as a pyridyl group, a triazinyl group, or a benzoxazolyl group), a halogen atom, a cyano group, an acyl group (such as an acetyl group, a trifluoroacetyl group, and a formyl group), a thioacetyl group (such as a thioacetyl group and a thioformyl group), an oxalyl group (such as a methyloxalyl group), an oxyoxalyl group (such as an ethoxyoxalyl group), a thiooxyalyl group (such as an ethylthiooxyalyl group), an oxamoyl group (such as a methyloxamoyl group), an oxycarbonyl group (such as an ethoxycarbonyl group), a carboxyl group, a thiocarbonyl group (such as an ethylthiocarbonyl group), a carbamoyl group, a thiocarbamoyl group, a sulfonyl group, a sulfinyl group, an oxysulfonyl group (such as an ethoxysulfonyl group), a thiosulfonyl group (such as an ethylthiosulfonyl group), a sulfamoyl group, an oxysulfinyl group (such as a methoxysulfinyl group), a thiosulfinyl group (such as a methylthiosulfinyl group), a sulfinamoyl group, a phosphoryl group, a nitro group, an imino group, an N-carbonylimino group (such as an N-acetylimino group), an N-sulfonylimino group (such as an N-methanesulfonylimino group), a dicyanoethylene group, an ammonium group, a sulfonium group, a phosphonium group, a pyrylium group, and an immonium group. However, also included are heterocyclic rings which are formed employing an ammonium group, a sulfonium group, a phosphonium group, or an immonium group. Substituents having a ap value of at least 0.30 are particularly preferred.

Alkyl groups represented by W include a methyl group, an ethyl group, and a trifluoromethyl group; alkenyl groups represented by W include a vinyl group, a halogen-substituted vinyl group, and a cyanovinyl group; aryl groups represented by W include a nitrophenol group, a cyanophenyl group, and a pentafluorophenyl group; heterocyclic groups represented by W include a pyridyl group, a triazinyl group, a succinimido group, a tetrazolyl group, an imidazolyl group, and a benzoxyazolyl group. Preferred as W are electron attractive groups having a positive σp value, and more preferred are those having a σp value of at least 0.30.

Of the aforesaid substituents of R, preferably listed are a hydroxyl group, a mercapto group, an alkoxy group, an alkylthio group, a halogen atom, an organic or inorganic salt of a hydroxyl group or a mercapto group, and a heterocyclic group, and of these, more preferably listed are a hydroxyl group, and an organic or inorganic salt of a hydroxyl group or a mercapto group.

Further, of the aforesaid substituents of X and W, preferred are those having an thioether bond in the substituent.

In General Formula (P), Q represents a nitrogen atom or a phosphorus atom; $R_1$, $R_2$, $R_3$, and $R_4$ each represents a hydrogen atom or a substituents; and $X^-$ represents an anion. Incidentally, $R_1$ through $R_4$ may be joined together to form a ring.

Listed as substituents represented by $R_1$ through $R_4$ are an alkyl group (such as a methyl group, an ethyl group, a propyl group, a butyl group, a hexyl group, and a cyclohexyl group), an alkenyl group (such as an allyl group and a butenyl group), an alkynyl group (such as a propargyl group and a butynyl group), an aryl group (such as a phenyl group and a naphthyl group), a heterocyclic group (such as a piperidinyl group, a piperazinyl group, a morpholinyl group, a pyridyl group, a furyl group, a thienyl group, a tetrahydrofuryl group, a tetrahydrothienyl group, and a sulforanyl group), and an amino group.

Listed as rings which are formed by joining $R_1$ through $R_4$ are a piperidine ring, a morpholine ring, a piperazine ring, quinuclidine ring, a pyridine ring, a pyrrole ring, an imidazole ring, a triazole ring, and a tetrazole ring.

Groups represented by $R_1$ through $R_4$ may have a substituent such as a hydroxyl group, an alkoxy group, an aryloxy group, a carboxyl group, a sulfo group, an alkyl group, and an aryl group. $R_1$, $R_2$, $R_3$, and $R_4$ each is preferably a hydrogen atom or an alkyl group.

Listed as anions represented by $X^-$ are inorganic or organic anions such as a halogen ion, a sulfate ion, a nitrate ion, an acetate ion, and a p-toluenesulfonate ion.

The aforesaid quaternary onium compounds can easily be synthesized employing methods known in the art. For instance, the aforesaid tetrazolium compounds can be synthesized based on the method described in Chemical Reviews Vol. 55. pages 335 through 483. The added amount of the aforesaid silver saving agents is commonly from $10^{-5}$ to 1 mol with respect to mol of aliphatic carboxylic acid silver salts, and is preferably from $10^{-4}$ to $5\times10^{31\ 1}$ mol.

In the present invention, it is preferable that at least one of silver saving agents is a silane compound.

The silane compounds employed as a silver saving agent in present invention are preferably alkoxysilane compounds having at least two primary or secondary amino groups or salts thereof, as described in Japanese Patent Application No. 2003-5324.

When alkoxysilane compounds or salts thereof or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

<Binder>

Suitable binders for the silver salt photothermographic material of the present invention are to be transparent or translucent and commonly colorless, and include natural polymers, synthetic resin polymers and copolymers, as well as media to form film. The binders include, for example, gelatin, gum Arabic, casein, starch, poly(acrylic acid), poly (methacrylic acid), poly(vinyl chloride), poly(methacrylic acid), copoly(styrene-maleic anhydride), copoly(styrene-acrylonitrile), copoly(styrene-butadiene), poly(vinyl acetals) (for example, poly(vinyl formal) and poly(vinyl butyral), poly(esters), poly(urethanes), phenoxy resins, poly(vinylidene chloride), poly(epoxides), poly(carbonates), poly (vinyl acetate), cellulose esters, poly(amides). The binders may be hydrophilic or hydrophobic.

Preferable binders for the photosensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

In the present invention, it is preferable that thermal transition point temperature, after development is at higher or equal to 100° C., is from 46 to 200° C. and is more preferably from 70 to 105° C. Thermal transition point temperature, as described in the present invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the photosensitive layer. The inventors of the present invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, the present invention was achieved.

The glass transition temperature (Tg) is determined employing the method, described in Brandlap, et al., "Polymer Handbook", pages from III-139 through III-179, 1966 (published by Wiley and Son Co.). The Tg of the binder comprised of copolymer resins is obtained based on the following formula.

Tg of the copolymer (in ° C.)$=v_1Tg_1+v_2Tg_2+\ldots+v_nTg_n$ wherein $v_1, v_2, \ldots v_n$ each represents the mass ratio of the monomer in the copolymer, and $Tg_1, Tg_2, \ldots Tg_n$ each represents Tg (in ° C.) of the homopolymer which is prepared employing each monomer in the copolymer. The accuracy of Tg, calculated based on the formula calculation, is ±5° C.

In the silver salt photothermographic dry imaging material of the present invention, employed as binders, which are incorporated in the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Listed as homopolymers or copolymers which comprise the ethylenic unsaturated monomers as constitution units are alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy) ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, employed may be the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by General Formula (V) described below.

General Formula (V)

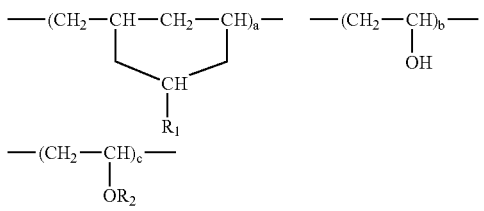

wherein $R_1$ represents a substituted or unsubstituted alkyl group, and a substituted or unsubstituted aryl group, however, groups other than the aryl group are preferred; $R_2$ represents a substituted or unsubstituted alkyl group, a substituted or unsubstituted aryl group, —$COR_3$ or —$CONHR_3$, wherein $R_3$ represents the same as defined above for $R_1$.

Unsubstituted alkyl groups represented by $R_1$, $R_2$, and $R_3$ preferably have from 1 to 20 carbon atoms and more preferably have from 1 to 6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have from 6 to 20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably from 1 to 20, while the number of total carbons of the substituted aryl group is preferably from 6 to 20.

$R_2$ is preferably —$COR_3$ (wherein $R_3$ represents an alkyl group or an aryl group) and —$CONHR_{53}$ (wherein $R_3$ represents an aryl group). "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c" is in the range of 0 to 40 mol percent. The repeated units having each composition ratio of "a", "b", and "c" may be the same or different.

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═$O(OM)_2$, —O—P═$O(OM)_2$ (wherein M represents a hydrogen atom or an alkali metal salt group), —$N(R_4)_2$, —$N^+(R_4)_3$ (wherein $R_{54}$ represents a hydrocarbon group, and a plurality of $R_{54}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/mm$^2$.

Polymers represented by aforesaid General Formula (V) of the present invention can be synthesized employing common synthetic methods described in "Sakusan Binihru Jushi (Vinyl Acetate Resins)", edited by Ichiro Sakurada (Kohbunshi Kagaku Kankoh Kai, 1962).

Examples of representative synthetic methods will now be described. However, the present invention is not limited to these representative synthetic examples.

Synthetic Example 1

Synthesis of P-1

Charged into a reaction vessel were 20 g of polyvinyl alcohol (Gosenol GH18) manufactured by Nihon Gosei Co., Ltd. and 180 g of pure water, and the resulting mixture was dispersed in pure water so that 10 weight percent polyvinyl alcohol dispersion was obtained. Subsequently, the resultant dispersion was heated to 95° C. and polyvinyl alcohol was dissolved. Thereafter, the resultant solution was cooled to 75° C., whereby an aqueous polyvinyl alcohol solution was prepared. Subsequently, 1.6 g of 10 percent by weight hydrochloric acid, as an acid catalyst, was added to the solution. The resultant solution was designated as Dripping Solution A. Subsequently, 11.5 g of a mixture consisting of butylaldehyde and acetaldehyde in a mol ratio of 4:5 was prepared and was designated as Dripping Solution B. Added to a 1,000 ml four-necked flask fitted with a cooling pipe and a stirring device was 100 ml of pure water which was heated to 85° C. and stirred well. Subsequently, while stirring, Dripping Solution A and Dripping Solution B were simultaneously added dropwise into the pure water over 2 hours, employing a dripping funnel. During the addition, the reaction was conducted while minimizing coalescence of deposit particles by controlling the stirring rate. After the dropwise addition, 7 g of 10 weight percent hydrochloric acid, as an acid catalyst, was further added, and the resultant mixture was stirred for 2 hours at 85° C., whereby the reaction had sufficiently progressed. Thereafter, the reaction mixture was cooled to 40° C. and was neutralized employing sodium bicarbonate. The resultant product was washed with water 5 times, and the resultant polymer was collected through filtration and dried, whereby P-1 was prepared. The Tg of obtained P-1 was determined employing a DSC, resulting in 83° C.

Other polymers described in Table 1 were synthesized in the same manner as above.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the aforesaid binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer Name | Acetoacetal mol % | Butyral mol % | Acetal mol % | Acetyl mol % | Hydroxyl Group mol % | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd. "-" in the table 1 means "not measured".

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in the present invention may be various conventional cross-linking agents, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent Application Open to Public Inspection No. 50-96216. Of these, preferred are isocyanate based compounds, silane compounds, epoxy compounds or acid anhydrides, as shown below.

As one of preferred cross-linking agents, isocyanate based and thioisocyanate based cross-linking agents represented by General Formula (IC), shown below, will now be described.

$$X{=}C{=}N\text{-}L\text{-}(N{=}C{=}X)_v \qquad \text{General Formula (IC)}$$

wherein v represents 1 or 2; L represents an alkyl group, an aryl group, or an alkylaryl group which is a linking group having a valence of v+1; and X represents an oxygen atom or a sulfur atom.

Incidentally, in the compounds represented by aforesaid General Formula (IC), the aryl ring of the aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

The aforesaid isocyanate based cross-linking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols.

Employed as specific examples may be isocyanate compounds described on pages 10 through 12 of JP-A No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic dry imaging material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have a v of 0, namely compounds having only one functional group.

Listed as examples of silane compounds which can be employed as a cross-linking agent in the present invention are compounds represented by General Formal (1) or General Formula (2), described in JP-A No. 2002-22203.

In these General Formulas, $R^1$, $R^2$, $R^3$, $R^4$, $R^5$, $R^6$, $R^7$, and $R^8$ each represents a straight or branched chain or cyclic alkyl group having from 1 to 30 carbon atoms, which may be substituted, (such as a methyl group, an ethyl group, a butyl group, an octyl group, a dodecyl group, and a cycloalkyl group), an alkenyl group (such as a propenyl group, a butenyl group, and a nonenyl group), an alkynyl group (such as an acetylene group, a bisacetylene group, and a phenylacetylene group), an aryl group, or a heterocyclic group (such as a phenyl group, a naphthyl group, a tetrahydropyrane group, a pyridyl group, a furyl group, a thiophenyl group, an imidazole group, a thiazole group, a thiadiazole group, and an oxadiazole group, which may have either an electron attractive group or an electron donating group as a substituent.

At least one of substituents selected from $R^1$, $R^2$, $R^3$, $R^4$, $R^5$, $R^6$, $R^7$, and $R^8$ is preferably either a non-diffusive group or an adsorptive group. Specifically, $R^2$ is preferably either a non-diffusive group or an adsorptive group.

Incidentally, the non-diffusive group, which is called a ballast group, is preferably an aliphatic group having at least 6 carbon atoms or an aryl group substituted with an alkyl group having at least 3 carbon atoms. Non-diffusive properties vary depending on binders as well as the used amount of cross-linking agents. By introducing the non-diffusive groups, migration distance in the molecule at room temperature is retarded, whereby it is possible to retard reactions during storage.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Preferred as epoxy compounds are those represented by General Formula (EP) described below.

General Formula (EP)

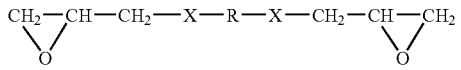

In General Formula (9), the substituent of the alkylene group represented by R is preferably a group selected from a halogen atom, a hydroxyl group, a hydroxyalkyl group, or an amino group. Further, the linking group represented by R preferably has an amido linking portion, an ether linking portion, or a thioether linking portion. The divalent linking group, represented by X, is preferably $—SO_2—$, $—SO_2NH—$, —S—, —O—, or $—NR_1—$, wherein $R_1$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/m$^2$, and is more preferably in the range of $1\times10^{-5}$ to $1\times10^{-3}$ mol/m$^2$.

The epoxy compounds may be incorporated in optional layers on the photosensitive layer side of a support, such as a photosensitive layer, a surface protective layer, an interlayer, an anti-halation layer, and a subbing layer, and may be incorporated in at least two layers. In addition, the epoxy compounds may be incorporated in optional layers on the side opposite the photosensitive layer on the support. Incidentally, when a photosensitive material has a photosensitive layer on both sides, the epoxy compounds may be incorporated in any layer.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited, but the compounds represented by General Formula (SA) are preferred.

General Formula (SA)

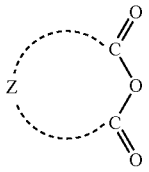

In General Formula (SA), Z represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-6}$ to $1\times10^{-3}$ mol/m$^2$.

In the present invention, the acid anhydrides may be incorporated in optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

<Tone Controlling Agent>

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Diligent investigation was performed for the silver salt photothermographic imaging material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also 0.998–1.000.

The value v* of the intersection point of the aforesaid linear regression line with the ordinate is −5–+5; and gradient (v*/u*) is 0.7–2.5.

(2) The coefficient of determination value $R^2$ of the linear regression line is 0.998–1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is −5–+5, while gradient (b*/a*) is 0.7–2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In the present invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, toning agents such as phthalazinones or a combinations of phthalazine with phthalic acids, or phthalic anhydride are employed.

Examples of suitable image toning agents are disclosed in Research Disclosure, Item 17029, and U.S. Pat. Nos. 4,123,282, 3,994,732, 3,846,136, and 4,021,249.

Other than such toners, it is preferable to control color tone employing couplers disclosed in JP-A No. 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to the present invention.

(Leuco Dyes)

Leuco dyes are employed in the silver salt photothermographic dry imaging materials of the present invention.

Employed as leuco dyes may be any of the colorless or slightly tinted compounds which are oxidized to form a colored state when heated at temperatures of about 80—about 200° C. for about 0.5—about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 200-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01–0.30, is preferably 0.02–0.20, and is most preferably 0.02–0.10. Further, it is preferable that images be controlled within the preferred color tone range described below.

(Yellow Forming Leuco Dyes)

In the present invention, particularly preferably employed as yellow forming leuco dyes are color image forming agents represented by following General Formula (YL) which increase absorbance between 360 and 450 nm via oxidation.

General Formula (YL)

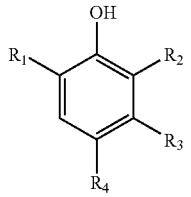

The compounds represented by General Formula (YL) will now be detailed.

In aforesaid General Formula (YL), preferably as the alkyl groups represented by $R_1$ are those having 1–30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Listed as substituents which $R_1$ may have are a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_2$ represents a hydrogen atom, a substituted or unsubstituted alkyl group, or an acylamino group. The alkyl group represented by $R_2$ is preferably one having 1–30 carbon atoms, while the acylamino group is preferably one having 1–30 carbon atoms. Of these, description for the alkyl group is the same as for aforesaid $R_1$.

The acylamino group represented by $R_2$ may be unsubstituted or have a substituent. Specifically listed are an acetylamino group, an alkoxyacetylamino group, and an aryloxyacetylamino group. $R_2$ is preferably a hydrogen atom or an unsubstituted group having 1–24 carbon atoms, and specifically listed are methyl, i-propyl, and t-butyl. Further, neither $R_1$ nor $R_2$ is a 2-hydroxyphenylmethyl group.

$R_3$ represents a hydrogen atom, and a substituted or unsubstituted alkyl group. Preferred as alkyl groups are those having 1–30 carbon atoms. Description for the above alkyl groups is the same as for $R_1$. Preferred as $R_3$ are a hydrogen atom and an unsubstituted alkyl group having 1–24 carbon atoms, and specifically listed are methyl, i-propyl and t-butyl. It is preferable that either $R_{12}$ or $R_{13}$ represents a hydrogen atom.

$R_4$ represents a group capable of being substituted to a benzene ring, and represents the same group which is described for substituent $R_4$, for example, in aforesaid General Formula (RED). $R_4$ is preferably a substituted or unsubstituted alkyl group having 1–30 carbon atoms, as well as an oxycarbonyl group having 2–30 carbon atoms. The alkyl group having 1–24 carbon atoms is more preferred. Listed as substituents of the alkyl group are an aryl group, an amino group, an alkoxy group, an oxycarbonyl group, an acylamino group, an acyloxy group, an imide group, and a ureido group. Of these, more preferred are an aryl group, an amino group, an oxycarbonyl group, and an alkoxy group. The substituent of these alkyl group may be substituted with any of the above alkyl groups.

Among the compounds represented by General Formula (YL), preferred compounds are bis-phenol compounds represented by General Formula (YL')

General Formula (YL')

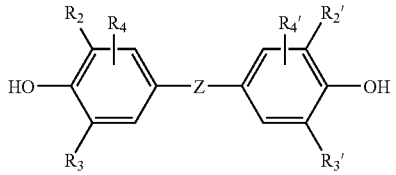

wherein, Z represents a —S— or —C($R_1$) ($R_{1'}$)— group. $R_1$ and $R_{1'}$ each represent a hydrogen atom or a substituent. The substituents represented by $R_1$ and $R_{1'}$ are the same substituents listed for $R_1$ in the aforementioned General Formula (RED). $R_1$ and $R_{1'}$ are preferably a hydrogen atom or an alkyl group.

$R_2$, $R_3$, $R_{2'}$ and $R_{3'}$ each represent a substituent. The substituents represented by $R_2$, $R_3$, $R_{2'}$ and $R_{3'}$ are the same substituents listed for $R_2$ and $R_3$ in the aforementioned General Formula (RED).

$R_2$, $R_3$, $R_{2'}$ and $R_{3'}$ are preferably, an alkyl group, an alkenyl group, an alkynyl group, an aryl group, a heterocyclic group, and more preferably, an alkyl group. Substituents on the alkyl group are the same substituents listed for the substituents in the aforementioned General Formula (RED).

$R_2$, $R_3$, $R_{2'}$ and $R_{3'}$ are more preferably tertiary alkyl groups such as t-butyl, t-amino, t-octyl and 1-methyl-cyclohexyl.

$R_4$ and $R_{4'}$ each represent a hydrogen atom or a substituent, and the substituents are the same substituents listed for $R_4$ in the aforementioned General Formula (RED).

Examples of the bis-phenol compounds represented by General Formula (RED) are, the compounds disclosed in JP-A No. 2002-169249, Compounds (II-1) to (II-40), paragraph Nos. [0032]–[0038]; and EP 1211093, Compounds (ITS-1) to (ITS-12), paragraph No. [0026].

In the following, specific examples of bisphenol compounds represented by General Formula (YL) are shown.

5-1

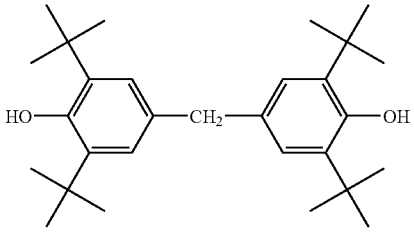

5-2

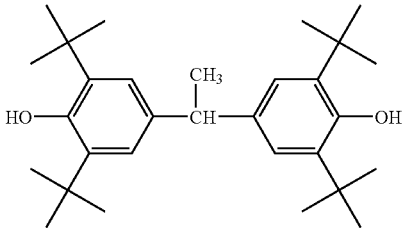

5-3

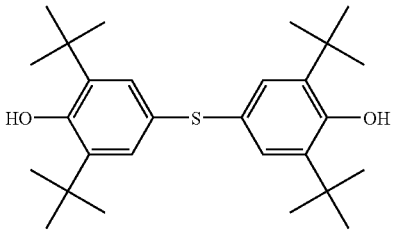

5-4

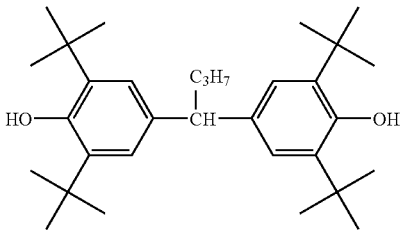

-continued 5-5

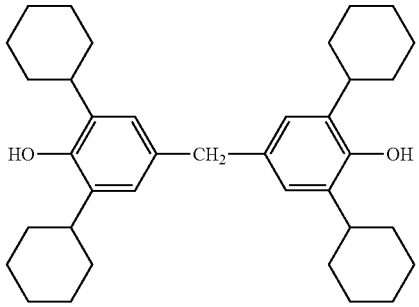

5-6

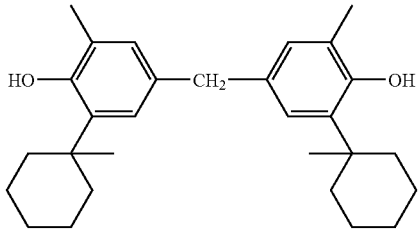

5-7

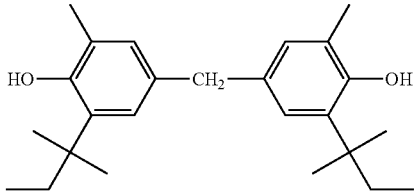

5-8

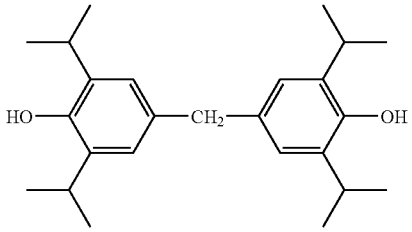

5-9

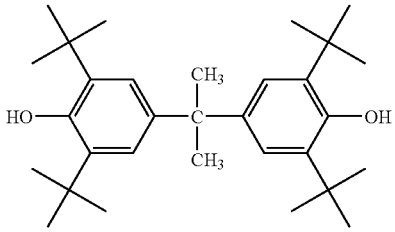

5-10

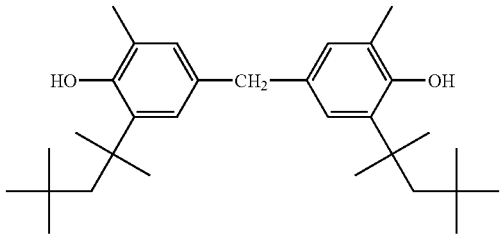

-continued (YL-11)

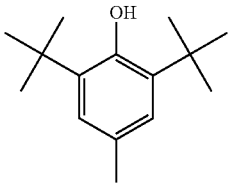

(YL-12)

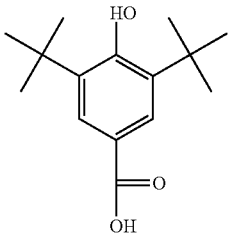

(YL-13)

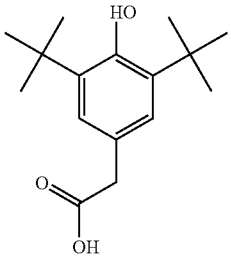

(YL-14)

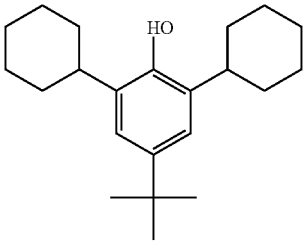

(YL-15)

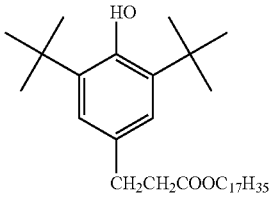

An amount of an incorporated compound represented by General Formula (YL) is; usually 0.00001 to 0.01 mol, and preferably, 0.0005 to 0.01 mol, and more preferably, 0.001 to 0.008 mol per mol of Ag.

(Cyan Forming Leuco Dyes)

Cyan forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600–700 nm), compounds represented by General Formulas (I)–(IV) of JP-A No. 5-204087 (specifically, compounds (1)–(18) described in paragraphs [0032]–[0037]), and compounds represented by General Formulas 4–7 (specifically, compound Nos. 1–79 described in paragraph [0105]) of JP-A No. 11-231460.

Cyan forming leuco dyes which are particularly preferably employed in the present invention are represented by following General Formula (CL).

General Formula (CL)

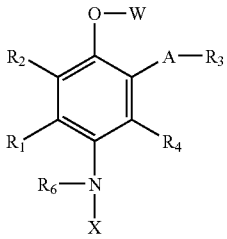

wherein $R_1$ and $R_2$ each represent a hydrogen atom, a substituted or unsubstituted alkyl group, an NHCO—$R_{10}$ group wherein $R_{10}$ is an alkyl group, an aryl group, or a heterocyclic group, while $R_1$ and $R_2$ may bond to each other to form an aliphatic hydrocarbon ring, an aromatic hydrocarbon ring, or a heterocyclic ring; A represents a —NHCO— group, a —CONH— group, or a —NHCONH— group; $R_3$ represents a substituted or unsubstituted alkyl group, an aryl group, or a heterocyclic group, or -A-$R_3$ is a hydrogen atom; W represents a hydrogen atom or a —CONH$R_5$— group, —CO$R_5$ or a —CO—O—$R_5$ group wherein $R_5$ represents a substituted or unsubstituted alkyl group, an aryl group, or a heterocyclic group; $R_4$ represents a hydrogen atom, a halogen atom, a substituted or unsubstituted alkyl group, an alkoxy group, a carbamoyl group, or a nitrile group; $R_6$ represents a —CONH—$R_7$ group, a —CO—$R_7$ group, or a —CO—O—$R_7$ group wherein $R_7$ is a substituted or unsubstituted alkyl group, an aryl group, or a heterocyclic group; and X represents a substituted or unsubstituted aryl group or a heterocyclic group.

In General Formula (CL), halogen atoms include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6–20 carbon atoms such as a phenyl group, a naphthyl group, or a thienyl group; heterocyclic groups include each of thiophene, furan, imidazole, pyrazole, and pyrrole groups. A represents a —NHCO— group, a —CONH— group, or a —NHCONH— group; $R_3$ represents a substituted or unsubstituted alkyl group (preferably having at most 20 carbon atoms such as methyl, ethyl, butyl, or dodecyl), an aryl group (preferably having 6–20 carbon atoms, such as phenyl, naphthyl, or thienyl), or a heterocyclic group (thiophene, furan, imidazole, pyrazole, or pyrrole); -A-$R_3$ is a hydrogen atom; W represents a hydrogen atom or a —CONH$R_5$ group, a —CO—$R_5$ group or a —CO—O$R_5$ group wherein $R_5$ represents a substituted or unsubstituted alkyl group (preferably having at most 20 carbon atoms, such as methyl, ethyl, butyl, or dodecyl), an aryl group (preferably having 6–20 carbon atoms, such as phenyl, naphthyl, or thienyl), or a heterocyclic group (such as thiophene, furan, imidazole, pyrazole, or pyrrole); $R_4$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Aforesaid $R_1$ and $R_2$, and $R_3$ and $R_4$ bond to each other to form a ring structure. The aforesaid groups may have a single substituent or a plurality of substituents. For example, typical substituents which may be introduced into aryl groups include a halogen atom (fluorine, chlorine, or bromine), an alkyl group (methyl, ethyl, propyl, butyl, or dodecyl), a hydroxyl group, a cyan group, a nitro group, an alkoxy group (methoxy or ethoxy), an alkylsulfonamide group (methylsulfonamido or octylsulfonamido), an arylsulfonamide group (phenylsulfonamido or naphthylsulfonamido), an alkylsulfamoyl group (butylsulfamoyl), an arylsulfamoyl group (phenylsulfamoyl), an alkyloxycarbonyl group (methoxycarbonyl), an aryloxycarbonyl group (phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group. It is possible to introduce two different groups of these groups into an aryl group. Either $R_{10}$ or $R_{85}$ is preferably a phenyl group, and is more preferably a phenyl group having a plurality of substituents containing a halogen atom or a cyano group.

$R_6$ is a —CONH—$R_7$ group, a —CO—$R_7$ group, or —CO—O—$R_7$ group, wherein $R_7$ is a substituted or unsubstituted alkyl group (preferably having at most 20 carbon atoms, such as methyl, ethyl, butyl, or dodecyl), an aryl group (preferably having 6–20 carbon atoms, such as phenyl, naphthol, or thienyl), or a heterocyclic group (thiophene, furan, imidazole, pyrazole, or pyrrole). Employed as substituents of the alkyl group represented by $R_7$ may be the same ones as substituents in $R_1$–$R_4$. $X_8$ represents a substituted or unsubstituted aryl group or a heterocyclic group. These aryl groups include groups having 6–20 carbon atoms such as phenyl, naphthyl, or thienyl, while the heterocyclic groups include any of the groups such as thiophene, furan, imidazole, pyrazole, or pyrrole. Employed as substituents which may be substituted to the group represented by X may be the same ones as the substituents in $R_1$–$R_4$. As the groups represented by X, preferred are an aryl group, which is substituted with an alkylamino group (a diethylamino group) at the para position, or a heterocyclic group. These may contain other photographically useful groups.

Specific examples of cyan forming leuco dyes (CL) are listed below, however are not limited thereto.

(CL-1)

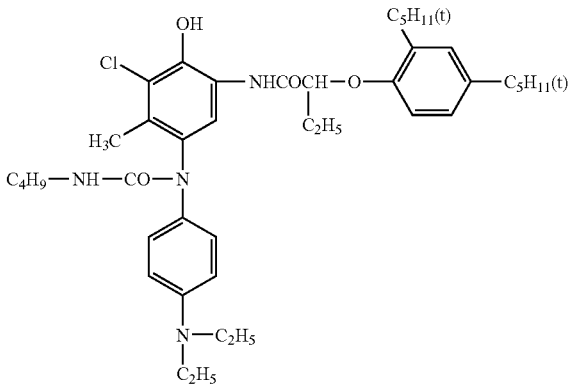

-continued (CL-2)

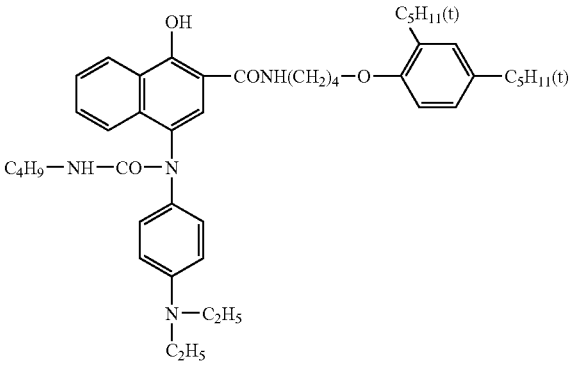

(CL-3)

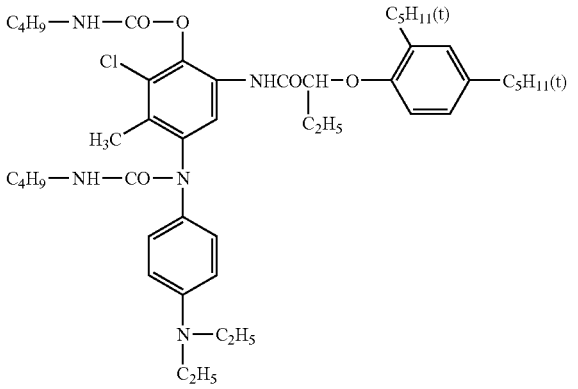

(CL-4)

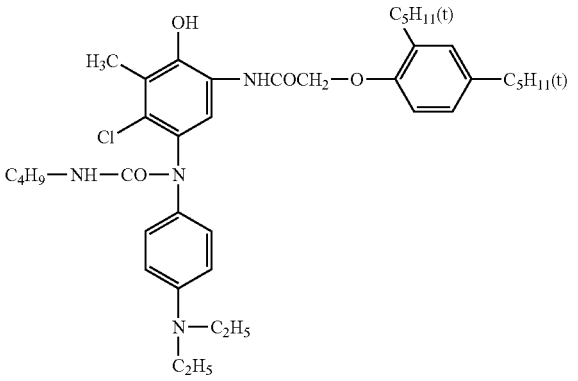

(CL-5)

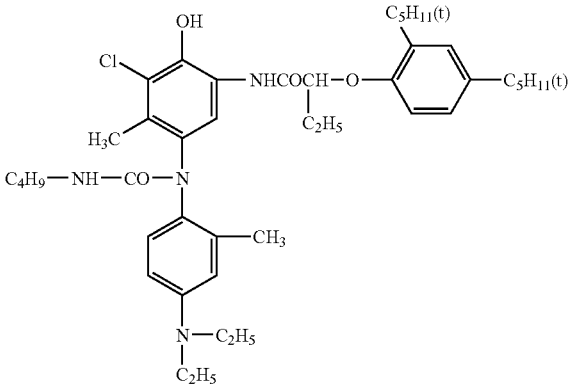

-continued (CL-6)

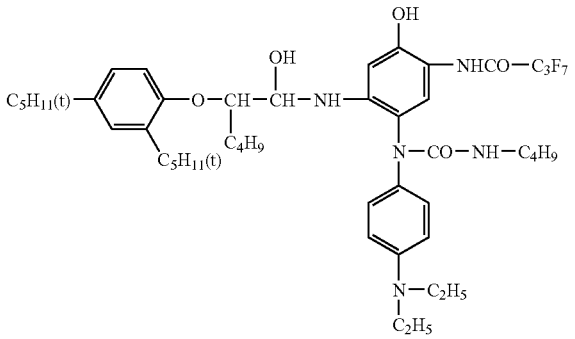

(CL-7)

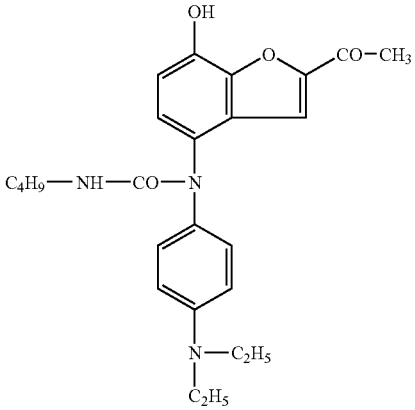

(CL-8)

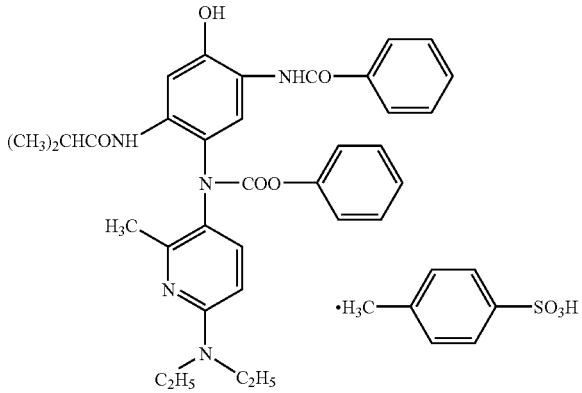

(CL-9)

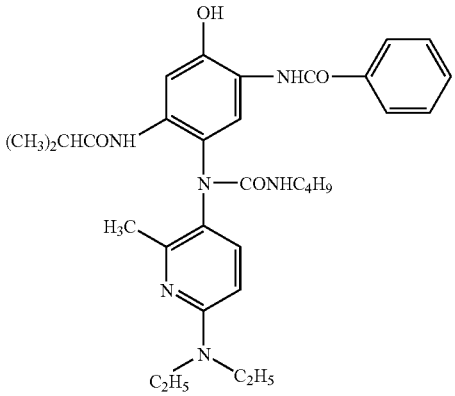

-continued (CL-10)

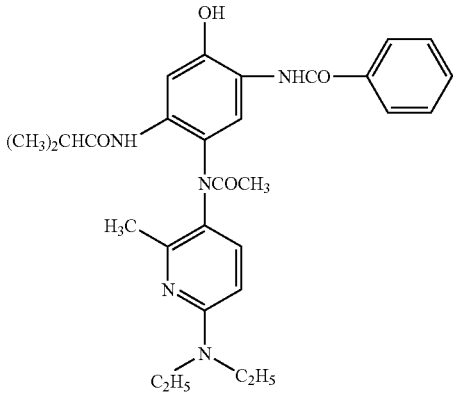

(CL-11)

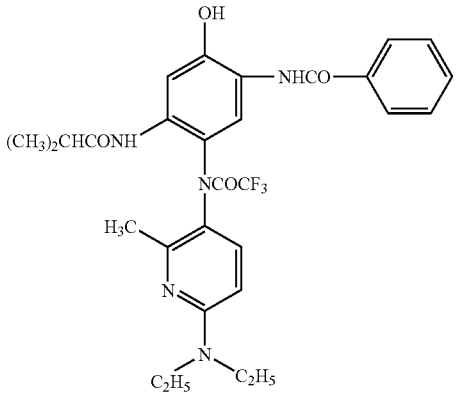

(CL-12)

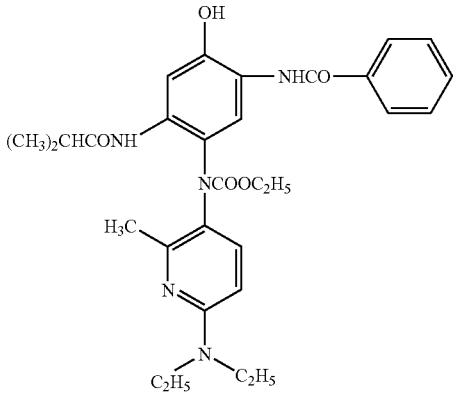

The added amount of cyan forming leuco dyes is customarily 0.00001–0.05 mol/mol of Ag, is preferably 0.0005–0.02 mol/mol, and is more preferably 0.001–0.01 mol.

The compounds represented by General Formula (YL) and cyan forming leuco dyes may be added employing the same method as for the reducing agents represented by General Formula (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by General Formula (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

<Coating Auxiliaries and Others>

In the present invention, in order to minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably less than or equal to 50 percent, is more preferably less than or equal to 40 percent, and is most preferably from less than or equal to 30 percent.

Herein, the variation coefficient of the particle size distribution refers to the value expressed by the formula described below.

((Standard deviation of particle diameter)/(particle diameter average))×100

Addition methods of the matting agent according to the present invention may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

(Fluorine Based Surface Active Agents)

It is preferable to employ the fluorine based surface active agents represented by following General Formulas (SA-1)–(SA-3) in the imaging materials according to the present invention.

$(Rf\text{-}L)_p\text{-}Y\text{-}(A)_q$ General Formula (SA-1)

$LiO_3S—(CF_2)_n—SO_3Li$ General Formula (SA-2)

$MO_3S—(CF_2)_n—SO_3M$ General Formula (SA-3)

wherein M represents a hydrogen atom, a sodium atom, a potassium atom, and an ammonium group; n represents a positive integer, while in the case in which M represents H, n represents an integer of 1–6 and 8, and in the case in which M represents an ammonium group, n represents an integer of 1–8.

In aforesaid General Formula (SA-1), Rf represents a substituent containing a fluorine atom. Listed as fluorine atom-containing substituents are, for example, an alkyl group having 1–25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

L represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

Y represents a trivalent or tetravalent linking group having no fluorine atom. Examples include trivalent or tetravalent linking groups having no fluorine atom, which are groups of atoms comprised of a nitrogen atom as the center. P represents an integer from 1 to 3, while q represents an integer of 2 or 3.

The fluorine based surface active agents represented by General Formula (SA-1) are prepared as follows. Alkyl compounds having 1–25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the trivalent—hexavalent alknaol compounds into which fluorine atom(s) are not introduced, aromatic compounds having 3–4 hydroxyl groups or hetero compounds. Anion group (A) is further introduced into the resulting compounds (including alknaol compounds which have been partially subjected to introduction of Rf) employing, for example, sulfuric acid esterification.

Listed as the aforesaid trivalent—hexavalent alkanol compounds are glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl) propane, 2,2-bis(butanol), aliphatic triol, tetramethylolmethane, D-sorbitol, xylitol, and D-mannitol.

Listed as the aforesaid aromatic compounds, having 3–4 hydroxyl groups and hetero compounds, are 1,3,5-trihydroxybenzene and 2,4,6-trihydroxypyridine.

n in General Formula (SA-2) represents an integer of 1–4.

In General Formula (SA-3), M represents a hydrogen atom, a potassium atom, or an ammonium group and n represents a positive integer. In the case in which M represents H, n represents an integer from 1 to 6 or 8; in the case in which M represents Na, n represents 4; in the case in which M represents K, n represents an integer from 1 to 6; and in the case in which M represents an ammonium group, n represents an integer from 1 to 8.

It is possible to add the fluorine based surface active agents represented by General Formulas (SA-1)–(SA-3) to liquid coating compositions, employing any conventional addition methods known in the art. Namely, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorine based surface active agents are added to the protective layer which is the outermost layer.

The added amount of the aforesaid fluorine based surface active agents is preferably $1\times10^{-8}$-$1\times10^{-1}$ mol per $m^2$. When the added amount is less than the lower limit, it is not possible to achieve desired charging characteristics, while it exceeds the upper limit, storage stability degrades due to an increase in humidity dependence.

Incidentally, surface active agents represented by General Formulas (SA-1), (SA-2), and (SA-3) are disclosed in JP-A No. 2003-57786, and Japanese Patent Application Nos. 2002-178386 and 2003-237982.

Listed as materials of the support employed in the silver salt photothermographic dry imaging material of the present invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic dry imaging material of the present invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in Japanese Patent Application No. 11-255557, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in Japanese Patent Publication Open to Public Inspection No. 8-201959.

<Layer Structures and Coating Conditions>

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.1 to 2.5 g/m$^2$, and is more preferably from 0.5 to 1.5 g/m$^2$.

Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$.

The ratio of the silver coverage which is resulted from silver halide is preferably from 2 to 18 percent with respect to the total silver, and is more preferably from 3 to 15 percent.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within the aforesaid range, from the viewpoint of maximum optical silver image density per definite silver coverage, namely covering power as well as silver image tone, desired results are obtained.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Incidentally, in the recording methods of the aforesaid first and second embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Development Conditions>

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will now be detailed with reference to examples. However, the present invention is not limited to these examples.

Example 1

<<Preparation of Subbed Photographic Supports>>

A photographic support comprised of a 175 μm thick biaxially oriented polyethylene terephthalate film with blue tinted at an optical density of 0.170 (determined by Densitometer PDA-65, manufactured by Konica Minolta Photo-imaging Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as Subbing Lower Layer B-1), which exhibited an antistatic function, was applied onto the backing layer side. The surface of Subbing Lower Layer A-1 and Subbing Lower Layer B-1 was subjected to corona discharge treatment of 8 W·minute/$m^2$. Subsequently, subbing liquid coating composition a-2 was applied onto Subbing Lower Layer A-1 was applied at 33° C. and 100 m/minute to result in a dried layer thickness of 0.03 μm and dried at 140° C. The resulting layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

(Preparation of Water-based Polyester A-1)

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170–220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220–235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000–100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allow to stand overnight, whereby Water-based Polyester A-1 Solution was prepared.

(Preparation of Modified Water-based Polyester B-1 and B-2 Solutions)

Placed in a 3-liter four-necked flask fitted with stirring blades, a reflux cooling pipe, a thermometer, and a dripping funnel was 1,900 ml of the aforesaid 15 percent by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20 percent by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate: acetacetoxyethyl methacrylate:n-butyl acrylate=39.5:40:20: 0.5.

(Preparation of Acryl Based Polymer Latexes C-1–C-3)

Acryl Based Polymer Latexes C-1–C-3 having the monomer compositions shown in the following table were synthesized employing emulsion polymerization. All the solid concentrations were adjusted to 30 percent by weight.

TABLE 2

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetacetoxyethyl methacrylate = 40:40:20 | 50 |

<<Water Based Polymers Containing Polyvinyl Alcohol Units>>

D-1: PVA-617 (Water Dispersion (5 percent solids): degree of saponification of 95, manufactured by Kuraray Co., Ltd.)

(Subbing Lower Layer Liquid Coating Composition a-1 on Image Forming Layer Side)

| | |
|---|---|
| Acryl Based Polymer Larex C-3 (30 percent solids) | 70.0 g |
| Water dispersion of ethoxylated alcohol and ethylene homopolymer (10 percent solids) | 5.0 g |
| Surface Active Agent (A) | 0.1 g |

A coating liquid composition was prepared by adding water to make 1,000 ml.

<<Image Forming Layer Side Subbing Upper Layer Liquid Coating Composition a-2>>

| | |
|---|---|
| Modified Water-based Polyester B-2 (18 percent by weight) | 30.0 g |
| Surface Active Agent (A) | 0.1 g |
| Spherical silica matting agent (Sea Hoster KE-P50, manufactured by Nippon Shokubai Co., Ltd.) | 0.04 g |

A liquid coating composition was prepared by adding water to make 1,000 ml.

(Backing Layer Side Subbing Lower Layer Liquid Coating Composition b-1)

| | |
|---|---|
| Acryl Based Polymer Late C-1 (30 percent solids) | 30.0 g |
| Acryl Based Polymer Late C-2 (30 percent solids) | 7.6 g |
| $SnO_2$ sol (the solid concentration of $SnO_2$ sol synthesized employing the method described in Example 1 of Japanese Patent Publication 35–6616 was heated and concentrated to reach a solid concentration of 10 percent by weight, and subsequently, the pH was adjusted to 10 by the addition of ammonia water) | 180 g |
| Surface Active Agent (A) | 0.5 g |
| 5 percent by weight of PVA-613 (PVA, manufactured by Kuraray Co., Ltd.) | 0.4 g |

A liquid coating composition was prepared by adding water to make 1,000 ml.

(Backing Layer Side Subbing Upper Layer Liquid Coatings Composition b-2)

| | |
|---|---|
| Modified Water-based Polyester B-1 (18 percent by weight) | 145.0 g |
| Spherical silica matting agent (Sea Roster KE-P50, manufactured by Nippon Shokubai Co., Ltd.) | 0.2 g |
| Surface Active Agent (A) | 0.1 g |

A liquid coating composition was prepared by adding water to make 1,000 ml.

Incidentally, an antihalation layer having the composition described below was applied onto Subbing Layer A-2 applied onto the aforesaid support.

| (Antihalation Layer Coating Composition) | |
|---|---|
| PVB-1 (binding agent) | 0.8 g/m$^2$ |
| C1 (dye) | $1.2 \times 10^{-5}$ mol/m$^2$ |

On the other hand, each of the liquid coating compositions of a BC layer and its protective layer which was prepared to achieve a coated amount (per m$^2$) described below was successively applied onto the aforesaid Subbing Upper Layer B-2 and subsequently dried, whereby a BC layer and a protective layer were formed.

| (BC Layer Composition) | |
|---|---|
| PVB-1 (binding agent) | 1.8 g |
| C1 (dye) | $1.2 \times 10^{-5}$ mol |
| **(BC Layer Protective Layer Liquid Coating Composition)** | |
| Cellulose acetate butyrate | 1.1 g |
| Matting agent (polymethyl methacrylate at an average particle diameter of 5 μm) | 0.12 g |
| Antistatic agent F-EO | 250 mg |
| Antistatic agent F-DS1 | 30 mg |

Surface Active Agent (A)

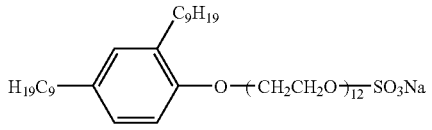

C1 (Dye)

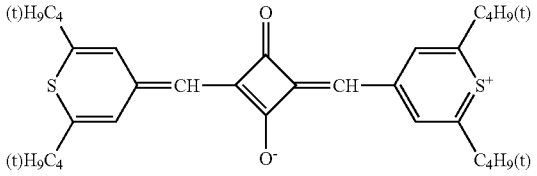

F-EO

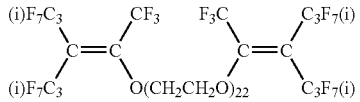

F-DS1

Polyacetal was employed as a binding agent, and methyl ethyl ketone (MEK) was employed as an organic solvent. Polyacetal was prepared as follows. Polyvinyl acetate at a degree of polymerization of 500 was saponified to a ratio of 98 percent, and subsequently, 86 percent of the residual hydroxyl groups were butylated. The resulting polyacetal was designated as PVB-1.

<<Preparation of Photosensitive Silver Halide Emulsion>>

(Preparation of Photosensitive Silver Halide Emulsion 1)

(Solution A1)

| | |
|---|---|
| Phenylcarbamoyl-modified gelatin | 88.3 g |
| Compound (*1) (10% aqueous methanol solution) | 10 ml |
| Potassium bromide | 0.32 g |
| Water to make | 5429 ml |
| (Solution B1) | |
| 0.67 mol/L aqueous silver nitrate solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| (Solution E1) | |
| 0.4 mol/L aqueous potassium bromide solution | the following amount controlled by silver potential |
| (Solution F1) | |
| Potassium hydroxide | 0.71 g |
| Water to make | 20 ml |
| (Solution G1) | |
| 56 percent aqueous acetic acid solution | 18.0 ml |
| (Solution H1) | |
| Sodium carbonate anhydride | 1.72 g |
| Water to make | 151 ml |

(*1) Compound A: $HO(CH_2CH_2O)_n(CH(CH_3)CH_2O)_{17}(CH_2CH_2O)_mH$ (m + N = 5 through 7)

Upon employing a mixing stirrer shown in Japanese Patent Publication Nos. 58-58288 and 58-58289, ¼ portion of Solution B1 and whole Solution C1 were added to Solution A1 over 4 minutes 45 seconds, employing a double-jet precipitation method while adjusting the temperature to 30° C. and the pAg to 8.09, whereby nuclei were formed. After one minute, whole Solution F1 was added. During the addition, the pAg was appropriately adjusted employing Solution E1. After 6 minutes, ¾ portion of Solution B1 and whole Solution D1 were added over 14 minutes 15 seconds, employing a double-jet precipitation method while adjusting the temperature to 30° C. and the pAg to 8.09. After stirring for 5 minutes, the mixture was cooled to 40° C., and whole Solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution Hi was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodispersed cubic silver iodobromide grains having an average grain size of 0.040 μm, a grain size variation coefficient of 12 percent and a (100) surface ratio of 92 percent.

(Preparation of Photosensitive Silver Halide Emulsion 2)

Photosensitive Silver Halide Emulsion 4 was prepared in the same manner as aforesaid Photosensitive Silver Halide Emulsion 1, except that after nucleus formation, all Solution F1 was added, and subsequently 4 ml of a 0.1 percent ethanol solution of ETTU (indicated below) was added.

Incidentally, the prepared emulsion was comprised of monodispersed cubic silver iodobromide grains having an average grain size of 0.042 μm, a grain size variation coefficient of 10 percent and a (100) surface ratio of 94

ETTU

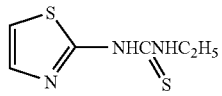

<<Preparation of Light-Sensitive Layer Liquid Coating Composition>>

(Preparation of Powdered Aliphatic Carboxylic Acid Silver Salt)

Each of Potassium Aliphatic Carboxylate Solutions A, B, and C was prepared by mixing 2.6 mol of aliphatic carboxylic acids at the mol ratio described in Table 3 (Be: behenic acid, Ar: arachidic acid and St: stearic acid), 10 L of pure water, and 0.47 L of a 5 M/L aqueous hydroxide solution and stirring the resultant mixture at 75° C. for one hour.

Added to a solution in a vessel, maintained at 30° C., which was prepared by mixing 38 L of pure water with 453 g of aforesaid Light-sensitive Silver Halide Emulsion 1 or 2 were 7 L of 1 M/L aqueous silver nitrate solution which had been separately prepared, and aforesaid Potassium Aliphatic Carboxylates A, B, and C in the stated order under the pattern described in Table 3. Aqueous silver nitrate solution was added over a constant period of 19.5 minutes, while all potassium aliphatic carboxylate solution was added over 20 minutes or 21 minutes (described in Table 3). During the addition, the potassium aliphatic carboxylate solution was maintained at 75° C., while aqueous silver nitrate solution was maintained at 10° C. Further, addition nozzles were positioned so that addition positions of the potassium aliphatic carboxylate solution and the aqueous silver nitrate solution maintained to be symmetrical with respect to a stirring shaft as a center. After completion of the addition, stirring was performed for 5 minutes without changing the temperature, whereby an aliphatic carboxylic silver salt dispersion was obtained.

TABLE 3

| Sample No. | Light-Sensitive Silver Halide Emulsion | Fatty Acid Composition and Addition Pattern: A Fatty Acid Composition (Be:Ar:St) | A Addition Pattern (in minute) | B Fatty Acid Composition (Be:Ar:St) | B Addition Pattern (minute) | C Fatty Acid Composition (Be:Ar:St) | C Addition Pattern (minute) | Addition Pattern of Silver Nitrate | Remarks |
|---|---|---|---|---|---|---|---|---|---|
| 1 | 1 | 48:31:21 | 0.5 to 7.0 | 48:31:21 | 7.0 to 13.5 | 48:31:21 | 13.5 to 20 | 0 to 19.5 | Comp. |
| 2 | 2 | 48:31:21 | 0.5 to 7.0 | 48:31:21 | 7.0 to 13.5 | 48:31:21 | 13.5 to 20 | 0 to 19.5 | Comp. |
| 3 | 1 | 10:10:80 | 0.5 to 7.0 | 48:31:21 | 7.0 to 13.5 | 48:31:21 | 13.5 to 20 | 0 to 19.5 | Comp. |
| 4 | 2 | 10:10:80 | 0.5 to 7.0 | 48:31:21 | 7.0 to 13.5 | 48:31:21 | 13.5 to 20 | 0 to 19.5 | Inv. |
| 5 | 2 | 10:10:80 | 0.5 to 7.0 | 10:10:80 | 7.0 to 13.5 | 48:31:21 | 13.5 to 20 | 0 to 19.5 | Inv. |
| 6 | 2 | 10:10:80 | 0.5 to 7.0 | 10:10:80 | 7.0 to 13.5 | 10:10:80 | 13.5 to 20 | 0 to 19.5 | Comp. |
| 7 | 2 | 10:10:80 | 0.5 to 7.0 | 10:10:80 | 7.0 to 13.5 | 90:8:2 | 13.5 to 20 | 0 to 19.5 | Inv. |
| 8 | 2 | 10:10:80 | 0.5 to 7.0 | 48:31:21 | 7.0 to 13.5 | 90:8:2 | 13.5 to 20 | 0 to 19.5 | Inv. |
| 9 | 2 | 48:31:21 | 0.5 to 7.0 | 48:31:21 | 7.0 to 13.5 | 90:8:2 | 13.5 to 20 | 0 to 19.5 | Inv. |
| 10 | 2 | 48:31:21 | 0.5 to 7.5 | 48:31:21 | 7.5 to 14.5 | 90:8:2 | 14.5 to 21 | 0 to 19.5 | Inv. |
| 11 | 2 | 48:31:21 | 0.5 to 7.0 | 90:8:2 | 7.0 to 13.5 | 90:8:2 | 13.5 to 20 | 0 to 19.5 | Inv. |
| 12 | 2 | 48:31:21 | 0.5 to 7.5 | 90:8:2 | 7.5 to 14.5 | 90:8:2 | 14.5 to 21 | 0 to 19.5 | Inv. |
| 13 | 2 | 10:10:80 | 0.5 to 7.0 | 90:8:2 | 7.0 to 13.5 | 90:8:2 | 13.5 to 20 | 0 to 19.5 | Inv. |
| 14 | 2 | 10:10:80 | 0.5 to 7.5 | 90:8:2 | 7.5 to 14.5 | 90:8:2 | 14.5 to 21 | 0 to 19.5 | Inv. |
| 15 | 2 | 90:8:2 | 0.5 to 7.0 | 90:8:2 | 7.0 to 13.5 | 90:8:2 | 13.5 to 20 | 0 to 19.5 | Comp. |

Comp.: Comparison

Inv.: Present invention

Addition Pattern is described using the addition time. A flow rate over the addition time was constant and the entire amount was added.

Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kikaku Co., Ltd.), while setting the drying conditions such as nitrogen gas as well as heating flow temperature at the inlet of the dryer (inlet temperature of 65° C. and outlet temperature of 40° C.), until its water content ratio reached 0.1 percent, whereby Powder Aliphatic Carboxylic Acid Silver Salt A was prepared. The water content ratio of aliphatic carboxylic acid silver salt compositions was determined employing an infrared moisture meter.

<<Preparation of Preliminary Dispersion A>>

Dissolved in 1457 g of methyl ethyl ketone (hereinafter referred to as MEK) was 14.57 g of poly(vinyl butyral) resin P-9. While stirring, employing Dissolver DISPERMAT Type CA-40M, manufactured by VMA-Getzmann Co., 500 g of aforesaid Powder Aliphatic Carboxylic Acid Silver Salt A was gradually added and sufficiently mixed, whereby Preliminary Dispersion A was prepared.

(Preparation of Photosensitive Emulsion A)

Preliminary Dispersion A, prepared as above, was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/second, whereby Photosensitive Emulsion A was prepared.

(Preparation of Stabilizer Solution)

Stabilizer Solution was prepared by dissolving 1.0 g of Stabilizer 1 and 0.31 g of potassium acetate in 4.97 g of methanol.

(Preparation of Infrared Sensitizing Dye A Solution)

Infrared Sensitizing Dye A Solution was prepared by dissolving 19.2 mg of Infrared Sensitizing Dye 1, 10 mg of Infrared Sensitizing Dye 2, 1.48 g of 2-chloro-benzoic acid, 2.78 g of Stabilizer 2, and 365 mg of 5-methyl-2-mercaptobenzimidazole in 131.3 ml of MEK in a light-shielded room.

(Preparation of Additive Solution "a")

Additive Solution "a" was prepared by dissolving 43.56 g of RED-17, 1.54 g of 4-methylphthalic acid, 0.15 g of aforesaid Infrared Dye 1 and YL-1 in 170 g of MEK.

(Preparation of Additive Solution "b")

Additive Solution "b" was prepared by dissolving 3.56 g of OFI-65 and 3.43 g of phthalazine in 40.9 g of MEK.

(Preparation of Photosensitive Layer Coating Composition A)

While stirring, 50 g of aforesaid Photosensitive Emulsion A and 15.11 g of MEK were mixed and the resultant mixture was maintained at 21° C. Subsequently, 390 μl of Antifoggant 1 (being a 10 percent methanol solution) was added and stirred for one hour. Further, 494 μl of calcium bromide (being a 10 percent methanol solution) was added and stirred for 20 minutes.

Subsequently, 582 μl of aforesaid Stabilizer Solution was added and stirred for 10 minutes. Thereafter, 4.11 g of aforesaid Infrared Sensitizing Dye A was added and the resulting mixture was stirred for one hour.

Subsequently, the resulting mixture was cooled to 13° C. and stirred for an additional 30 minutes. While maintaining at 13° C. 13.31 g of poly(vinyl acetal) Resin P-1 as a binder was added and stirred for 30 minutes. Thereafter, 1.084 g of tetrachlorophthalic acid (being a 9.4 weight percent MEK solution) was added and stirred for 15 minutes. Further, while stirring. 12.43 g of Additive Solution "a", 1.6 ml of Desmodur N300/aliphatic isocyanate, manufactured by Mobay Chemical Co. (being a 10 percent MEK solution), and 5.75 g of Additive Solution "b" were successively added, whereby Photosensitive Layer Coating Composition A was prepared.

<<Preparation of Silver Salt Photothermographic Dry Imaging Material Samples>>

Photosensitive Layer Liquid Coating Composition A and Surface Protective Layer Liquid Coating Composition, prepared as above, were simultaneously applied onto the subbing layer on the support prepared as above, employing a prior art extrusion type coater, whereby Sample 101 was prepared. The coating was performed so that the coated silver amount of the photosensitive layer reached 1.5 g/m$^2$ and the thickness of the surface protective layer reached 2.5 μm after drying. Thereafter, drying was performed employing a drying air flow at a temperature of 75° C. and a dew point of 10° C. for 10 minutes, whereby Sample 101 was prepared.

Stabilizer 1

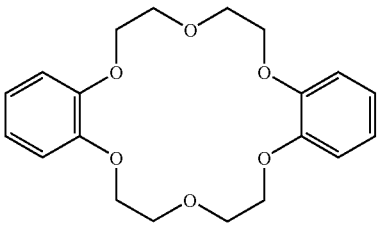

Antifoggant 1

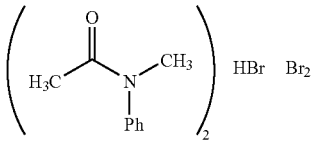

Stabilizer 2

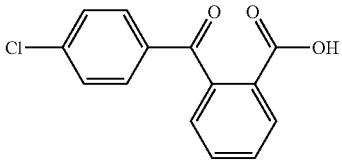

Infrared sensitizing dye 1

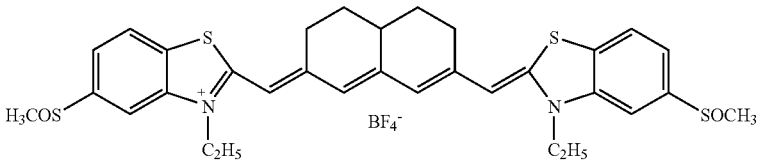

Infrared sensitizing dye 2

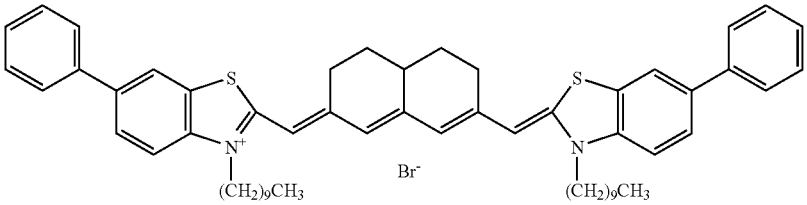

<<Surface Protective Layer>>

The liquid coating composition having the formulation described below was prepared in the same manner as the photosensitive layer liquid coating composition and was subsequently applied onto a photosensitive layer to result in the coated amount (per m$^2$) below, and subsequently dried, whereby a photosensitive layer protective layer was formed.

| | |
|---|---|
| Cellulose acetate propionate | 2.0 g |
| 4-Methyl phthalate | 0.7 g |
| Tetrachlorophthalic acid | 0.2 g |
| Tetrachlorophthalic anhydride | 0.5 g |
| Silica matting agent (at an average diameter of 5 μm) | 0.5 g |
| 1,3-bis(vinylsulfonyl)-2-propanol | 50 mg |
| Benzotriazole | 30 mg |
| Antistatic Agent: F-EO | 20 mg |
| Antistatic Agent: F-DS1 | 3 mg |

<<Evaluation of Each Characteristic>>

(Exposure and Development Process)

Scanning exposure was given onto the emulsion side surface of each sample prepared as above, employing an exposure apparatus in which a semiconductor laser, which was subjected to longitudinal multi mode of a wavelength of 800 to 820 nm, employing high frequency superposition, was employed as a laser beam source. In such a case, images were formed while adjusting the angle between the exposed surface of the sample and the exposure laser beam to 75 degrees. By employing such a method, compared to the case in which the angle was adjusted to 90 degrees, images were obtained which minimized unevenness and surprisingly exhibited excellent sharpness.

Thereafter, while employing an automatic processor having a heating drum, the protective layer of each sample was brought into contact with the surface of the drum and thermal development was carried out at 110° C. for 15 seconds. In such a case, exposure as well as development was carried out in the room which was conditioned at 23° C. and 50 percent relative humidity.

(Measurement of Speed, Fog Density, and Maximum Density)

The density of the resulting images formed as above was measured employing a densitometer and characteristic curves were prepared in which the abscise shows the exposure amount and the ordinate shows the density. Utilizing the resulting characteristic curve, speed was defined as the reciprocal of an exposure amount to result in density higher 1.0 than the unexposed part, and fog density (minimum density) as well as maximum density was determined. Incidentally, the speed and the maximum density were shown as a relative value when each value of Sample 101 was 100.

(Determination of Image Density Variation Due to Development of Samples Stored at Different Humidity)

Prior to the aforesaid processing, each of the samples was allowed to stand in a darkroom at each of 23° C. and 20 percent relative humidity, 23° C. and 50 percent relative humidity, and 23° C. and 80 percent relative humidity for three days. Thereafter, the resultant samples were exposed and developed in the same manner as above and the density of the resulting image was determined employing a densitometer. Based on the results of density determination, each of the samples was exposed to light at an exposure amount which resulted in a density of 1.0 for the sample stored in the darkroom at 23° C. and 50 percent relative humidity and then stored in the darkroom at 23° C. and 20 percent relative humidity as well as at 23° C. and 80 percent relative humidity for three days. Subsequently, the density of each of the samples was determined and the resulting Δ was evaluated as humidity dependence.

TABLE 4

| No. | Dmin | Relative Photographic Speed | Relative Photographic Speed Obtained by Thermal Processing prior to Exposure | Density Difference between Sample Stored at 20% and Sample Stored at 80% (Exposure amount to result in a density of 1.0 for Sample stored at 80%) | Remarks |
|---|---|---|---|---|---|
| 1 | 0.191 | 100 | 34 | 0.47 | Comp. |
| 2 | 0.195 | 105 | 6 | 0.44 | Comp. |
| 3 | 0.19 | 104 | 37 | 0.45 | Comp. |
| 4 | 0.193 | 112 | 7 | 0.23 | Inv. |
| 5 | 0.198 | 115 | 8 | 0.26 | Inv. |
| 6 | 0.262 | 123 | 12 | 0.67 | Comp. |
| 7 | 0.19 | 112 | 7 | 0.2 | Inv. |
| 8 | 0.193 | 110 | 7 | 0.22 | Inv. |
| 9 | 0.192 | 103 | 5 | 0.11 | Inv. |
| 10 | 0.189 | 120 | 10 | 0.07 | Inv. |
| 11 | 0.183 | 105 | 4 | 0.09 | Inv. |
| 12 | 0.179 | 112 | 7 | 0.04 | Inv. |
| 13 | 0.186 | 107 | 6 | 0.1 | Inv. |
| 14 | 0.184 | 114 | 8 | 0.06 | Inv. |
| 15 | 0.185 | 71 | 3 | 0.41 | Comp. |

Comp.: Comparison
Inv.: Present invention

Incidentally, the numerical value of relative photographic speed of thermal processing prior to exposure in Table 4 was obtained as follows. Before a light-sensitive material was exposed to white light, the light-sensitive material was thermally processed at the thermal development temperature. Thereafter, the light-sensitive material was exposed to white light (4874 K and 30 seconds) through an optical wedge and photographic speed was determined. On the other hand, a light-sensitive material was not thermally processed prior to exposure and photographic speed of the light-sensitive material was determined in the same manner as above. Subsequently, when the latter speed was 100, the relative speed of the former was calculated as the above numerical value. Further, in the relative comparison, the main reason of decrease in relative speed of the light-sensitive material which was thermally processed at the thermal development temperature prior to exposure to white light was that the relative relationship between the surface speed and the interior speed of light-sensitive silver halide grains varied due to elimination of or decrease in spectral sensitizing effects. This reason was confirmed through observation/measurement of variation of spectral sensitivity spectra.

As can clearly be seen from Table 4, the silver salt photothermographic dry imaging materials of the present invention resulted in fog (Dmin) less than or equal to comparative examples, but resulted in photographic speed more than or equal to comparative examples. Specifically, it was found that excellent storage stability for difference in ambient humidity as well as excellent processing stability was exhibited. Further, Nos. 10, 12, and 14 exhibited more desired effects compared to Nos. 9, 11, and 13. Thus it was found that the surface coating further enhanced effects of the present invention. Furthermore, based on results of Nos. 9, 11, and 13, it was found that in aliphatic carboxylic acids which constituted aliphatic carboxylic acid silver salts, when the amount of an aliphatic carboxylic acid of the highest addition rate was at least 50 percent, effects of the present invention were markedly exhibited.

Example 2

Aliphatic carboxylic acid silver salts were prepared in the same manner as Example 1, employing the addition pattern described in Table 5, and prior to a dispersion process, dried powder of aliphatic carboxylic acid silver salts was subjected to the thermal process described in Table 4. Coating samples were prepared employing the same method as in Example 1 which employed each of the aliphatic carboxylic acid salts, and evaluated in the same manner as Example 1.

TABLE 5

| Sample No. | Fatty Acid Composition and Addition Pattern: A Fatty Acid Composition (Be:Ar:St) | A Addition Pattern (in minute) | B Fatty Acid Composition (Be:Ar:St) | B Addition Pattern (minute) | C Fatty Acid Composition (Be:Ar:St) | C Addition Pattern (minute) | Addition Pattern of Silver Nitrate | Thermal Processing Condition prior to Silver Salt Dispersion | Remarks |
|---|---|---|---|---|---|---|---|---|---|
| 21 | 48:31:21 | 0.5 to 7.0 | 48:31:21 | 7.0 to 13.5 | 48:31:21 | 13.5 to 20 | 0 to 19.5 | None | Comp. |
| 22 | 48:31:21 | 0.5 to 7.0 | 48:31:21 | 7.0 to 13.5 | 48:31:21 | 13.5 to 20 | 0 to 19.5 | 90° C. 60 second | Comp. |
| 23 | 10:10:80 | 0.5 to 7.0 | 10:10:80 | 7.0 to 13.5 | 10:10:80 | 13.5 to 20 | 0 to 19.5 | None | Comp. |
| 24 | 10:10:80 | 0.5 to 7.0 | 10:10:80 | 7.0 to 13.5 | 10:10:80 | 13.5 to 20 | 0 to 19.5 | 90° C. 60 second | Comp. |
| 25 | 90:8:2 | 0.5 to 7.0 | 90:8:2 | 7.0 to 13.5 | 90:8:2 | 13.5 to 20 | 0 to 19.5 | None | Comp. |
| 26 | 90:8:2 | 0.5 to 7.0 | 90:8:2 | 7.0 to 13.5 | 90:8:2 | 13.5 to 20 | 0 to 19.5 | 90° C. 60 second | Comp. |
| 27 | 48:31:21 | 0.5 to 7.0 | 48:31:21 | 7.0 to 13.5 | 90:8:2 | 13.5 to 20 | 0 to 19.5 | None | Inv. |
| 28 | 48:31:21 | 0.5 to 7.0 | 48:31:21 | 7.0 to 13.5 | 90:8:2 | 13.5 to 20 | 0 to 19.5 | 90° C. 60 second | Inv. |
| 29 | 48:31:21 | 0.5 to 7.0 | 90:8:2 | 7.0 to 13.5 | 90:8:2 | 13.5 to 20 | 0 to 19.5 | None | Inv. |
| 30 | 48:31:21 | 0.5 to 7.0 | 90:8:2 | 7.0 to 13.5 | 90:8:2 | 13.5 to 20 | 0 to 19.5 | 90° C. 60 second | Inv. |
| 31 | 10:10:80 | 0.5 to 7.0 | 90:8:2 | 7.0 to 13.5 | 90:8:2 | 13.5 to 20 | 0 to 19.5 | None | Inv. |
| 32 | 10:10:80 | 0.5 to 7.0 | 90:8:2 | 7.0 to 13.5 | 90:8:2 | 13.5 to 20 | 0 to 19.5 | 90° C. 60 second | Inv. |

Comp.: Comparison
Inv.: Present invention
Addition Pattern is described using the addition time. A flow rate over the addition time was constant and the entire amount was added.

TABLE 6

| Sample No. | Dmin | Relative Photographic Speed | Density Difference between Sample Stored at 20% and Sample Stored at 80% (Exposure amount to result in a density of 1.0 for Sample stored at 80%) | Remarks |
|---|---|---|---|---|
| 21 | 0.191 | 100 | 0.47 | Comp. |
| 22 | 0.195 | 96 | 0.44 | Comp. |
| 23 | 0.245 | 109 | 0.72 | Comp. |
| 24 | 0.273 | 100 | 0.67 | Comp. |
| 25 | 0.182 | 72 | 0.43 | Comp. |
| 26 | 0.183 | 58 | 0.41 | Comp. |
| 27 | 0.189 | 102 | 0.15 | Inv. |
| 28 | 0.187 | 101 | 0.08 | Inv. |
| 29 | 0.182 | 100 | 0.14 | Inv. |
| 30 | 0.182 | 100 | 0.08 | Inv. |
| 31 | 0.184 | 101 | 0.12 | Inv. |
| 32 | 0.184 | 101 | 0.07 | Inv. |

Comp.: Comparison
Inv.: Present invention

As can clearly be seen from Table 6, the silver salt photographic dry imaging materials of the present invention resulted in fog (Dmin) less than or equal to comparative examples, but resulted in photographic speed more than or equal to comparative examples, and excellent storage stability for difference in ambient humidity as well as excellent processing stability was exhibited.

Example 3

Samples were prepared in the same manner as No. 14 of Example 1, except that during <preparation of light-sensitive layer liquid coating compositions>, the type and amount of surface active agents according to the present invention were finally added as described in Table 7 and stirred.

Incidentally, photographic speed was expressed by a relative value-when the photographic speed of Sample No. 1 was 100.

As can clearly be seen from Table 7, the silver salt photothermographic dry imaging materials of the present invention resulted in fog (Dmin) less than or equal to comparative examples, but resulted in photographic speed more than or equal to comparative examples, and excellent storage stability for difference in ambient humidity as well as excellent processing stability was exhibited.

Further, during preparation of light-sensitive silver halide emulsions, gelatin was replaced with succinated gelatin and the same evaluation as above was performed. It was confirmed that the desired results were obtained.

TABLE 7

| No. | Surface Active Agent: HLB Value 3–7 Type | HLB Value 3–7 Added Amount ($g/m^2$) | HLB Value 8 or more Type | HLB Value 8 or more Added Amount ($g/m^2$) | Dmin | Relative Photographic Speed | *1 | Remarks |
|---|---|---|---|---|---|---|---|---|
| 1 | — | — | — | — | 0.184 | 100 | 0.06 | Inv. |
| 2 | propylene glycol monostearic acid ester | 0.1 | — | — | 0.187 | 105 | 0.03 | Inv. |
| 3 | diethylene glycol monostearic acid ester | 0.1 | — | — | 0.188 | 107 | 0.04 | Inv. |
| 4 | glycerin monostearic acid ester | 0.1 | — | — | 0.188 | 105 | 0.04 | Inv. |

TABLE 7-continued

| | Surface Active Agent | | | | | | | |
|---|---|---|---|---|---|---|---|---|
| | HLB Value 3–7 | | HLB Value 8 or more | | | | | |
| No. | Type | Added Amount ($g/m^2$) | Type | Added Amount ($g/m^2$) | Dmin | Relative Photographic Speed | *1 | Remarks |
| 5 | polyoxyethylene-polyoxypropylene copolymer | 0.05 | — | — | 0.184 | 104 | 0.04 | Inv. |
| 6 | polyoxyethylene-polyoxypropylene copolymer | 0.1 | — | — | 0.184 | 107 | 0.03 | Inv. |
| 7 | polyoxyethylene-polyoxypropylene copolymer | 0.2 | — | — | 0.185 | 113 | 0.03 | Inv. |
| 8 | polyoxyethylene-polyoxypropylene copolymer | 0.1 | polyoxypropylene stearic acid ester | 0.1 | 0.187 | 109 | 0.02 | Inv. |
| 9 | polyoxyethylene-polyoxypropylene copolymer | 0.1 | polyoxyethylene sorbitan monostearic acid ester | 0.1 | 0.188 | 108 | 0.02 | Inv. |
| 10 | polyoxyethylene-polyoxypropylene copolymer | 0.1 | polyoxyethylene monostearic acid ester | 0.1 | 0.187 | 110 | 0.02 | Inv. |
| 11 | polyoxyethylene-polyoxypropylene copolymer | 0.1 | polybutylene glycol | 0.1 | 0.188 | 111 | 0.02 | Inv. |
| 12 | polyoxyethylene-polyoxypropylene copolymer | 0.1 | polyoxyethylene-polyoxypropylene copolymer | 0.1 | 0.185 | 113 | 0.02 | Inv. |
| 13 | polyoxyethylene-polyoxypropylene copolymer | 0.1 | polyoxyethylene-polyoxypropylene copolymer | 0.2 | 0.188 | 119 | 0.01 | Inv. |

*1: Density Difference between Sample Stored at 20% and Sample Stored at 80% (Exposure amount to result in a density of 1.0 for Sample stored at 80%)

Inv.: Present Invention

Example 4

Samples were prepared in the same manner as No. 14 of Example 1, except that during <preparation of light-sensitive layer liquid coating compositions>, the type and amount of surface active agents according to the present invention were finally added as described in Table 8 and stirred.

(Determination of Photographic Speed, Fog Density, and Maximum Density)

Density of images prepared as above was determined employing a densitometer, and a characteristic curve, in which the abscissa indicated exposure amount and the ordinate indicated density, was prepared. In the characteristic curve, the inverse of the exposure amount, which resulted in density which was 1.0 higher than the unexposed portion, was defined as photographic speed. Fog density (minimum density) was also determined. Incidentally, the photographic speed of samples was expressed by a relative value when Sample No. 1 (containing no compound represented by General Formula DA) was 100.

(Evaluation of Storage Stability of Images After Development)

(Evaluation of Color Tone of Images: Determination of u* and v* in CIE 1976 Color Space)

By employing a thermal development apparatus, 4-step wedge samples having an unexposed portion as well as portions each having an optical density of 0.5, 1.0, and 1.5 were prepared. The wedge density portions prepared as above were measured employing CM-3600d (produced by Minolta Co., Ltd.) and u* and v* were calculated. Thereafter, samples were continually irradiated with a light of 500 1× at 45° C. (55 percent relative humidity) for three days. Subsequently, the resultant density was determined employing CM-3600d, and u* and v* were calculated, whereby the variation ratios of these were obtained. Measurement conditions were such that F7 was employed as a light source and a transmission measurement mode was employed at a visual field angle of 10 degrees.

TABLE 8

| No. | Compound Represented by General Formula DA species | amount (mol/m$^2$) | Dmin | Relative Photographic Speed | Color Tone Variation Ratio at 45° C. and 500 lx for 3 Days u* (D = 0.5) | v* (D = 0.5) | u* (D = 1.5) | v* (D = 1.5) |
|---|---|---|---|---|---|---|---|---|
| 1 | — | — | 0.184 | 100 | 40% | 33% | 11% | 8% |
| 2 | DA-1-2 | $5 \times 10^{-4}$ | 0.187 | 123 | 6% | 6% | 1% | 1% |
| 3 | DA-1-3 | $5 \times 10^{-4}$ | 0.186 | 120 | 6% | 5% | 1% | 1% |
| 4 | DA-1-6 | $5 \times 10^{-4}$ | 0.186 | 118 | 7% | 6% | 1% | 1% |
| 5 | DA-2-1 | $5 \times 10^{-4}$ | 0.185 | 110 | 8% | 6% | 1% | 1% |
| 6 | DA-2-3 | $5 \times 10^{-4}$ | 0.185 | 106 | 9% | 7% | 1% | 2% |

Notes: A numerical value in the parenthesis was obtained as follows. Before a light-sensitive material was exposed to white light, the light-sensitive material was thermally processed at the thermal development temperature.

Thereafter, the light-sensitive material was exposed to white light (4874 K and 30 seconds) through an optical wedge and photographic speed was determined. On the other hand, a light-sensitive material was not thermally processed prior to exposure and photographic speed of the light-sensitive material was determined in the same manner as above. Subsequently, when the latter speed was 100, the relative speed of the former was calculated as the above numerical value. Further, in the relative comparison, the main reason of decrease in relative speed of the light-sensitive material which was thermally processed at the thermal development temperature prior to exposure to white light was that the relative relationship between the surface speed and the interior speed of light-sensitive silver halide grains varied due to elimination of or decrease in spectral sensitizing effects. This reason was confirmed through observation/measurement of variation of spectral sensitivity spectra.

As can clearly be seen from Table 8, the silver salt photothermographic dry imaging materials containing a compound represented by General Formula DA resulted in fog (Dmin) less than or equal to Sample No. 1 without such compound, but resulted in photographic speed more than or equal to that Sample No. 1. Specifically, storage stability (variation of color tone) of images after photographic processing was found to be excellent based on the fact that the variation ratio in the color tone evaluation was less than Sample No. 1.

What is claimed is:

1. A photothermographic imaging material comprising a support having thereon light-insensitive organic silver salt grains, photosensitive silver halide grains, a reducing agent for silver ions, a binder and a compound represented by Formula (1):

Formula (1)

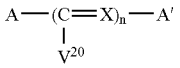

wherein X represents $C(V^{21})$ or a nitrogen atom, each $V^{20}$ and $V^{21}$ independently represents a hydrogen atom or a substituent, provided that $V^{20}$ and $V^{21}$ may form a ring by binding together; each A and A' independently represents a hydrogen atom or a substituent, provided that at least one of A and A' represents OH, OR, $NH_2$, NHR or NRR', each R and R' independently representing a hydrogen atom or a substituent; and A and A' may form a ring by binding together; and n represents an integer of 0 to 5, and wherein:

(a) each one of the photosensitive silver halide grains produces a larger number of latent images in a surface portion of the grain than in an inner portion of the grain by exposure to light;

(b) each one of the photosensitive silver halide grains produces a larger number of latent images in the inner portion of the grain than in the surface portion of the grain after being subjected to a thermal development; and (c) a surface photographic speed of each of the photosensitive silver halide grains decreases after being subjected to the thermal development.

2. The photothermographic imaging material of claim 1, the compound represented by Formula (1) is further represented by Formula (DA-1) or Formula (DA-2):

Formula (DA-1)

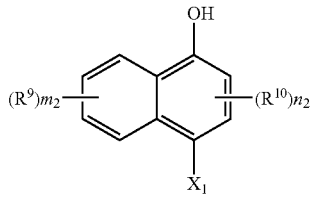

Formula (DA-2)

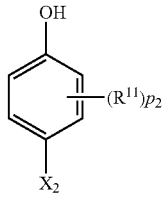

wherein, each $X_1$ and $X_2$ is independently a hydrogen atom or a substituent; each $R^9$ and $R^{11}$ is independently a hydrogen atom or a substituent; each m2 and p2 is independently an integer of 0 to 4; and n2 is an integer of 0 to 2.

3. The photothermographic imaging material of claim 1, wherein each of the light-insensitive organic silver salt grains has a structure having different silver ion dissociation constants at a surface portion of the grain and at an inner portion of the grain.

4. The photothermographic imaging material of claim 1, wherein:

(i) each of the light-insensitive organic silver salt grains comprises an aliphatic carboxylic acid and a silver salt of the aliphatic carboxylic acid; and (ii) each of the light-insensitive organic silver salt grains has a different weight ratio of the aliphatic carboxylic acid to the silver salt of the aliphatic carboxylic acid in the surface portion of the grain and in the inner portion of the grain.

5. The photothermographic imaging material of claim 1, wherein each of the light-insensitive organic silver salt grains is covered with a coating material.

6. The photothermographic imaging material of claim 1, wherein the light-insensitive organic silver salt grains are subjected to a thermal treatment at no less than 80° C.

7. The photothermographic imaging material of claim 1, wherein the light-insensitive organic silver salt grains comprises one kind of silver salt of an aliphatic carboxylic acid in an amount of not less than 50 mol % based on the total mol of the silver salts of aliphatic carboxylic acids contained in the organic silver salt grains.

8. The photothermographic imaging material of claim 1, further comprising a surface active agent having a HLB value of 3 to 7.

9. The photothermographic imaging material of claim 8, still further comprising a surface active agent having a HLB value of not less than 8.

10. The photothermographic imaging material of claim 1, further comprising a gelatin which is dispersible in an organic solvent as a dispersing agent for the photosensitive silver halide grains.

* * * * *